US006297001B1

(12) United States Patent
Takiguchi et al.

(10) Patent No.: US 6,297,001 B1
(45) Date of Patent: Oct. 2, 2001

(54) PHOTOTHERMOGRAPHIC MATERIAL

(75) Inventors: Hideki Takiguchi; Katsura Hirai, both of Hino (JP)

(73) Assignee: Konica Corporation (JP)

( * ) Notice: Subject to any disclaimer, the term of this patent is extended or adjusted under 35 U.S.C. 154(b) by 0 days.

(21) Appl. No.: 09/514,890

(22) Filed: Feb. 28, 2000

(30) Foreign Application Priority Data

Mar. 5, 1999 (JP) ..... 11-058684

(51) Int. Cl.[7] ..... G03C 1/498; G03C 1/12; G03C 1/34

(52) U.S. Cl. ..... 430/619; 430/581; 430/583; 430/584; 430/587; 430/600; 430/607; 430/611; 430/610; 430/614; 430/615; 430/944

(58) Field of Search ..... 430/619, 600, 430/607, 611, 613, 614, 615, 584, 583, 581, 587, 944

(56) References Cited

U.S. PATENT DOCUMENTS

| | | | | |
|---|---|---|---|---|
| 4,960,681 | * | 10/1990 | Aotsuka | 430/351 |
| 5,637,550 | * | 6/1997 | Leenders et al. | 503/503 |
| 5,686,228 | * | 11/1997 | Murray et al. | 430/619 |
| 5,714,311 | * | 2/1998 | Cowdery-Corvan et al. | 430/607 |
| 5,952,167 | * | 9/1999 | Okada et al. | 430/619 |

* cited by examiner

*Primary Examiner*—Thorl Chea
(74) *Attorney, Agent, or Firm*—Jordan B. Bierman; Bierman, Muserlian and Lucas

(57) ABSTRACT

A photothermographic material is disclosed, comprising a non-photosensitive organic silver salt, a photosensitive silver halide, a reducing agent a binder and a cross-linking agent; the photothermographic material further comprising a compound capable of generating a labile species other than a halogen atom upon exposure to ultraviolet radiation or visible radiation to deactivate the reducing agent.

16 Claims, No Drawings

PHOTOTHERMOGRAPHIC MATERIAL

FIELD OF THE INVENTION

The present invention relates to photothermographic materials with superior storage stability and in particular to black-and-white thermally developable silver salt photothermographic materials with superior storage stability of silver images.

BACKGROUND OF THE INVENTION

In the field of medical treatment and graphic arts, there have been problems in working property with respect to effluents produced from wet-processing of image forming materials, and recently, reduction of the processing effluent is strongly demanded in terms of environment protection and space saving.

Accordingly, there are needed techniques regarding photothermographic materials for photographic use and which are capable of forming black images exhibiting high sharpness, enabling efficient exposure by means of a laser imager or laser image setter. As such a technique is known a thermally developable photosensitive material, which comprises a support having thereon an organic silver salt, light-sensitive silver halide grains and a reducing agent, as described in U.S. Pat. Nos. 3,152,904 and 3,487,075; and D. Morgan "Dry Silver Photographic Material" (Handbook of Imaging Materials, Marcel Dekker, Inc., page 48, 1991). No processing solution is used in this thermally developable photosensitive material (hereinafter, also referred to as a photothermographic material), enabling a simple system friendly to the environment and operators.

Since this thermally developable photothermographic material contains an organic silver salt, light-sensitive silver halide grains and a reducing agent, there are problems such that the photothermographic material not only tends to cause fogging before or during thermal development but also easily produces fog or photolytic silver (or print-out silver). Specifically, this photothermographic material, after exposure, is subjected only to thermal development at a temperature of 80 to 250° C., without being further subjected to fixing so that there was such problems that silver images causes discoloring upon exposure to light or heat during storage under the concurrent presence of the silver halide, organic silver salt and reducing agent which remained in unexposed areas.

A technique for solving these problems is disclosed in JP-A 6-208192 and 8-267934 (herein, the term, JP-A means a unexamined and published Japanese Patent Application) and references cited therein. Although these disclosed techniques were effective to some extent, they were not sufficiently so as a technique to satisfy levels required by the market.

SUMMARY OF THE INVENTION

In view of the foregoing problems, an object of the present invention is to provide a thermally developable photothermographic material which produces little fog when allowed to stand for a long period of time and producing silver images superior in storage stability, and an image forming method by use thereof.

The object of the invention can be accomplished by the following constitution:

1. A photothermographic material comprising a non-photosensitive organic silver salt, a photosensitive silver halide, a reducing agent, a binder and a cross-linking agent; the photothermographic material further comprising a compound capable of generating a labile species other than a halogen atom upon exposure to ultraviolet radiation or visible radiation to deactivate the reducing agent;
2. An image forming method comprising exposure of the photothermographic material described above to laser light by using a laser exposure apparatus, wherein scanning laser light is not exposed at an angle substantially vertical to the exposed surface of the photosensitive material;
3. An image recording method comprising exposure of the photothermographic material described above to laser by using a laser exposure apparatus, wherein scanning laser light is longitudinally multiple; and
4. An image recording method, wherein the photothermographic material described described above is thermally developed in a state containing an organic solvent of 5 to 1,000 mg/m$^2$.

DETAILED DESCRIPTION OF THE INVENTION

The photothermographic material comprises a) a non-photosensitive organic silver salt, b) a photosensitive silver halide, c) a reducing agent capable of reducing a silver ion of the organic silver salt when activated upon heating, d) a binder and e) a cross-linking agent for the binder. Concurrent presence of silver halide as a photoreceptor, the organic silver salt as a silver source and the reducing agent deteriorates pre-exposure storage stability of the photothermographic material. No fixation subsequent to development produces disadvantages in stability after being developed, such as occurrence of marked print-out when exposed to light. Such disadvantages are contemplated to be due to the fact that the presence of a reducing agent in the photosensitive material easily causes thermal fogging upon reaction with an organic silver salt and the reducing agent functions not only as reduction of a silver ion but also as a hole trap when exposed, after development, to light in the wavelength region different from that of the image recording light, promoting print-out of silver halide and the organic silver salt.

It was discovered that problems such as described above could be solved by incorporating a compound capable of generating a labile species, which deactivated the reducing agent on exposure to ultraviolet or visible radiation after thermal development to inhibit reduction of the silver halide and the organic silver salt. As a reducing agent used in photothermographic materials are employed reducing agents containing a proton, such as bisphenols and sulfonamidophenols. Accordingly, a compound generating a labile species which is capable of abstracting a proton to deactivate the reducing agent is preferred. More preferred is a compound as a non-colored photooxidizing substance, which is capable of generating a free radical as a labile species on exposure. Any compound having such a function is applicable. However, a halogen radical, which easily forms silver halide is not preferred. An organic free radical composed of plural atoms is preferred. Any compound having such a function and exhibiting no adverse effect on the photothermographic material is usable irrespective of its structure.

Of such free radical generation compounds, a compound containing an aromatic, and carbocyclic or heterocyclic group is preferred, which provides stability to the generated free radical so as to be in contact with the reducing agent for a period sufficient to react with the reducing agent to deactivate it. Representative examples of such compounds include biimidazolyl compounds and iodonium compounds. The imidazolyl compounds generate two imidazolyl radicals as a free radical upon exposure to ultraviolet or visible radiation, which are capable of oxidizing a reducing agent remaining after development, thereby inhibiting reduction of silver salts. It is surprising that the imidazolyl compound is photo-active and capable of oxidizing a reducing agent effective in heat-promoted reduction of a substantially non-photosensitive organic silver salt.

Of such imidazolyl compounds, a compound represented by the following formula [1] is preferred:

Formula [1]

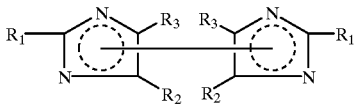

wherein $R_1$, $R_2$ and $R_3$ (,which may be the same or different) each are an alkyl group (e.g., methyl, ethyl, hexyl), an alkenyl group (e.g., vinyl, allyl), an alkoxyl group (e.g., methoxy, ethoxy, octyloxy), an aryl group (e.g., phenyl, naphthyl, tolyl), hydroxy, a hydrogen atom, a halogen atom, an aryloxyl (e.g., phenoxy), an alkylthio group (e.g., methylthio, butylthio), an arylthio group (e.g., phenylthio), a heterocyclic group (e.g., pyridyl, triazyl), an acyl group (e.g., acetyl, propionyl, butylyl, valeryl), a sulfonyl group (e.g., methylsulfonyl, phenylsulfonyl), an acylamino group, sulfonylamino group, an acyloxy group (e.g., acetoxy, benzoxy), carboxy, cyano, a sulfo group, or an amino group. Of these groups are preferred an aryl group, a heterocyclic group, an alkenyl group and cyano group.

The biimidazolyl compounds can be synthesized in accordance with the methods described in U.S. Pat. No. 3,734,733 and British Patent 1,271,177. Preferred Examples thereof are shown below.

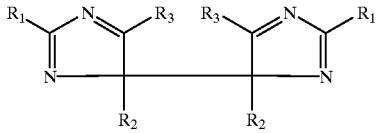

| | $R_1$ | $R_2$ | $R_3$ |
|---|---|---|---|
| BI-1 | H | CN | H |
| BI-2 | CN | H | CN |
| BI-3 | $CF_3$ | H | $CF_3$ |
| BI-4 | 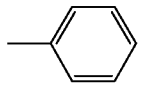 | 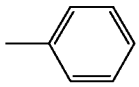 | 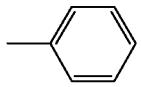 |
| BI-5 | 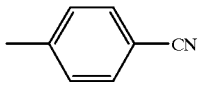 | 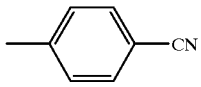 | 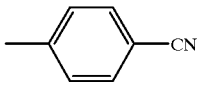 |
| BI-6 | 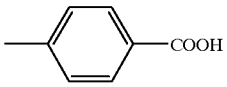 | 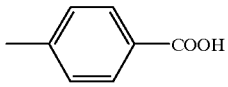 | 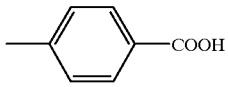 |
| BI-7 | H | —CH=$CH_2$ | H |
| BI-8 | 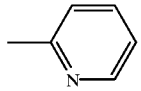 | 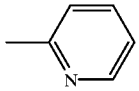 | 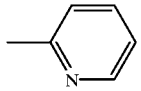 |
| BI-9 | 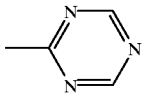 | 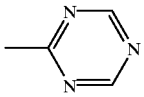 | 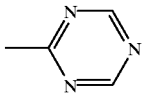 |

-continued

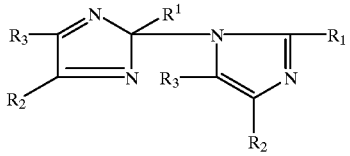

| | $R_1$ | $R_2$ | $R_3$ |
|---|---|---|---|
| BI-10 | H | 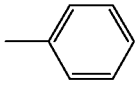 | 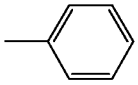 |
| BI-11 | CN | H | H |
| BI-12 | CN | 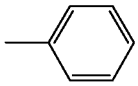 | 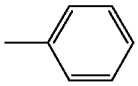 |
| BI-13 | H | 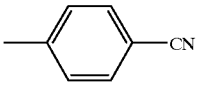 | 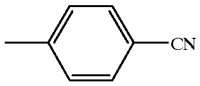 |
| BI-14 | H | $CF_3$ | H |
| BI-15 | H | 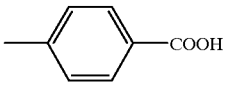 | 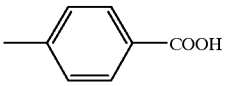 |
| BI-16 | H | 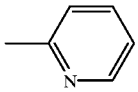 | 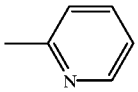 |

Similarly preferred compounds include a iodonium compound represented by the following formula (2):

Formula [2]

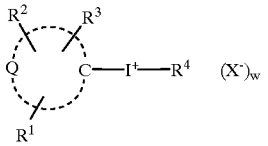

wherein Q is a group of atoms necessary to complete a 5-, 6-, or 7-membered ring, and the atoms being selected from a carbon atom, nitrogen atom, oxygen atom and sulfur atom; and $R^1$, $R^2$ and $R^3$ (,which may be the same or different) are each a hydrogen atom, an alkyl group (e.g., methyl, ethyl, hexyl), an alkenyl group (e.g., vinyl, allyl), an alkoxyl group (e.g., methoxy, ethoxy, octyloxy), an aryl group (e.g., phenyl, naphthyl, tolyl), hydroxy, a halogen atom, an aryloxyl (e.g., phenoxy), an alkylthio group (e.g., methylthio, butylthio), an arylthio group (e.g., phenylthio), an acyl group (e.g., acetyl, propionyl, butylyl, valeryl), a sulfonyl group (e.g., methylsulfonyl, phenylsulfonyl), an acylamino group, sulfonylamino group, an acyloxy group (e.g., acetoxy, benzoxy), carboxy, cyano, a sulfo group, or an amino group. Of these groups are preferred an aryl group, an alkenyl group and cyano group, provided that $R^1$, $R^2$ and $R^3$ may be bonded with each other to form a ring; $R^4$ is a carboxylate group such as acetate, benzoate or trifluoroacetate, or $O^-$; W is 0 or 1, provided that when $R^3$ is a sulfo group or a carboxy group, W is 0 and $R^4$ is $O^-$; $X^-$ is an anionic counter ion, including $CH_3CO_2$—, $CH_3SO_3$— and $PF_6^-$.

Of these is specifically preferred a compound represented by the following formula [3]:

Formula [3]

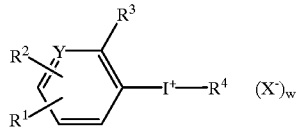

wherein $R^1$, $R^2$, $R^3$, $X^-$ and W are each the same as defined in formula [2]; Y is a carbon (i.e., —CH═) to form a benzene ring or a nitrogen atom (—N═) to form a pyridine ring.

The iodonium compounds described above can be synthesized in accordance with the methods described in Org. Syn., 1961 and Fieser, "Advanced Organic Chemistry" (Reinhold, N.Y., 1961). Examples of the suitable compounds are represented by the following general formulas.

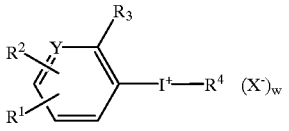

| Compound | $R^1$ | $R^2$ | $R^3$ | $R^4$ | W | X | Y |
|---|---|---|---|---|---|---|---|
| I-1 | H | H | H | $OCOCH_3$ | 1 | $OCOCH_3$ | C |
| I-2 | H | H | H | $OCOCF_3$ | 1 | $OCOCF_3$ | C |
| I-3 | H | $CH_3$ | H | $OCOCH_3$ | 1 | $OCOOH_3$ | C |
| I-4 | H | $CH_3$ | $CO_2H$ | $O^-$ | 0 | — | C |
| I-5 | H | H | $CO_2H$ | $O^-$ | 0 | — | C |
| I-6 | H | CN | $CO_2H$ | $O^-$ | 0 | — | C |
| I-7 | $OCH_3$ | $CH_3$ | H | $OCOCH_3$ | 1 | $OCOCH_3$ | C |
| I-8 | $CH_3$ | $CH_3$ | $CH_3$ | $OCOCH_3$ | 1 | $OCOCH_3$ | C |
| I-9 | $CH_3$ | $CH_3$ | H | $OCOCH_3$ | 1 | $OCOCH_3$ | C |
| I-12 | $CH_3$ | $CH_3$ | $CO_2H$ | $O^-$ | 0 | — | C |
| I-13 | H | H | $SO_3H$ | $O^-$ | 0 | — | C |
| I-14 | H | CN | $CO_2H$ | $O^-$ | 0 | — | C |
| I-15 | $OCH_3$ | Cl | H | $OCOCH_3$ | 1 | $OCOCH_3$ | C |
| l-16 | $CO_2H$ | H | H | $OCOCH_3$ | 1 | $OCOCH_3$ | C |
| I-17 | $OCH_3$ | Cl | $CH_3$ | $OCOCH_3$ | 1 | $OCOCH_3$ | C |
| I-18 | H | H | H | $OCOCH_2CH_3$ | 1 | $OCOCH_2CH_3$ | C |
| I-19 | H | $CH_2OH$ | H | $OCOCH_3$ | 1 | $OCOCH_3$ | C |
| I-20 | Cl | $CH_2OH$ | $CO_2H$ | $O^-$ | 0 | — | C |
| I-21 | Cl | $CH_3$ | $SO_3H$ | $O^-$ | 0 | — | C |
| I-22 | $CH_3$ | CN | $CO_2H$ | $O^-$ | 0 | — | C |
| I-23 | $CF_3$ | Cl | H | $OCOCH_3$ | 1 | $OCOCH_3$ | C |
| I-24 | $CO_2H$ | H | H | $OCOCH_3$ | 1 | $OCOCH_3$ | C |
| I-25 | $OCCH_3$ | H | $C_6H_5$ | $OCOCH_3$ | 1 | $OCOCH_3$ | C |
| I-26 | $C_6H_5$ | H | H | $OCOCH_3$ | 1 | $OCOCH_2CH_3$ | C |
| I-27 | $C_6H_4CO_2H$ | H | H | $OCOCH_3$ | 1 | $OCOCH_3$ | C |
| I-28 | H | $CH_2OH$ | $CO_2H$ | $O^-$ | 0 | — | C |
| I-29 | $SO_2CH_3$ | H | H | $OCOCH_3$ | 1 | $OCOCH_3$ | C |
| I-30 | Cl | CN | $CO_2H$ | $O^-$ | 0 | — | |
| I-31 | $CF_3$ | $OCH_3$ | H | $OCOCH_3$ | 1 | $OCOCH_3$ | C |
| I-32 | $CO_2H$ | $CO_2H$ | H | $OCOCH_3$ | 1 | $OCOCH_3$ | C |
| I-33 | H | H | H | $OCOCH_3$ | 1 | $OCOCH_3$ | N |
| I-34 | H | H | H | $OCOCF_3$ | 1 | $OCOCF_3$ | N |
| I-35 | H | COOH | COOH | $O^-$ | 1 | $OCOCH_3$ | N |
| I-36 | H | CN | COOH | $O^-$ | 0 | — | N |

I-37

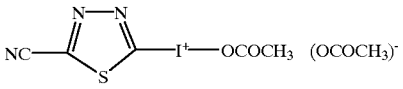

I-38

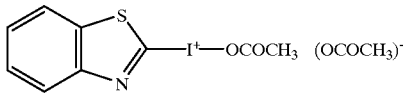

The compound releasing a labile species other than a halogen atom, such as represented by formula [1] or [2] is incorporated preferably in an amount of 0.001 to 0.1 mol/$m^2$, and more preferably 0.005 to 0.05 mol/$m^2$. The compound may be incorporated into any component layer of the photothermographic material relating to the invention and is preferably incorporated in the vicinity of a reducing agent.

As a compound capable of deactivating a reducing agent to inhibit reduction of an organic silver salt to silver by the reducing agent are preferred compounds releasing a labile species other than a halogen atom. However, these compounds may be used in combination with a compound capable of releasing a halogen atom as a labile species. The compound capable of releasing a halogen atom as a labile species is used preferably in an amount of 0.001 to 0.1 mol/$m^2$ and more preferably 0.005 to 0.05 mol/$m^2$. Exemplary examples of the compound releasing an active halogen atom include a compound represented by the following formula [4]:

Formula [4]

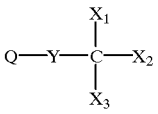

wherein Q is an aryl group or a heterocyclic group; $X_1$, $X_2$ and $X_3$ are each a hydrogen atom, a halogen atom, a haloalkyl group, an acyl group, an alkoxycarbonyl group, an aryloxycarbonyl group, a sulfonyl group, an aryl group or a heterocyclic group, provided that at least of them a halogen atom; Y is —C(=O)—, —SO— or —$SO_2$—. The aryl group represented by Q may be a monocyclic group or condensed ring group and is preferably a monocyclic or di-cyclic aryl group having 6 to 30 carbon atoms (e.g., phenyl, naphthyl), more preferably a phenyl or naphthyl group, and still more preferably a phenyl group. The heterocyclic group represented by Q is a 3- to 10-membered, saturated or unsaturated heterocyclic group containing at least one of N, O and S, which may be a monocyclic or condensed with another ring to a condensed ring.

The heterocyclic group is preferably a 5- or 6-membered unsaturated heterocyclic group, which may be condensed, more preferably a 5- or 6-membered aromatic heterocyclic group, which may be condensed, still more preferably a N-containing 5- or 6-membered aromatic heterocyclic group, which may be condensed, and optimally a 5- or 6-membered aromatic heterocyclic group containing one to four N atoms, which may be condensed. Exemplary examples of heterocyclic rings included in the heterocyclic group include imidazole, pyrazole, pyridine, pyrimidine, pyrazine, pyridazine, triazole, triazines, indole, indazole, purine, thiazole, oxadiazole, quinoline, phthalazine, naphthyridine, quinoxaline, quinazoline, cinnoline, pteridine, acrydine, phenanthroline, phenazine, tetrazole, thiazole, oxazole, benzimidazole, benzoxazole, benzthiazole, indolenine and tetrazaindene. Of these are preferred imidazole, pyridine, pyrimidine, pyrazine, pyridazine, triazole, triazines, thiadiazole, oxadiazole, quinoline, phthalazine, naphthylizine, quinoxaline, quinazoline, cinnoline, tetrazole, thiazole, oxazole, benzimidazole, and tetrazaindene; more preferably imidazole, pyrimidine, pyridine, pyrazine, pyridazine, triazole, triazines, thiadiazole, quinoline, phthalazine, naphthyridine, quinoxaline, quinazoline, cinnoline, tetrazole, thiazole, benzimidazole, and benzthiazole; and still more preferably pyridine, thiazole, quinoline and benzthiazole.

The aryl group or heterocyclic group represented by Q may be substituted by a substituent, in addition to —Y—C($X_1$)($X_2$)($X_3$). Preferred examples of the substituent include an alkyl group, an alkenyl group, an aryl group, an alkoxyl group, an aryloxyl group, an acyloxy group, an acyl group, an alkoxycarbonyl group, an aryloxycarbonyl group, an acyloxy group, an acylamino group, an alkoxycarbonylamino group, an aryloxycarbonylamino group, a sulfonylamino group, a sulfamoyl group, a carbamoyl group, a sulfonyl group, a ureido group, phosphoramido group, a halogen atom, cyano group, sulfo group, carboxy group, nitro group and heterocyclic group. Of these are preferred an alkyl group, an aryl group, an alkoxyl group, an aryloxyl group, an acyl group, an acylamino group, an aryloxyl group, acyl group, an acylamino group, an alkoxycarbonyl group, an aryloxycarbonylamino group, a sulfonylamino group, a sulfamoyl group, a carbamoyl group, a ureido group, phosphoramido group, a halogen atom, cyano group, nitro group, and a heterocyclic group; and more preferably an alkyl group, an aryl group, an alkoxyl group, an aryloxyl group, an acyl group, an acylamino group, a sulfonylamino group, a sulfamoyl group, a carbamoyl group, a halogen group, cyano group, nitro group and a heterocyclic group; and still more preferably an alkyl group, an aryl group and a halogen atom.

$X_1$, $X_2$ and $X_3$ are preferably a halogen atom, a haloalkyl group, an acyl group, an alkoxycarbonyl group, an aryloxycarbonyl group, a carbamoyl group, a sulfamoyl group, a sulfonyl group, and a heterocyclic group, more preferably a halogen atom, a haloalkyl group, an acyl group, an alkoxycarbonyl group, an aryloxycarbonyl group, and a sulfonyl group; and still more preferably a halogen atom and trihalomethyl group; and most preferably a halogen atom. Of halogen atoms are preferably chlorine atom, bromine and iodine atom, and more preferably chlorine atom and bromine atom, and still more preferably bromine atom. Y is —C(=O)—, —SO—, and —$SO_2$—, and preferably —$SO_2$—.

Exemplary examples of these compounds are shown below.

4-1

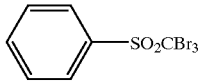

4-2

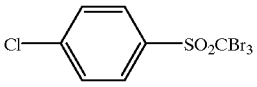

4-3

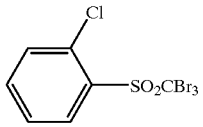

4-4

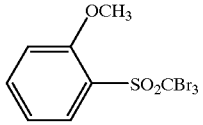

4-5

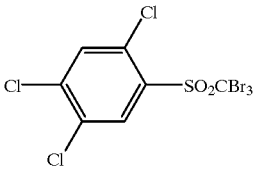

4-6

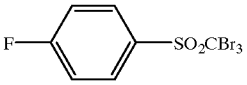

4-7

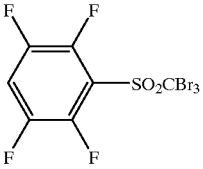

4-8

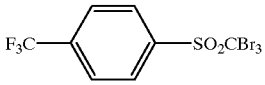

4-9

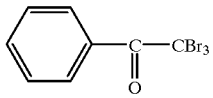

4-10

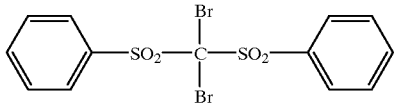

-continued
4-11
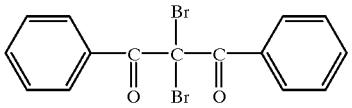
4-12
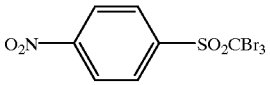
4-13
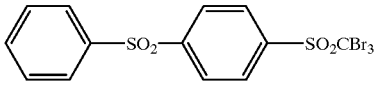
4-14
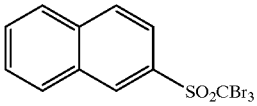
4-15
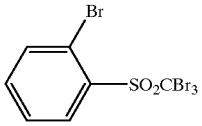
4-16
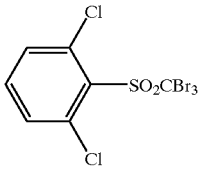
4-17
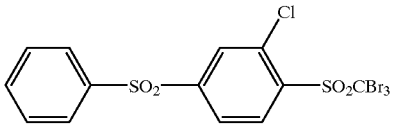
4-18
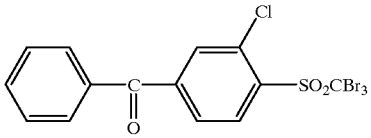
4-19
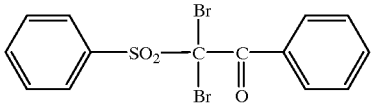
4-20
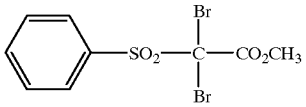
4-21
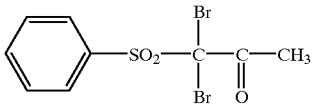
4-22
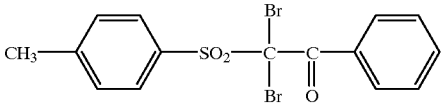
-continued
4-23
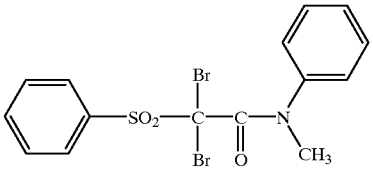
4-24
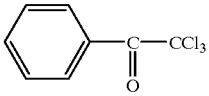
4-25
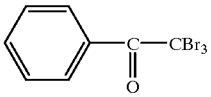
4-26
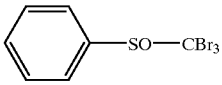
4-27
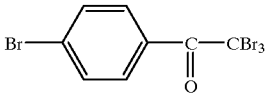
4-28
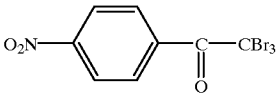
4-29
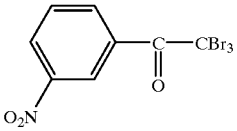
4-30
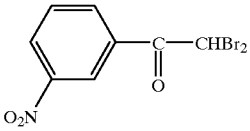
4-31
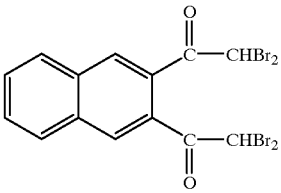
4-32
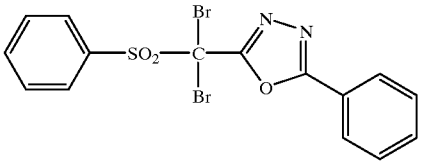
4-33
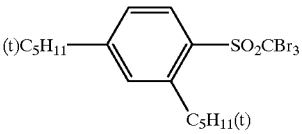

-continued
4-34
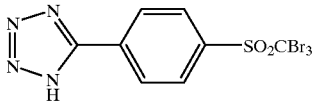
4-35
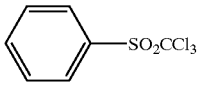
4-36
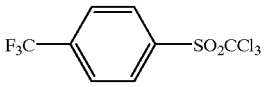
4-37
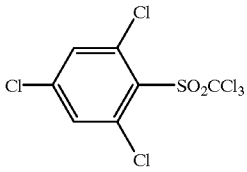
4-38
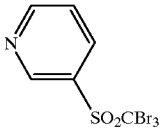
4-39
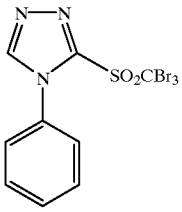
4-40
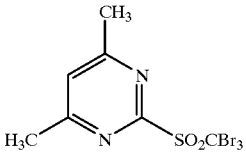
4-41
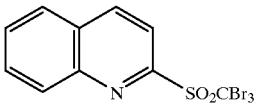
4-42
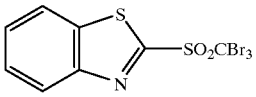
4-43
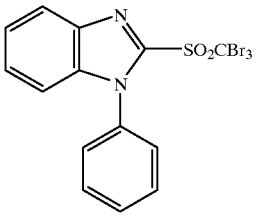
-continued
4-44
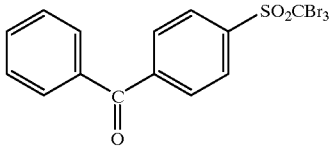
4-45
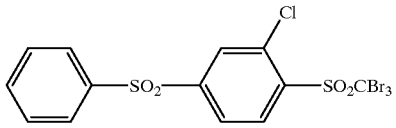
4-46
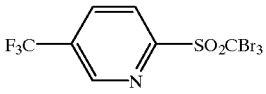
4-47
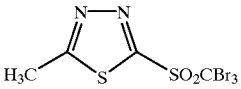
4-48
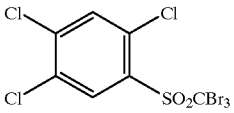
4-49
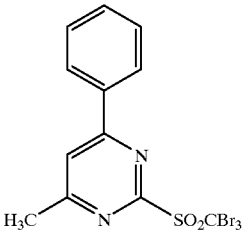
4-50
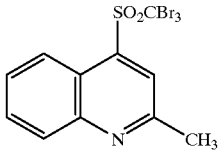
4-51
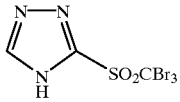
4-52
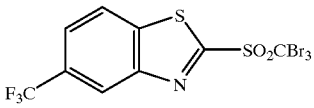
4-53
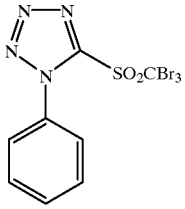

-continued 4-54

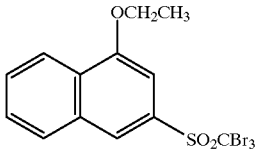

4-55

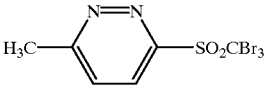

4-56

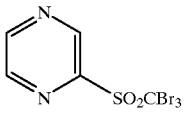

4-57

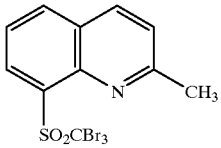

4-58

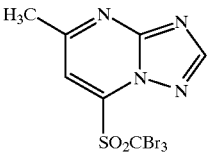

4-59

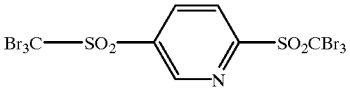

4-60

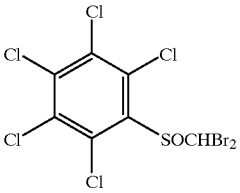

4-61

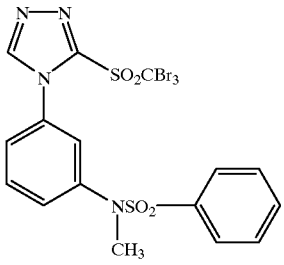

4-62

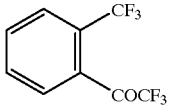

4-63

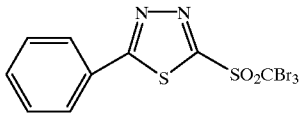

-continued 4-64

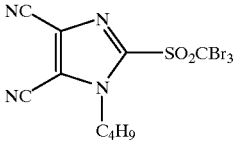

These compounds are incorporated in an amount within a range such that increased formation of print-out silver produces substantially no problem, preferably in an amount of not more than 150%, and more preferably not more than 100% based on the compound releasing a labile species other than a halogen atom. As afore-mentioned, these compounds deactivate a reducing agent included in the thermally developable photosensitive layer, enhancing storage stability of the photothermographic material. Reducing agents used in the photothermographic materials and capable of deactivating a free radical will be described.

Reducing agents are incorporated into the photothermographic material of the present invention. Examples of suitable reducing agents are described in U.S. Pat. Nos. 3,770,448, 3,773,512, and 3,593,863, and Research Disclosure Items 17029 and 29963, and include the following: aminohydroxycycloalkenone compounds (for example, 2-hydroxypiperidino-2-cyclohexane); esters of amino reductones as the precursor of reducing agents (for example, piperidinohexose reducton monoacetate); N-hydroxyurea derivatives (for example, N-p-methylphenyl-N-hydroxyurea); hydrazones of aldehydes or ketones (for example, anthracenealdehyde phenylhydrazone; phosphamidophenols; phosphamidoanilines; polyhydroxybenzenes (for example, hydroquinone, t-butylhydroquinone, isopropylhydroquinone, and (2,5-dihydroxy-phenyl) methylsulfone); sulfydroxamic acids (for example, benzenesulfhydroxamic acid); sulfonamidoanilines (for example, 4-(N-methanesulfonamide)aniline); 2-tetrazolylthiohydroquinones (for example, 2-methyl-5-(1-phenyl-5-tetrazolylthio)hydroquinone); tetrahydroquinoxalines (for example, 1,2,3,4-tetrahydroquinoxaline); amidoxines; azines (for example, combinations of aliphatic carboxylic acid arylhydrazides with ascorbic acid); combinations of polyhydroxybenzenes and hydroxylamines, reductones and/or hydrazine; hydroxamic acids; combinations of azines with sulfonamidophenols; α-cyanophenylacetic acid derivatives; combinations of bis-β-naphthol with 1,3-dihydroxybenzene derivatives; 5-pyrazolones, sulfonamidophenol reducing agents, 2-phenylindane-1,3-dione, etc.; chroman; 1,4-dihydropyridines (for example, 2,6-dimethoxy-3,5-dicarboethoxy-1,4-dihydropyridine); bisphenols (for example, bis(2-hydroxy-3-t-butyl-5-methylphenyl)methane, bis(6-hydroxy-m-tri)mesitol, 2,2-bis(4-hydroxy-3-methylphenyl)propane, 4,5-ethylidene-bis(2-t-butyl-6-methyl)phenol, UV-sensitive ascorbic acid derivatives and 3-pyrazolidones. Of these, particularly preferred reducing agents are hindered phenols. As hindered phenols, listed are compounds represented by the general formula (A) described below:

Formula (A)

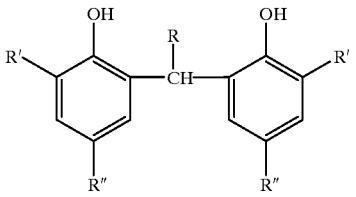

wherein R represents a hydrogen atom or an alkyl group having from 1 to 10 carbon atoms (for example, isopropyl, —$C_4H_9$, 2,4,4-trimethylpentyl), and R' and R" each represents an alkyl group having from 1 to 5 carbon atoms (for example, methyl, ethyl, t-butyl).

Exemplary examples of the compounds represented by the formula (A) are shown below.

A–1

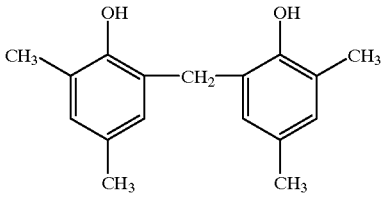

A–2

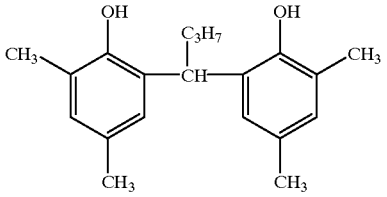

A–3

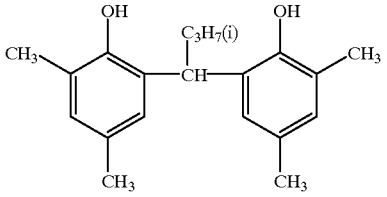

A–4

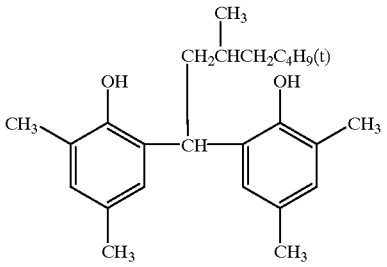

A–5

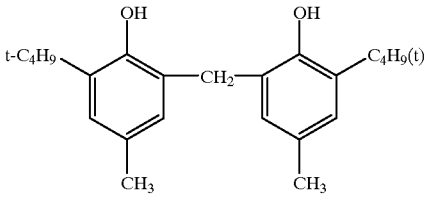

-continued

A–6

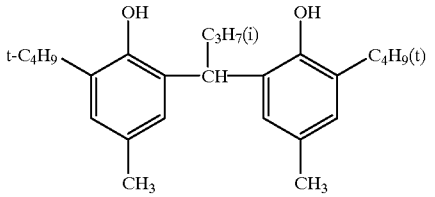

A–7

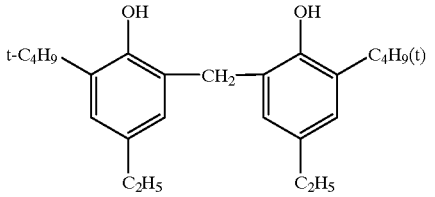

The used amount of reducing agents represented by the above-mentioned general formula (A) is preferably between $1\times10^{-2}$ and 10 moles, and is more preferably between $1\times10^{-2}$ and 1.5 moles per mole of silver.

The photothermographic material according to the invention contains a photosensitive silver halide and an organic silver salt.

Photosensitive silver halide grains used in the invention will be described.

Silver halide emulsions used in the invention can be prepared according to the methods described in P. Glafkides, Chimie Physique Photographique (published by Paul Montel Corp., 19679; G. F. Duffin, Photographic Emulsion Chemistry (published by Focal Press, 1966); V. L. Zelikman et al., Making and Coating of Photographic Emulsion (published by Focal Press, 1964). Any one of acidic precipitation, neutral precipitation and ammoniacal precipitation is applicable and the reaction mode of aqueous soluble silver salt and halide salt includes single jet addition, double jet addition and a combination thereof. Specifically, preparation of silver halide grains with controlling the grain formation condition, so-called controlled double-jet precipitation is preferred. The halide composition of silver halide is not specifically limited and may be any one of silver chloride, silver chlorobromide, silver iodochlorobromide, silver bromide, silver iodobromide and silver iodide.

The grain formation process is usually classified into two stages of formation of silver halide seed crystal grains (nucleation) and grain growth. These stages may continuously be conducted, or nucleation (seed grain formation) and grain growth may be separately performed. The controlled double-jet precipitation, in which grain formation is undergone with controlling grain forming conditions such as pAg and pH, is preferred to control the grain form or grain size. In cases when nucleation and grain growth are separately conducted, for example, a soluble silver salt and a soluble halide salt are homogeneously and promptly mixed in an aqueous gelatin solution to form nucleus grains (seed grains), thereafter, grain growth is performed by supplying soluble silver and halide salts, while being controlled at a pAg and pH to prepare silver halide grains. After completing the grain formation, the resulting silver halide grain emulsion is subjected to desalting to remove soluble salts by commonly known washing methods such as a noodle washing method, a flocculation method, a ultrafiltration method, or electrodialysis to obtain desired emulsion grains.

In order to minimize cloudiness after image formation and to obtain excellent image quality, the less the average grain size, the more preferred, and the average grain size is preferably not more than 0.2 μm, more preferably between 0.01 and 0.17 μm, and still more preferably between 0.02 and 0.14 μm. The average grain size as described herein is defined as an average edge length of silver halide grains, in cases where they are so-called regular crystals in the form of cube or octahedron. Furthermore, in cases where grains are tabular grains, the grain size refers to the diameter of a circle having the same area as the projected area of the major faces. Furthermore, silver halide grains are preferably monodisperse grains. The monodisperse grains as described herein refer to grains having a coefficient of variation of grain size obtained by the formula described below of not more than 7%; more preferably not more than 5%, still more preferably not more than 3%, and most preferably not more than 1%.

Coefficient of variation of grain size=standard deviation of grain diameter/average grain diameter×100 (%)

The grain form includes cubic, octahedral or tetradecahedral grains, tabular grains, spherical grains, bar-like grains, and potato-shaped grains. Of these, cubic grains, octahedral grains, tetradecahedral grains and tabular grains are specifically preferred.

The aspect ratio of tabular grains is preferably 2 to 100, and more preferably 3 to 50. These grains are described in U.S. Pat. Nos. 5,264,337, 5,314,798 and 5,320,958 and desired tabular grains can be readily obtained. Silver halide grains having rounded corners are also preferably employed.

The silver halide grain shape is not specifically limited, but a high ratio accounted for by a Miller index [100] plane is preferred. This ratio is preferably at least 50%; is more preferably at least 70%, and is most preferably at least 80%. The ratio accounted for by the Miller index [100] face can be obtained based on T. Tani, J. Imaging Sci., 29, 165 (1985) in which adsorption dependency of a [111] face or a [100] face is utilized.

It is preferred to use low molecular gelatin having an average molecular weight of not more than 50,000 in the preparation of silver halide grains used in the invention, specifically, in the stage of nucleation. Thus, the low molecular gelatin has an average molecular eight of not more than 50,000, preferably 2,000 to 40,000, and more preferably 5,000 to 25,000. The average molecular weight can be determined by means of gel permeation chromatography. The low molecular gelatin can be obtained by subjecting an aqueous gelatin conventionally used and having an average molecular weight of ca. 100,000 to enzymatic hydrolysis, acid or alkali hydrolysis, thermal degradation at atmospheric pressure or under high pressure or ultrasonic degradation.

The concentration of dispersion medium used in the nucleation stage is preferably not more than 5% by weight, and more preferably 0.05 to 3.0% by weight.

In the preparation of silver halide grains, it is preferred to use a compound represent by the following formula [5], specifically in the nucleation stage:

$$YO(CH_2CH_2O)m(C(CH_3)HCH_2O)p(CH_2CH_2O)nY \quad \text{Formula [5]}$$

Wherein Y is a hydrogen atom, —$SO_3M$ or —CO—B—COOM, in which M is a hydrogen atom, alkali metal atom, ammonium group or ammonium group substituted by an alkyl group having carbon atoms of not more than 5, and B is a chained or cyclic group forming an organic dibasic acid; m and n each are 0 to 50; and p is 1 to 100. The compound represented by formula [5] has been employed as a defoaming agent to inhibit marked foaming occurred when stirring or moving emulsion raw materials, specifically in the stage of preparing an aqueous gelatin solution, adding a water-soluble silver and halide salts to the aqueous gelatin solution or coating an emulsion on a support during the process of preparing silver halide photographic light sensitive materials. A technique of using these compounds as a defoaming agent is described in JP-A 44-9497. The compound represented by formula [5] also functions as a defoaming agent during nucleation.

The compound represented by formula [5] is used preferably in an amount of not more than 1%, and more preferably 0.01 to 0.1% by weight, based on silver. The compound is to be present at the stage of nucleation, and may be added to a dispersing medium prior to or during nucleation. Alternatively, the compound may be added to an aqueous silver salt solution or halide solution used for nucleation. It is preferred to add it to a halide solution or both silver salt and halide solutions in an amount of 0.01 to 2.0% by weight. It is also preferred to make the compound represented by formula [5] present over a period of at least 50% (more preferably, at least 70%) of the nucleation stage. The compound may be added in the form of powder or solution using a solvent such as methanol. Representative examples of the compound represented by formula [5] are shown below, but are not limited to these.

$$HO(CH_2CH_2O)_m(C(CH_3)HCH_2O)_{19.8}(CH_2CH_2O)_nH(m+n=9.77) \quad \text{E-1}$$

$$NaO_2C(CH_2)OCO(CH_2CH_2O)_m(C(CH_3)HCH_2O)_{17}(CH_2CH_2O)_n CO(CH_2)_2CO_2Na(m+n=5.7) \quad \text{E-2}$$

$$KO_2CCH{=}CHCOO(CH_2CH_2O)_m(C(CH_3)HCH_2O)_{34.2}(CH_2CH_2O)_nCOCH{=}CHCO_2K(m+n=8.5) \quad \text{E-3}$$

$$NaO_3SO(C(CH_3)HCH_2O)_{17}SO_3Na \quad \text{E-4}$$

E-5

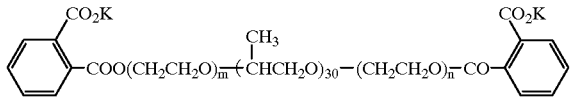

(m + n = 12)

E-6

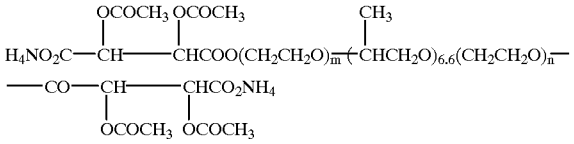

(m + n = 2.2)

The temperature during the stage of nucleation is preferably 5 to 60° C., and more preferably 15 to 50° C. Even when nucleation is conducted at a constant temperature, in a temperature-increasing pattern (e.g., in such a manner that nucleation starts at 25° C. and the temperature is gradually increased to reach 40° C. at the time of completion of nucleation) or its reverse pattern, it is preferred to control the temperature within the range described above.

Silver salt and halide salt solutions used for nucleation are preferably in a concentration of not more than 3.5N, and more preferably 0.01 to 2.5N. The flow rate of aqueous silver salt solution is preferably $1.5\times10^{-3}$ to $3.0\times10^{-1}$ mol/min per lit. of the solution, and more preferably $3.0\times10^{-3}$ to $8.0\times10^{-2}$ mol/min. per lit. of the solution. The pH during nucleation is within a range of 1.7 to 10, and since the pH at the alkaline side broadens the grain size distribution, the pH is preferably 2 to 6. The pBr during nucleation is 0.05 to 3.0, preferably 1.0 to 2.5, and more preferably 1.5 to 2.0.

Silver halide may be incorporated into an image forming layer by any means, in which silver halide is arranged so as to be as close to reducible silver source as possible. It is general that silver halide, which has been prepared in advance, added to a solution used for preparing an organic silver salt. In this case, preparation of silver halide and that of an organic silver salt are separately performed, making it easier to control the preparation thereof. Alternatively, as described in British Patent 1,447,454, silver halide and an organic silver salt can be simultaneously formed by allowing a halide component to be present together with an organic silver salt-forming component and by introducing silver ions thereto.

Silver halide can also be prepared by reacting a halogen containing compound with an organic silver salt through conversion of the organic silver salt. Thus, a silver halide-forming component is allowed to act onto a pre-formed organic silver salt solution or dispersion or a sheet material containing an organic silver salt to convert a part of the organic silver salt to photosensitive silver halide. The thus formed silver halide is effectively in contact with the organic silver salt, exhibiting favorable actions. In this case, the silver halide-forming component refers to a compound capable of forming silver salt upon reaction with the organic silver salt. Such a compound can be distinguished by the following simple test. Thus, a compound to be tested is to be mixed with the organic silver salt, and if necessary, the presence of a peal specific to silver halide can be confirmed by the X-ray diffractometry, after heating. Compounds that have been confirmed to be effective as a silver halide-forming component include inorganic halide compounds, onium halides, halogenated hydrocarbons, N-halogeno compounds and other halogen containing compounds. These compounds are detailed in U.S. Pat. Nos. 4,009,039, 3,457,075 and 4,003,749, British Patent 1,498,956 and JP-A 53-27027 and 53-25420. Exemplary examples thereof are shown below:

(1) Inorganic halide compound: e.g., a halide compound represented by formula, MXn, in which M represents H, NH4 or a metal atom; n is 1 when M is H or NH4 and a number equivalent to a valence number of the metal atom when M is the metal atom; the metal atom includes lithium, sodium, potassium, cesium, magnesium, calcium, strontium, barium, zinc, cadmium, mercury, tin, antimony, chromium, manganese, cobalt, rhodium, and cerium, and molecular halogen such as aqueous bromine being also effective;

(2) Onium halide: e.g., quaternary ammonium halides such as trimethylphenylammonium bromide, cetylethyldimethylammonium bromide, and trimethylbenzylammonium bromide; and tertiary sulfonium halides such as trimethylsulfonium iodide;

(3) Halogenated hydrocarbons: e.g., iodoform, bromoform, carbon tetrachloride and 2-brom-2-methylpropane;

(4) N-halogeno compounds: e.g., N-chlorosuccinimide, N-bromosucciimde, N-bromophthalimide, N-bromoacetoamide, N-iodosuccinimide, N-bromophthalazinone, N-bromooxazolinone, N-chlorophthalazinone, N-bromoacetoanilide, N,N-dibromobenzenesulfonamide, N-bromo-N-methylbenzenesulfonamide, 1,3-dibromo-4,4-dimethylhydantoin and N-bromourazole;

(5) Other halogen containing compounds: e.g., triphenylmethyl chloride, triphenylmethyl bromide 2-bromoacetic acid, 2-bromoethanol and dichlorobenzophenone.

The silver halide forming components may be used in combination. As described above, although silver halide can be formed by converting a part or all of an organic silver salt to silver halide through reaction of the organic silver salt and a halide ion, it is preferred to use silver halide separately prepared which can be easily controlled with respect to grain size or grain form. The silver halide separately prepared may be used in combination with silver halide prepared by conversion of at least apart of an organic silver salt. The silver halide which is separately prepared or prepared through conversion of an organic silver salt is used preferably in an amount of 0.001 to 0.7 mol, and more preferably 0.03 to 0.5 mol per mol of organic silver salt.

Silver halide preferably occludes ions of metals belonging to Groups 6 to 11 of the Periodic Table. Preferred as the metals are W; Fe, Co, Ni, Cu, Ru, Rh, Pd, Re, Os, Ir, Pt and Au. These metals may be introduced into silver halide in the form of a complex. In the present invention, regarding the transition metal complexes, six-coordinate complexes represented by the general formula described below are preferred:

Formula: $(ML_6)^m$:

wherein M represents a transition metal selected from elements in Groups 6 to 11 of the Periodic Table; L represents a coordinating ligand; and m represents 0, 1-, 2-, 3- or 4-.

Exemplary examples of the ligand represented by L include halides (fluoride, chloride, bromide, and iodide), cyanide, cyanato, thiocyanato, selenocyanato, tellurocyanato, azido and aquo, nitrosyl, thionitrosyl, etc., of which aquo, nitrosyl and thionitrosyl are preferred. When the aquo ligand is present, one or two ligands are preferably coordinated. L may be the same or different.

The particularly preferred example of M is rhodium (Rh), ruthenium (Ru), rhenium (Re), iridium (Ir) or osmium (Os).

Exemplary examples of transition metal ligand complexes are shown below.

1: $[RhCl_6]^{3-}$
2: $[RuCl_6]^{3-}$
3: $[ReCl_6]^{3-}$
4: $[RuBr_6]^{3-}$
5: $[OsCl_6]^{3-}$
6: $[CrCl_6]^{4-}$
7: $[IrCl_6]^{4-}$
8: $[IrCl_6]^{3-}$
9: $[Ru(NO)Cl_5]^{2-}$
10: $[RuBr_4(H_2O)]^{2-}$
11: $[Ru(NO)\ (H_2O)Cl_4]^{-}$
12: $[RhCl_5(H_2O)]^{2-}$
13: $[Re(NO)Cl_5]^{2-}$
14: $[Re(NO)(CN)_5]^{2-}$
15: $[Re(NO)Cl(CN)_4]^{2-}$
16: $[Rh(NO)_2Cl_4]^{-}$
17: $[Rh(NO)(H_2O)Cl_4]^{-}$
18: $[Ru(NO)(CN)_5]^{2-}$
19: $[Fe(CN)_6]^{3-}$
20: $[Rh(NS)Cl_5]^{2-}$
21: $[Os(NO)Cl_5]^{2-}$
22: $[Cr(NO)Cl_5]^{2-}$
23: $[Re(NO)Cl_5]^{-}$
24: $[Os(NS)Cl_4(TeCN)]^{2-}$

25: $[Ru(NS)Cl_5]^{2-}$

26: $[Re(NS)Cl_4(SeCN)]^{2-}$

27: $[Os(NS)Cl(SCN)_4]^{2-}$

28: $[Ir(NO)Cl_5]^{2-}$

With regard to cobalt or iron compounds, hexacyano cobalt or iron complexes are preferably used and exemplary examples thereof are shown below:

29: $[Fe(CN)_6]^{4-}$

30: $[Fe(CN)_6]^{3-}$

31: $[Co(CN)_6]^{3-}$

Compounds, which provide these metal ions or complex ions, are preferably incorporated into silver halide grains through addition during the silver halide grain formation. These may be added during any preparation stage of the silver halide grains, that is, before or after nuclei formation, growth, physical ripening, and chemical ripening. However, these are preferably added at the stage of nuclei formation, growth, and physical ripening; furthermore, are preferably added at the stage of nuclei formation and growth; and are most preferably added at the stage of nuclei formation. These compounds may be added several times by dividing the added amount. Uniform content in the interior of a silver halide grain can be carried out. As disclosed in JP-A No. 63-29603, 2-306236, 3-167545, 4-76534, 6-110146, 5-273683, the metal can be distributively occluded in the interior of the grain.

These metal compounds can be dissolved in water or a suitable organic solvent (for example, alcohols, ethers, glycols, ketones, esters, amides, etc.) and then added. Furthermore, there are methods in which, for example, an aqueous metal compound powder solution or an aqueous solution in which a metal compound is dissolved along with NaCl and KCl is added to a water-soluble silver salt solution during grain formation or to a water-soluble halide solution; when a silver salt solution and a halide solution are simultaneously added, a metal compound is added as a third solution to form silver halide grains, while simultaneously mixing three solutions; during grain formation, an aqueous solution comprising the necessary amount of a metal compound is placed in a reaction vessel; or during silver halide preparation, dissolution is carried out by the addition of other silver halide grains previously doped with metal ions or complex ions. Specifically, the preferred method is one in which an aqueous metal compound powder solution or an aqueous solution in which a metal compound is dissolved along with NaCl and KCl is added to a water-soluble halide solution. When the addition is carried out onto grain surfaces, an aqueous solution comprising the necessary amount of a metal compound can be placed in a reaction vessel immediately after grain formation, or during physical ripening or at the completion thereof or during chemical ripening.

Silver halide grain emulsions used in the invention may be desalted after the grain formation, using the methods known in the art, such as the noodle washing method and flocculation process.

The photosensitive silver halide grains used in the invention is preferably subjected to a chemical sensitization. As preferable chemical sensitizations, well known chemical sensitizations in this art such as a sulfur sensitization, a selenium sensitization and a tellurium sensitization are usable. Furthermore, a noble metal sensitization using gold, platinum, palladium and iridium compounds and a reduction sensitization are available. As the compounds preferably used in the sulfur sensitization, the selenium sensitization and the tellurium sensitization, well known compounds can be used and the compounds described in JP-A 7-128768 is usable.

Examples of the compounds used in the noble metal sensitization include chloroauric acid, potassium chloroaurate, potassium aurothiocyanate, gold sulfide, gold selenide, compounds described U.S. Pat. No. 2,448,060 and British Patent No. 618,061. Examples of the compounds used in the reduction sensitization include ascorbic acid, thiourea dioxide, stannous chloride, aminoiminomethanesulfinic acid, hydrazine derivatives, borane compounds, silane compounds and polyamine compounds. The reduction sensitization can be carried out by ripening an emulsion with keeping the pH and pAg at not less than 7 and not more than 8.3, respectively. Furthermore, the reduction sensitization can be carried out by introducing a silver ion alone at a time during the grain formation.

Silver halide used in the invention is preferably spectral-sensitized by allowing a sensitizing dye to adsorb onto the silver halide. Spectral sensitizing dues usable in the invention include cyanine dyes, merocyanine dyes, complex cyanine dyes, complex merocyanine dyes, holopolar cyanine dyes, styryl dyes, hemi-cyanine dyes, oxonol dyes and hemi-oxonol dyes, as described in JP-A 63-159841, 60-140335, 63-231437, 63-259651, 63-304242, and 63-15245; U.S. Pat. Nos. 4,639,414, 4,740,455, 4,741,966, 4,751,175 and 4,835,096. Useful sensitizing dyes used in the invention are also described in RD17643, sect. IV-A (December, 1978, page 23) and RD18431 sect. IX (August, 1978, page 437). It is specifically preferred to use sensitizing dyes exhibiting spectral sensitivity suited for spectral characteristics of light sources used in a laser imager or a scanner, as described in JP-A 9-34078, 9-54409 and 9-80679.

Useful cyanine dyes are those which contain a basic nucleus, such as a thiazoline nucleus, oxazoline nucleus, pyrroline nucleus, pyridine nucleus, oxazole nucleus, thiazole nucleus, selenazole nucleus and imidazole nucleus. Useful preferred merocyanine dyes include acidic nuclei such as a thiohydantoin nucleus, rhodanine nucleus, oxazolidinedione nucleus, thiazolinedione nucleus, barbituric acid nucleus, thiazolinone nucleus, malononirile nucleus and pyrazolone nucleus, as well as basic nuclei described above.

It is specifically preferred to use sensitizing dyes exhibiting sensitivity to the infrared region. Examples of preferred infrared sensitizing dyes used in the invention include those described in U.S. Pat. Nos. 4,536,473, 4,515,888 and 4,959,294.

Specifically, preferred sensitizing dyes are dyes represented by the following formulas (1) to (4):

Formula (1)

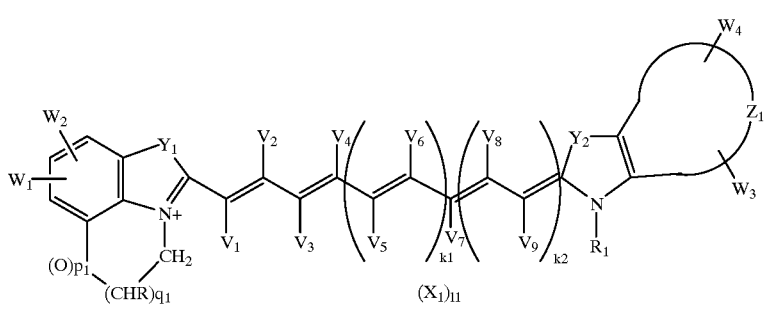

Formula (2)

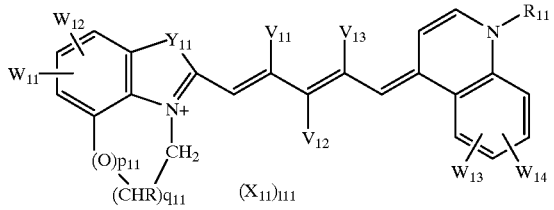

Formula (3)

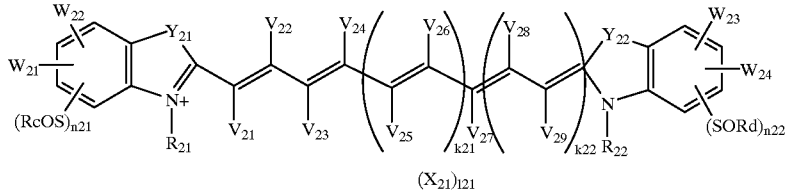

Formula (4)

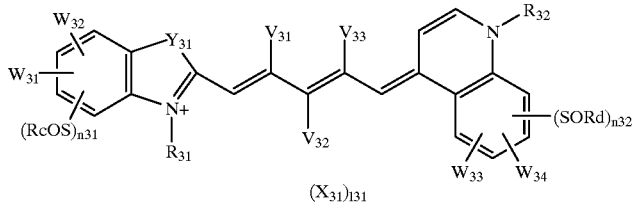

In formulas (1) to (4), $Y_1$, $Y_2$, $Y_{11}$, $Y_{21}$, $Y_{22}$ and $Y_{31}$, each are independently an oxygen atom, a sulfur atom, a selenium atom, —C(Ra)(Rb)— group or —CH═CH— group, in which Ra and Rb each are a hydrogen atom, an alkyl group (preferably having 1 to 5 carbon atoms) or a non-metallic atom group necessary to form an aliphatic spiro ring; $Z_1$ is a non-metallic atom group necessary to form a 5- or 6-membered ring; $R_1$, $R_{11}$, $R_{21}$, $R_{22}$, $R_{31}$ and $R_{32}$ each are an aliphatic group or a non-metallic atom group necessary to form a condensed ring between $R_1$ and $W_3$ or between $R_{11}$ and $W_{14}$; Rc and Rd each are independently an unsubstituted lower alkyl group, a cycloalkyl group, an aralkyl group, an aryl group or a heterocyclic group; $W_1$, $W_2$, $W_3$, $W_4$, $W_{11}$, $W_{12}$, $W_{13}$, $W_{14}$, $W_{21}$, $W_{22}$, $W_{23}$, $W_{24}$, $W_{31}$, $W_{32}$, and $W_{34}$ each are independently a hydrogen atom, a substituent or a non-metallic atom group necessary to form a condensed ring by bonding between $W_1$ and $W_2$, $W_{11}$ and $W_{12}$, $W_{21}$ and $W_{22}$, $W_{23}$ and $W_{24}$, $W_{31}$ and $W_{32}$, or $W_{33}$ and $W_{34}$; $V_1$ to $V_9$, $V_{11}$ to $V_{13}$, $V_{21}$ to $V_{29}$, and $V_{31}$ to $V_{33}$ each are independently a hydrogen atom, a halogen atom, an amino group, an alkylthio group, an arylthio group, a lower alkyl group, a lower alkoxyl group, an aryl group, an aryloxyl group, a heterocyclic group or a non-metallic atom group necessary to form a 5- to 7-membered ring by bonding between $V_1$ and $V_3$, $V_2$ and $V_4$, $V_3$ and $V_5$, $V_2$ and $V_6$, $V_5$ and $V_7$, $V_6$ and $V_8$, $V_7$ and $V_9$, $V_{11}$ and $V_{13}$, $V_{21}$ and $V_{23}$, $V_{22}$ and $V_{24}$, $V_{23}$ and $V_{25}$, $V_{24}$ and $V_{26}$, $V_{25}$ and $V_{27}$, $V_{26}$ and $V_{28}$, $V_{27}$ and $V_{29}$, or $V_{31}$ and $V_{33}$; $X_{21}$ and $X_{31}$, provided that at least one of $V_1$ to $V_9$ and at least one of $V_{11}$ to $V_{13}$ are a group other than a hydrogen atom; $X_1$, $X_{11}$, $X_{21}$ and $X_{31}$ each are an ion necessary to compensate for an intramolecular charge; l1, l11, l21 and l31 each an ion necessary to compensate for an intramolecular charge; k1, k2, k31 and k32 each are 0 or 1; n21, n22, n31 and n32 each are 0, 1 or 2;, provided that n1 and n22, and n31 and n32 are not 0 at the same time; p1 and p11 are each 0 or 1; q1 and q11 each are 1 or 2, provided that the sum of p1 and q1 and the sum of p11 and q11 each are respectively not more than 2.

Of formulas (1) and (2), a compound represented by the following formula (1-1) or (2-1) is more preferred:

Formula (1)

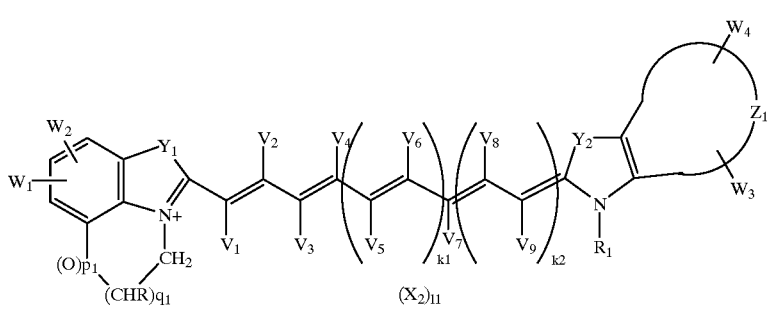

Formula (2)

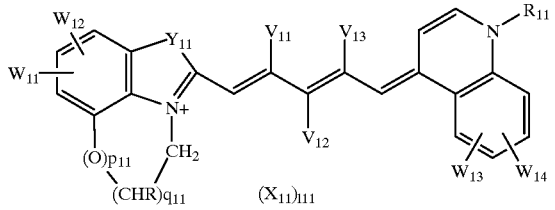

wherein $Y_1$, $Y_2$ and $Y_{11}$ each are independently an oxygen atom, a sulfur atom, a selenium atom, —C(Ra)(Rb)— group or —CH═CH— group, in which Ra and Rb each are a hydrogen atom, a lower alkyl group or an atomic group necessary to form an aliphatic spiro ring when Ra and Rb are linked with each other; $Z_1$ is an atomic group necessary to form a 5- or 6-membered ring; R is a hydrogen atom, a lower alkyl, a cycloalkyl group, an aralkyl group, a lower alkoxyl group, an aryl group, a hydroxy group or a halogen atom; $W_1$, $W_2$, $W_3$, $W_4$, $W_{11}$, $W_{12}$, $W_{13}$ and $W_{14}$ each are independently a hydrogen atom, a substituent or a non-metallic atom group necessary to form a condensed ring by bonding between $W_1$ and $W_2$ or $W_{11}$ and $W_{12}$; $R_1$ and $R_{11}$ are each an aliphatic group or a non-metallic atom group necessary to form a condensed ring by bonding between $R_1$ and $W_3$ or $R_{11}$ and $W_{14}$; $L_1$ to $L_9$, and $L_{11}$ to $L_{15}$ each are independently a methine group; $X_1$ and $X_{11}$ each are an ion necessary to compensate for an intramolecular charge; l1 and l11 each an ion necessary to compensate for an intramolecular charge; k1 and k2 each are 0 or 1; p1 and p11 are each 0 or 1; q1 and q11 each are 1 or 2, provided that the sum of p1 and q1 and the sum of p11 and q11 each are respectively not more than 2.

Substituents will be further described. Thus, substituents of the compounds represented by formulas (1), (2), (1-1), (2-1), (3), and (4) will be explained below.

The 5- or 6-membered condensed rings completed by an atomic group represented by $Z_1$ include a condensed cyclohexene ring, a condensed benzene ring, a condensed thiophene ring, a condensed pyridine ring, and a condensed naphthalene ring. Exemplary examples thereof include a benzoxazole ring, tetrahydrobenzoxazole ring, naphthooxazole ring, benzonephthooxazole ring, benzothiazole ring, tetrahydrobenzothiazole ring, naphthothiazole ring, benzonaphthothiazole ring; thienothiazole ring, thianaphthenothiazole ring, pyridothiazole ring, benzoselenazole ring, tetrahydrobenzoselenazole ring, naphthoselenazole ring, benzonaphthoselenazole ring, quinoline ring, 3,3-dialkylindolenine and 3,3-dialkylpyridopyrroline. Any substituent such as one represented by $W_1$ to $W_4$ described later can be substituted on the ring described above.

Examples of the aliphatic group represented by $R_1$, $R_{11}$, $R_{21}$, $R_{22}$, $R_{31}$, and $R_{32}$ include a branched or straight-chained alkyl group having 1 to 10 carbon atoms (e.g., methyl, ethyl, propyl, butyl, pentyl, i-pentyl, 2-ethyl-hexyl, octyl, decyl), an alkenyl group having 3 to 10 carbon atoms (e.g., 2-propenyl, 3-butenyl, 1-methyl-3-propenyl, 3-pentenyl, 1-methyl-3-butenyl, 4-hexenyl), and an aralkyl group having 7 to 10 carbon atoms (e.g., benzyl, phenethyl). These groups may further be substituted with a substituent, including groups such as a lower alkyl group (preferably having 1 to 5 carbon atoms, e.g., methyl, ethyl, propyl), a halogen atom (e.g., fluorine atom, chlorine atom, or bromine atom), a vinyl group, an aryl group (e.g., phenyl, p-tolyl, p-bromophenyl), trifluoromethyl, an alkoxyl group (e.g., methoxy, ethoxy, methoxyethoxy), an aryloxyl group (e.g., phenoxy, p-tolyloxy), cyano, a sulfonyl group (e.g., methanesulfonyl, trifluoromethansulfonyl), p-toluenesulfonyl), an alkoxycarbonyl group (e.g., ethoxycarbonyl, butoxycarbonyl), an amino group (e.g., amino, biscarboxymethylamino), an aryl group (e.g., phenyl, carboxyphenyl), a heterocyclic group (e.g., tetrahydrofurfuryl, 2-pyrrolidinone-1-yl), an acyl group (e.g., acetyl, benzoyl), an ureido group (e.g., ureido, 3-methylureido, 3-phenylureido), a thioureido group (e.g., thioureido, 3-methylthioureido), an alkylthio group (e.g., methylthio, ethylthio), an arylthio group (e.g., phenylthio), a heterocyclic-thio group (e.g., 2-thienythio, 3-thienylthio, 2-imidazolylthio), a carbonyloxy group (e.g., acetyloxy, propanoyloxy, benzoyloxy), an acylamino group (e.g., acetylamino, benzoylamino); and hydrophilic groups, such as a sulfo group, a carboxy group, a phosphono group, a sulfate group, hydroxy, mercapto, sulfino group, a carbamoyl group (e.g., carbamoyl, n-methylcarbamoyl, N,N-tetramethylenecarbamoyl), a sulfamoyl group (e.g., sulfamoyl, N,N-3-oxapentamethylenaminosulfonyl), a sulfonamido group (e.g., methanesulfonamido, butanesulfoneamido), a sulfonylaminocarbonyl group (e.g., methanesulfonylaminocarbonyl, ethanesulfonylaminocarbonyl), an acylaminosulfonyl group (e.g., acetoamidosulfonyl, methoxyacetoamidosulfonyl), an acylaminocarbonyl group (e.g., acetoamidocarbonyl, methoxyacetoamidocarbonyl), and a sulfinylaminocarbonyl group (e.g., methasulfinylaminocarbonyl, ethanesulfinylaminocarbonyl). Examples of aliphatic groups substituted by a hydrophilic group include carboxymethyl, carboxypentyl, 3-sulfatobutyl, 3-sulfopropyl, 2-hydroxy-3-sulfopropyl, 4-sulfobutyl, 5-sulfopentyl, 3-sulfopentyl, 3-sulfinobutyl, 3-phosphonopropyl, hydroxyethyl, N-methanesulfonylcarbamoylmethyl, 2-carboxy-2-propenyl, o-sulfobenzyl, p-sulfobenzyl and p-carboxybenzyl.

The lower alkyl group represented by R include a straight-chained or branched one having 1 to 5 carbon atoms, such as methyl, ethyl, propyl, pentyl and isopropyl. The cycloalkyl group includes, e.g., cyclopropyl, cyclobutyl and cyclopentyl. The aralkyl group includes, e.g., benzyl, phenethyl, p-methoxyphenylmethyl and o-acetylaminophenylethyl; the lower alkoxyl group includes one having 1 to 4 carbon atoms, including methoxy, ethoxy, propoxy and i-propoxy; the aryl group includes substituted or unsubstituted one, such as phenyl, 2-naphthyl, 1-naphthyl, o-tolyl, o-methoxyphenyl, m-chlorophenyl, m-bromophenyl, p-tolyl and p-ethoxyphenyl. These groups may be substituted by a substituent group, such as a phenyl group, a halogen atom (e.g., fluorine atom, chlorine atom, bromine atom, iodine atom), an alkoxyl group or hydroxy.

The lower alkyl group represented by Ra or Rb are the same as defined in R.

The lower alkyl group represented by Rc, and Rd includes a straight-chained or branched one having 1 to 5 carbon atoms, such as methyl, ethyl, propyl, pentyl and isopropyl. The cycloalkyl group includes, e.g., cyclopropyl, cyclobutyl and cyclopentyl. The aralkyl group includes, e.g., benzyl, phenethyl, p-methoxyphenylmethyl and o-acetylaminophenyl-ethyl; the aryl group includes substituted or unsubstituted one, such as phenyl, 2-naphthyl, 1-naphthyl, o-tolyl, o-methoxyphenyl, m-chlorophenyl, m-bromophenyl, p-tolyl and p-ethoxyphenyl; and the heterocyclic group includes substituted or unsubstituted one, such as 2-furyl, 5-methyl-2-furyl, 2-thienyl, 2-imidazolyl, 2-methyl-l-imidazolyl, 4-phenyl-2-thiazolyl, 5-hydroxy-2-benzothiazolyl, 2-pyridyl and 1-pyrrolyl. These groups, as described above, may be substituted by a substituent group, such as a phenyl group, a halogen atom, an alkoxyl group or hydroxy.

Examples of the substituents represented by $W_1$ to $W_4$, $W_{11}$ to $W_{14}$, $W_{21}$ to $W_{24}$, $W_{31}$ to $W_{34}$, $W_{41}$ to $W_{44}$ and $W_{51}$ to $W_{54}$ include an alkyl group (e.g., methyl, ethyl, butyl, I-butyl), an aryl group (including monocyclic and polycyclic ones such as phenyl and naphthyl), a heterocyclic group (e.g., thienyl, furyl, pyridyl, carbazolyl, pyrrolyl, indolyl), a halogen atom (e.g., fluorine atom, chlorine atom, bromine atom, iodine atom), a vinyl group, trifluoromethyl, an alkoxyl group (e.g., methoxy, ethoxy, methoxyethoxy), an aryloxyl group (e.g., phenoxy, p-tolyloxy), a sulfonyl group (e.g., methanesulfonyl, p-toluenesulfonyl), an alkoxycarbonyl group (e.g., ethoxycarbonyl, ethoxycarbonyl), an amino group (e.g., amino, biscarboxymethylamino), an acyl group (e.g., acetyl, benzoyl), an ureido group (e.g., ureido, 3-methylureido), a thioureido group (e.g., thioureido, 3-methylthioureido), an alkylthio group (e.g., methylthio, ethylthio), an alkenyl thio group, an arylthio group (e.g., phenylthio), hydroxy and styryl.

These groups may be substituted by the same substituents as described in the aliphatic group represented by $R_1$. Examples of substituted alkyl group include 2-methoxyethyl, 2-hydroxyethyl, 3-ethoxycarbonylpropyl, 2-carbamoylethyl, 2-methanesulfonylethyl, 3-methanesulfonylaminopropyl, benzyl, phenethyl, carboxymethyl, carboxymethyl, allyl, and 2-furylethyl. Examples of substituted aryl groups include p-carboxyphenyl, p-N,N-dimethylaminophenyl, p-morpholinophenyl, p-methoxyphenyl, 3,4-dimethoxyphenyl, 3,4-methylene-dioxyphenyl, 3-chlorophenyl, and p-nitrophenyl. Further, examples of substituted heterocyclic group include 5-chloro-2-pyridyl, 2-ethoxycarbonyl-2-pyridyl and 5-carbamoyl-2-pyridyl. $W_1$ and $W_2$, $W_3$ and $W_4$, $W_{11}$ and $W_{12}$, $W_{13}$ and $W_{14}$, $W_{21}$ and $W_{22}$, $W_{23}$ and $W_{24}$, $W_{31}$ and $W_{32}$, $W_{33}$ and $W_{34}$ each pair may combine to form a condensed ring, such as 5- or 6-membered saturated or unsaturated condensed carbon rings, which are further substituted by substituents as described in the aliphatic group.

Among the groups represented by $V_1$ to $V_9$, $V_{11}$ to $V_{13}$, $V_{21}$ to $V_{29}$, and $V_{31}$ to $V_{33}$, the halogen atom includes, e.g., a fluorine atom, chlorine atom, bromine atom and iodine atom; the amino group includes, e.g., amino, dimethylamino, diphenylamino, and methylphenylamino; the alkylthio group includes substituted and substituted ones, such as phenylthio or m-fluorphenylthio; the lower alkyl group includes straight-chained or branched one having five or less carbon atoms, such as methyl, ethyl, propyl, butyl, pentyl or isopropyl; the lower alkoxyl group includes one having four or less carbon atoms, such as methoxy, ethoxy, propoxy, or iso-propoxy; the aryl group includes substituted and unsubstituted ones, such as phenyl, 2-naphthyl, 1-naphthyl, o-tolyl, o-methoxyphenyl, m-chlorophenyl, m-bromophenyl, p-tolyl, and p-ethoxy phenyl; the aryloxyl group includes substituted and unsubstituted ones, such as phenoxy, p-tolyloxy, and m-carboxyphenyloxy; and the heterocyclic group includes substituted or unsubstituted ones, such as 2-furyl, 5-methyl-2-furyl2-thienyl, 2-imidazolyl, 2-methyl-1-imidazolyl, 4-phenyl-2-thiazolyl, 5-hydroxy-2-benzothiazolyl, 2-pyridyl, and 1-pyrrolyl. These groups may further be substituted by a substituent group, such as a phenyl group, a halogen atom, alkoxyl group, or hydroxy. $V_1$ and $V_3$, $V_2$ and $V_4$, $V_3$ and $V_5$, $V_4$ and $V_6$, $V_5$ and $V_7$, $V_6$ and $V_8$, $V_7$ and $V_9$, $V_{11}$ and $V_{13}$, $V_{21}$ and $V_{23}$, $V_{22}$ and $V_{24}$, $V_{23}$ and $V_{25}$, $V_{24}$ and $V_{26}$, $V_{25}$ and $V_{27}$, $V_{26}$ and $V_{28}$, $V_{27}$ and $V_{29}$, and $V_{31}$ and $V_{33}$ each pair may combine to form a 5- to 7-membered ring, such as a cyclopentene ring, cyclohexene ring, cycloheptene ring, and decalin ring, each of which may further be substituted by a lower alkyl group, lower alkoxyl group or aryl group, as described in R.

The methylene group represented by $L_1$ to $L_9$, $L_{11}$ to $L_{15}$ each are a substituted or unsubstituted methylene group. Examples of the substituent thereof include fluorine and chlorine atoms, a substituted or unsubstituted lower alkyl group(e.g., methyl, ethyl, I-propyl, benzyl), and a substituted or unsubstituted alkoxyl group (e.g., methoxy, ethoxy), a substituted or unsubstituted aryloxyl group (e.g., phenoxy, naphthoxy), a substituted or unsubstituted aryl group (e.g., phenyl, naphthyl, p-tolyl, o-carboxyphenyl), $N(U_1)(U_2)$, —SRg, a substituted or unsubstituted heterocyclic group [e.g., 2-thienyl, 2-furyl, N,N'-bis(methoxyethyl)barbituric acid], in which Rg is a lower alkyl group (preferably having 1 to 5 carbon atoms), an aryl group or a heterocyclic group and examples of —SRg include methylthio, ethylthio, benzylthio, phenylthio and tolylthio groups; $U_1$ and $U_2$ are each a substituted or unsubstituted lower alkyl group or aryl group, provided that $V_1$ and $V_2$ may combine to form a 5- or 6-membered nitrogen containing heterocyclic ring (e.g., pyrazole ring, pyrrol ring, pyrrolidine ring, morpholine ring, pyperizine ring, pyridine, pyrimidine ring, etc.). Methylene groups which are adjacent or distant by one may combine to form a 5- or 6-membered ring.

In cases where the compound represented by formula (1), (1-1), (2-1), (3) or (4) is substituted with a cationic- or anionic-charged group, a counter ion is formed by an anionic or cationic equivalent to compensate an intramolecular charge. As an ion necessary to compensate the intramolecular charge, which is represented by $X_1$, $X_{11}$, $X_{21}$, or $X_{31}$, examples of cations include a proton, an organic ammonium ion (e.g., triethylammonium, triethanolammonium) and inorganic cations (e.g., cations of lithium, sodium and potassium); and examples of acid anions include halide ions (e.g., chloride ion, bromide ion, iodide ion), p-toluenesulfonate ion, perchlorate ion, tetrafluoroborate ion, sulfate ion, methylsulfate ion, ethylsulfate ion, methanesulfonate ion, trifluoromethanesulfonate ion).

The infrared sensitizing dye according to the invention is preferably a dye characterized in that a three ring-condensed heterocyclic nucleus is formed by bonding between a nitrogen atom contained in a benzothiazole ring and a carbon atom at a peri-position; or that the dye is a long chain polymethine dye, in which a sulfonyl group is substituted on the benzene ring of the benzothiazole ring.

Exemplary examples of the sensitizing dyes represented by formulas (1), (1-1), (2-1), (3) and (4) are shown below, but are not limited to these.

Compound represented by Formulas (1) to (4):

NO.S-1

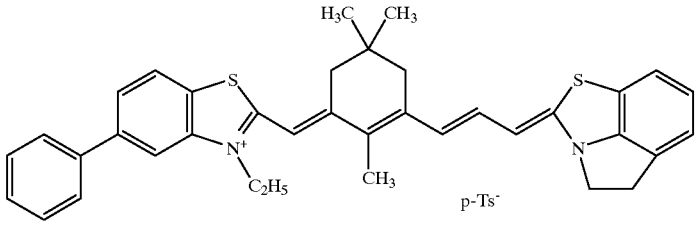

NO.S-2

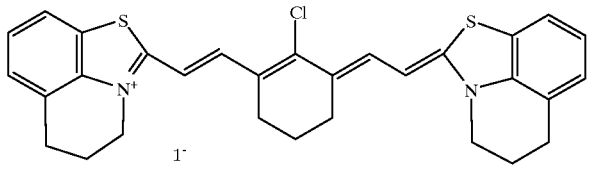

NO.S-3

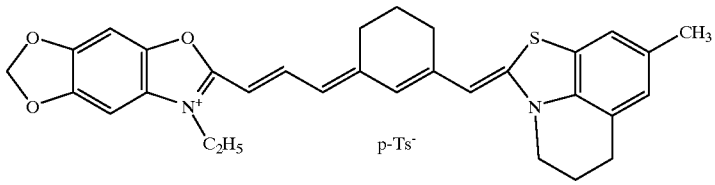

NO.S-4

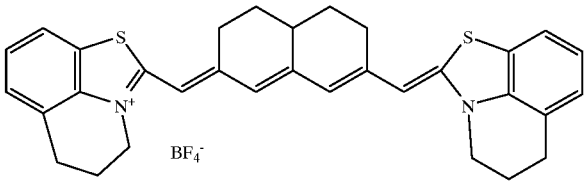

NO.S-5

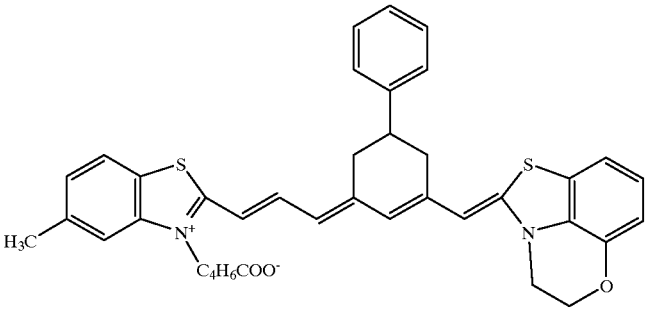

-continued
NO.S-6
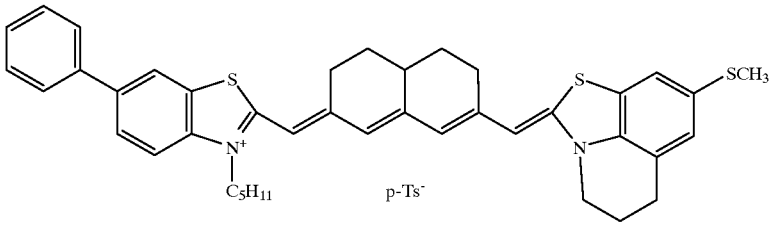
NO.S-7
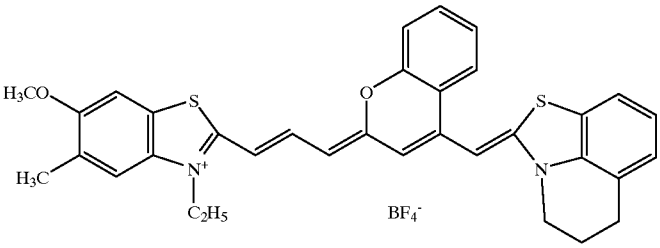
No.S-8
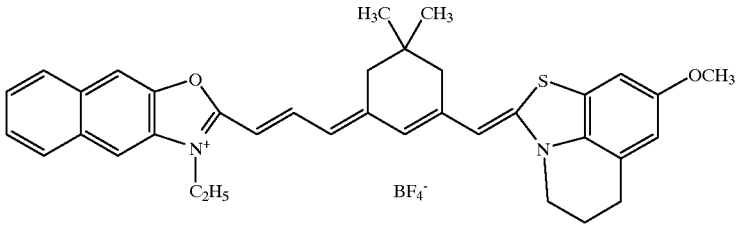
No.S-9
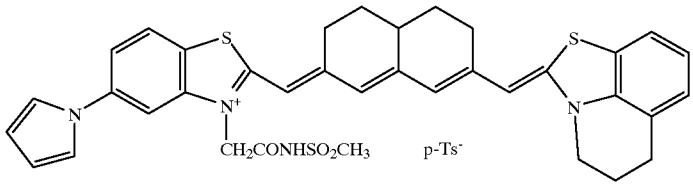
No.S-10
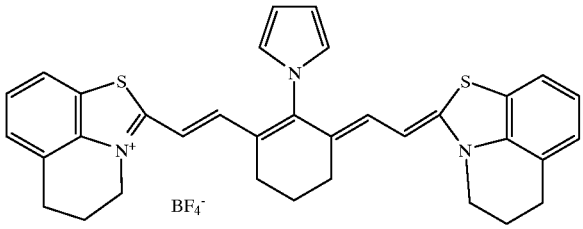
No.S-11
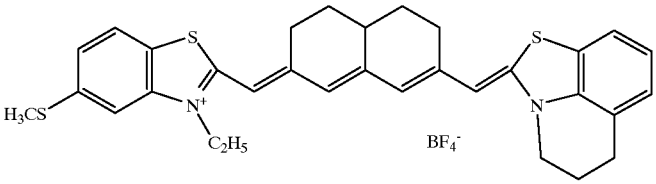
No.S-12
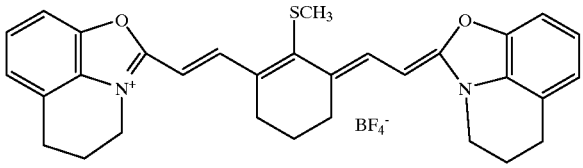

-continued
No.S-13
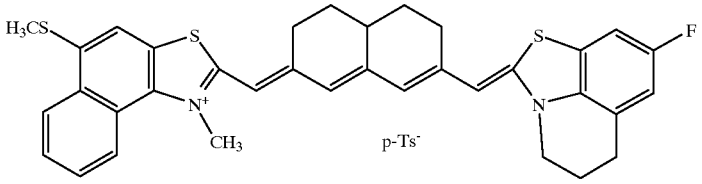
No.S-14
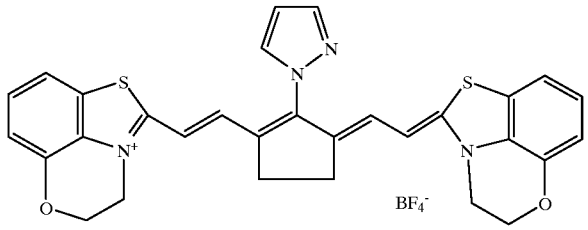
No.S-15
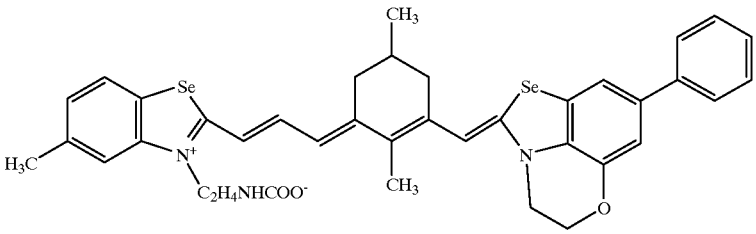
No.S-16
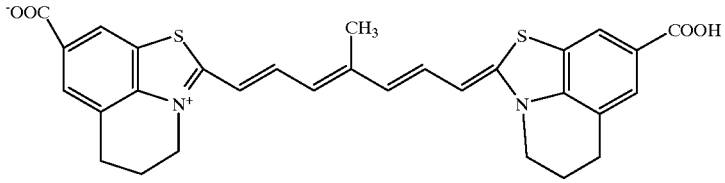
No.S-17
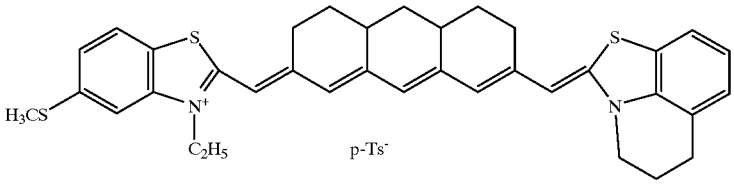
No.S-18
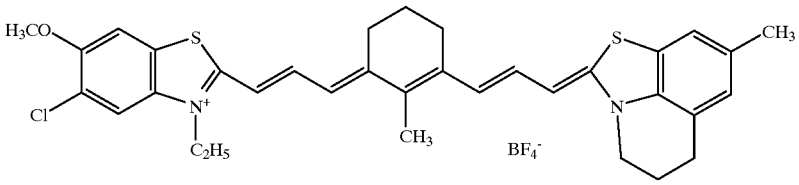
No.S-19
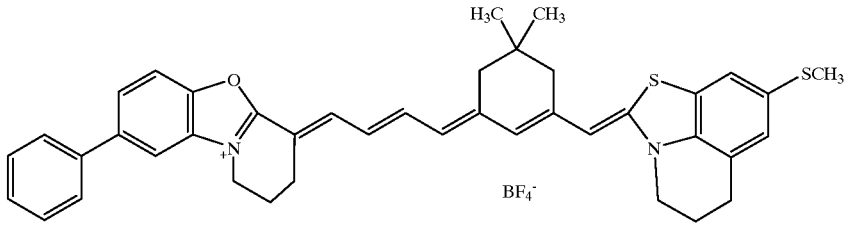

-continued
No.S-20
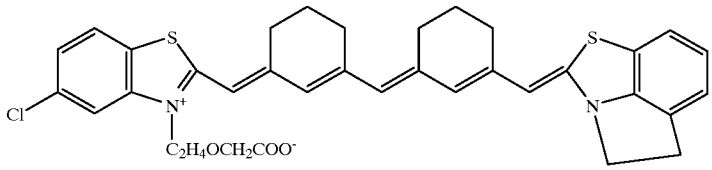
No.S-21
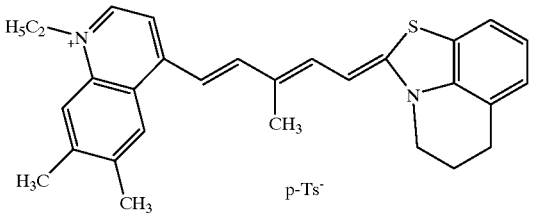
No.S-22
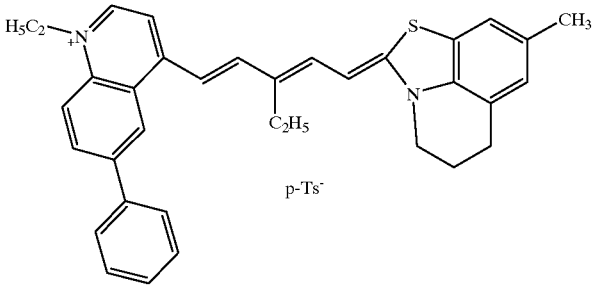
No.S-23
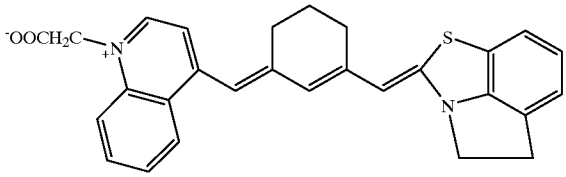
No.S-24
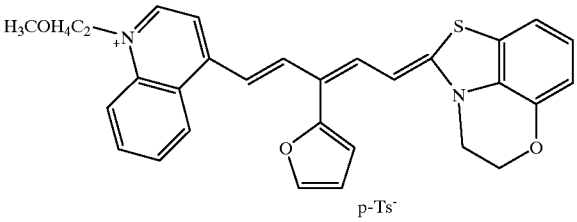
No.S-25
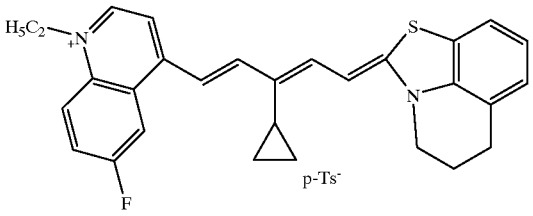

-continued
No.S-26
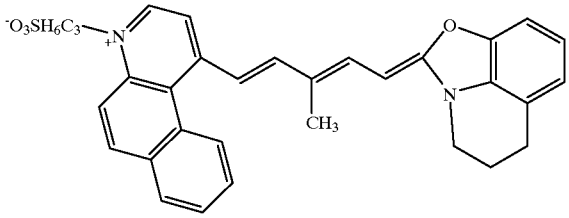
No.S-27
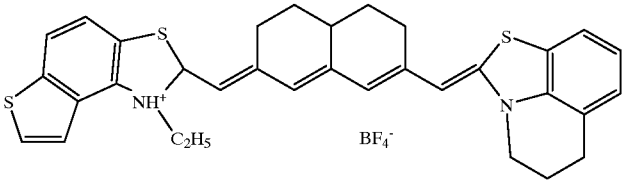
No.S-28
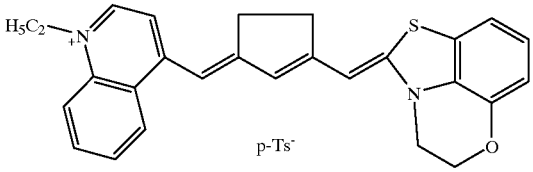
No.S-29
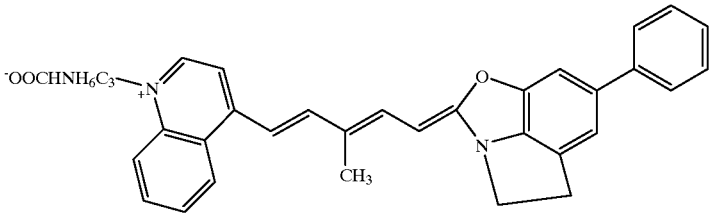
No.S-30
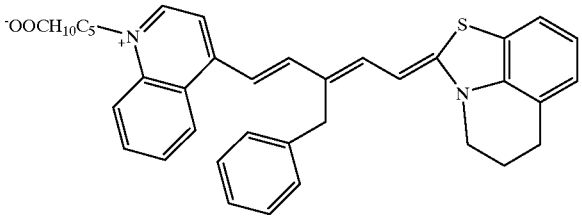
No.S-31
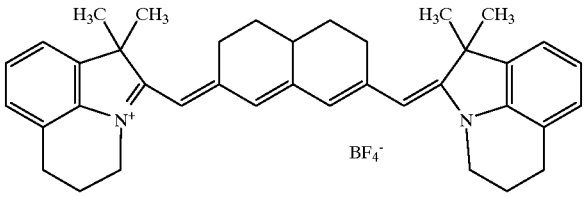

-continued
No.S-32
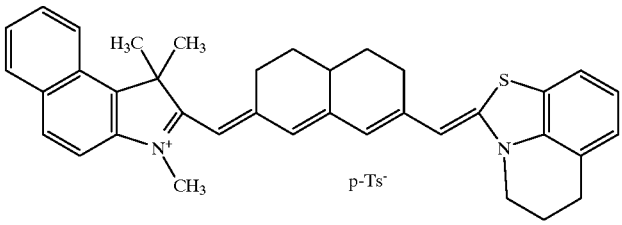
No.S-33
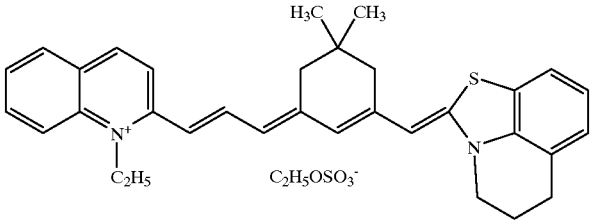
No.S-34
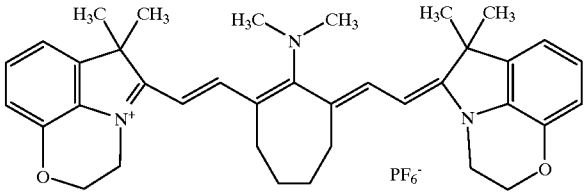
No.S-35
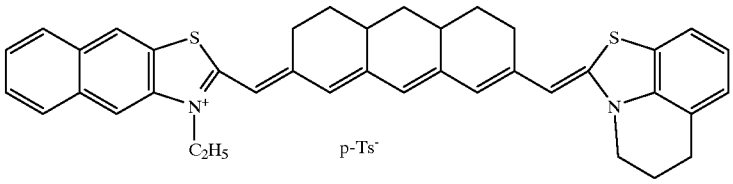
No.S-36
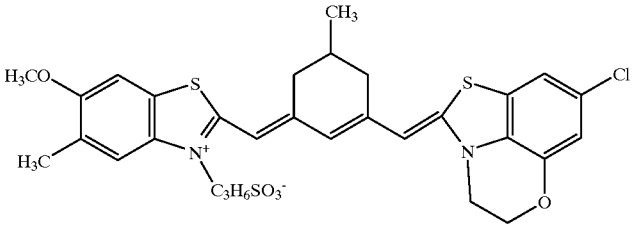
No.S-37
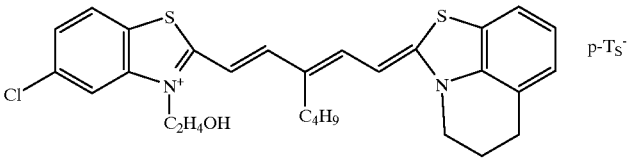
No.S-38
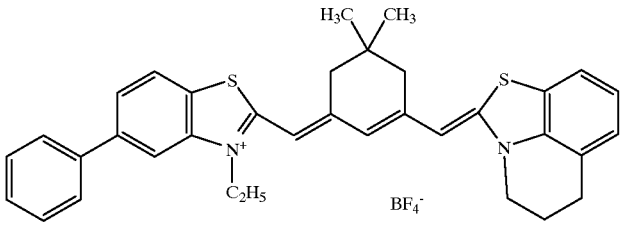

-continued
No.S-39
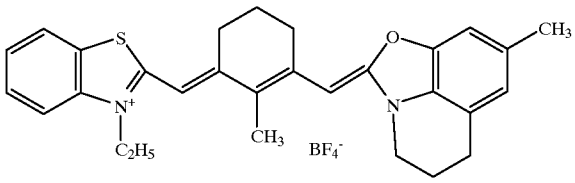
No.S-40
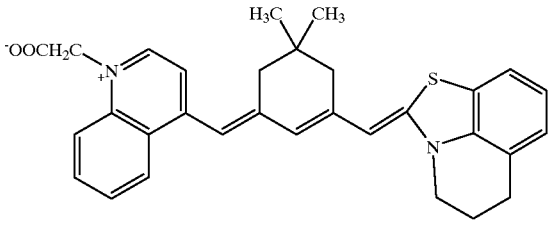
No.S-41
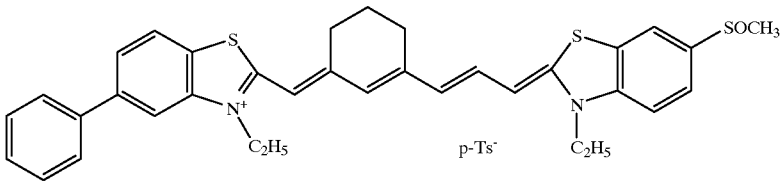
No.S-42
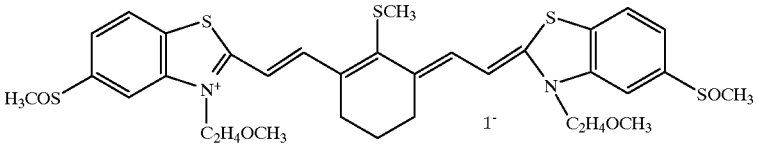
No.S-43
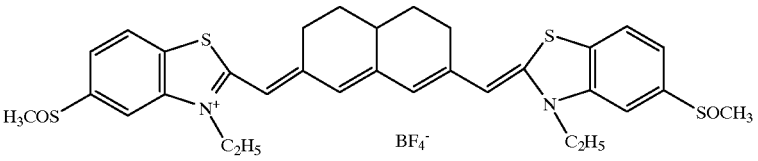
No.S-44
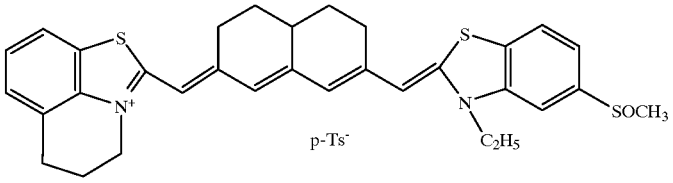
No.S-45
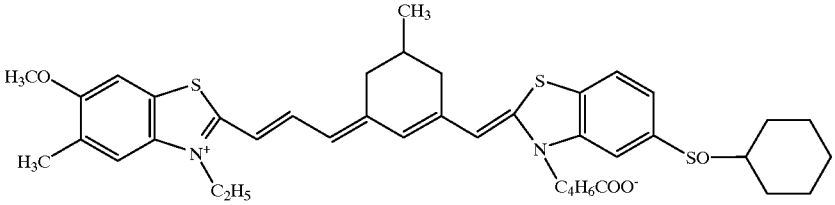
No.S-46
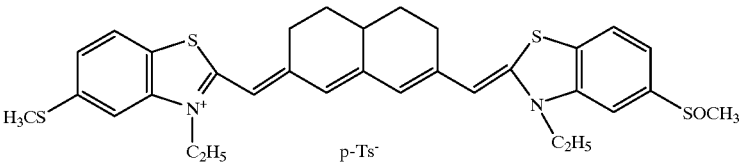

-continued
No.S-47
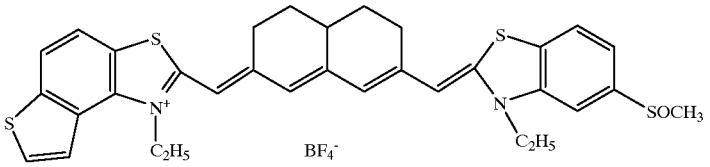
No.S-48
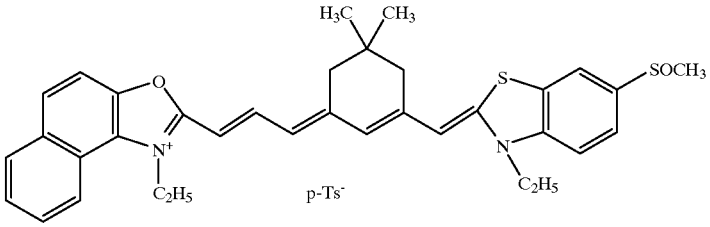
No.S-49
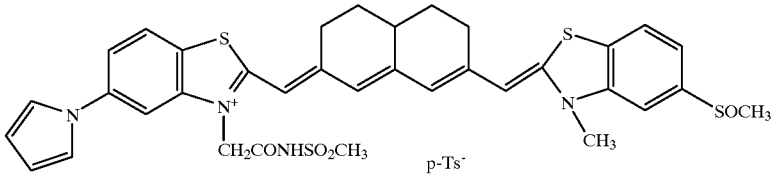
No.S-50
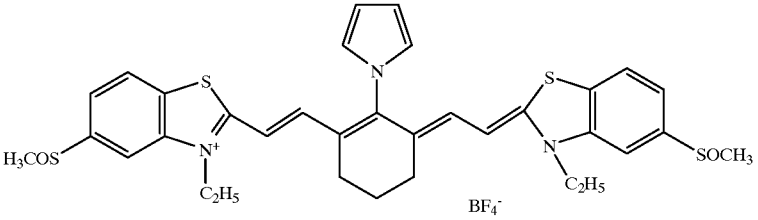
No.S-51
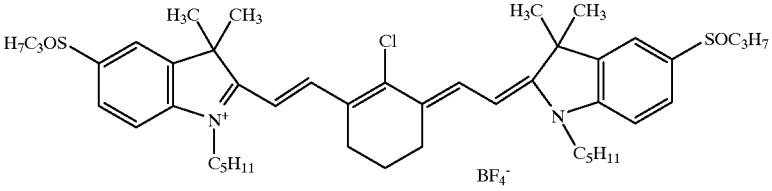
No.S-52
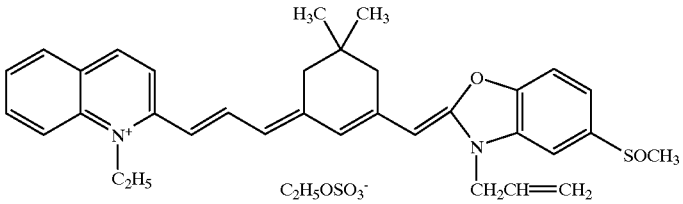
No.S-53
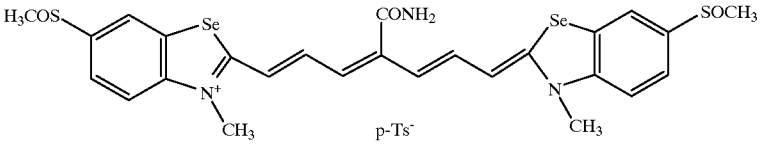

-continued
No.S-54
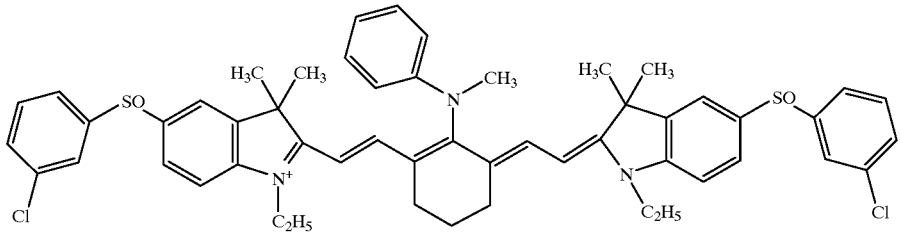
No.S-55
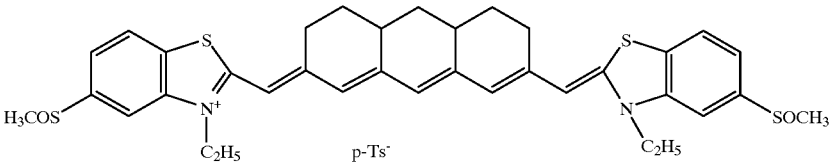
No.S-56
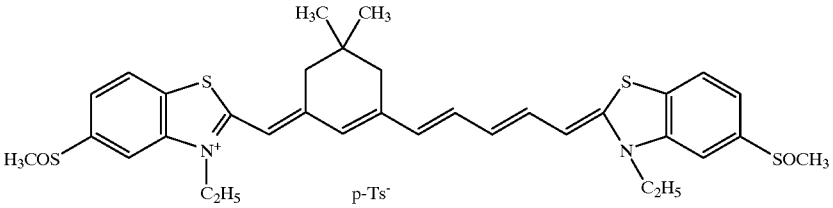
No.S-57
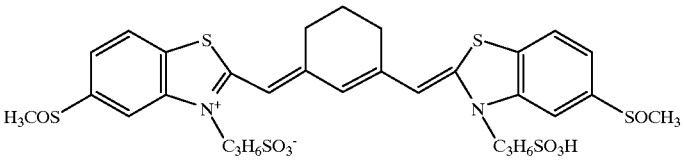
No.S-58
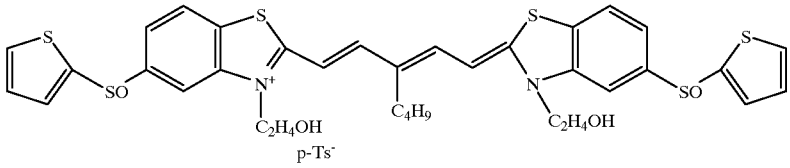
No.S-59
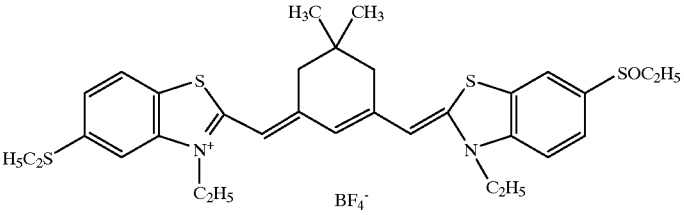
No.S-60
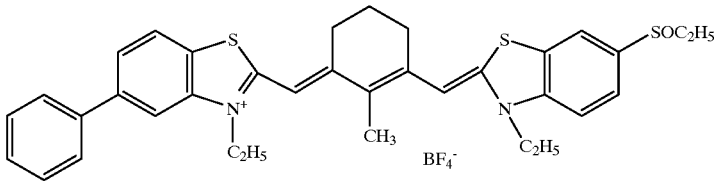

-continued
No.S-61
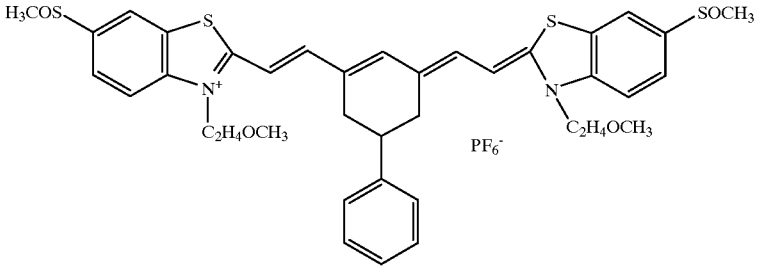
No.S-62
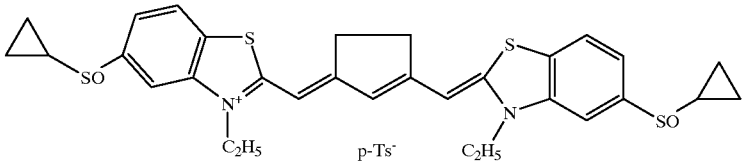
No.S-63
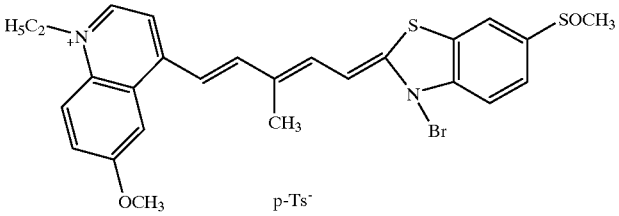
No.S-64
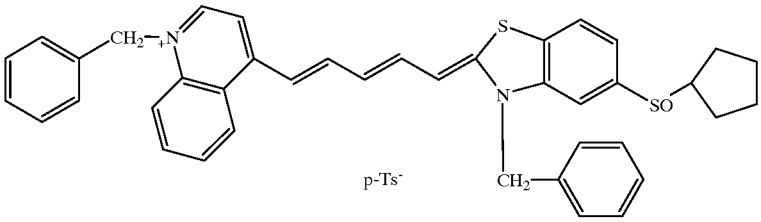
No.S-65
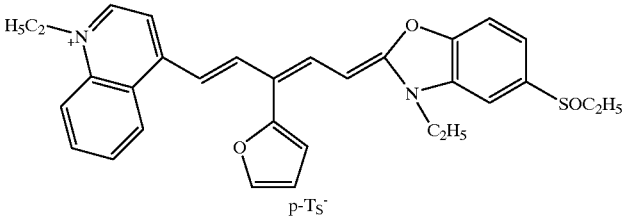
No.S-66
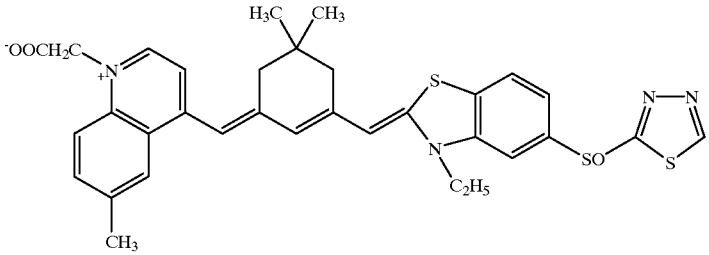

-continued

No.S-67

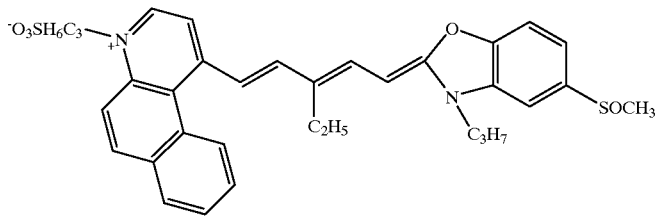

No.S-68

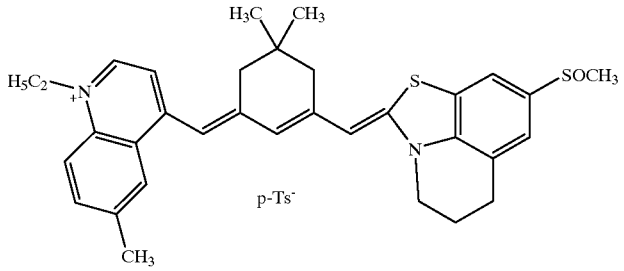

No.S-69

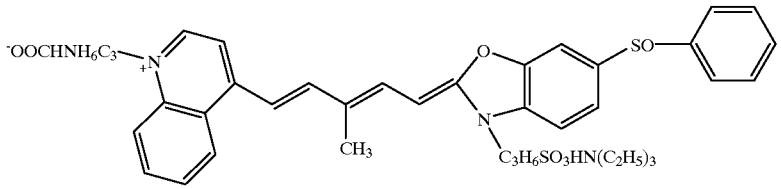

No.S-70

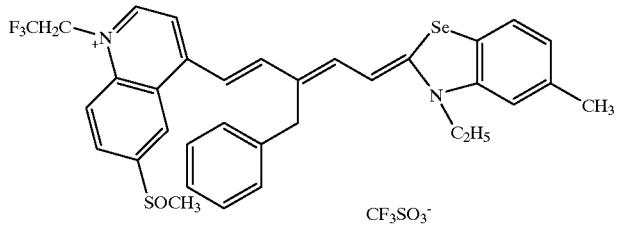

The infrared sensitizing dyes and spectral sensitizing dyes described above can be readily synthesized according to the methods described in F. M. Hammer, The Chemistry of Heterocyclic Compounds vol.18, "The cyanine Dyes and Related Compounds" (A. Weissberger ed. Interscience Corp., New York, 1964).

These sensitizing dyes may be used alone or in combination thereof. The combined use of sensitizing dyes is often employed for the purpose of supersensitization. A supersensitizing compound, such as a dye which does not exhibit spectral sensitization or substance which does not substantially absorb visible light may be incorporated, in combination with a sensitizing dye, into the emulsion.

In cases when being super-sensitized, and specifically when a reducing agent is not deactivated, photosensitivity is enhanced, print-out is easily promoted after development. In such a case, the present invention is effective. In cases when being infrared-sensitized, an infrared sensitizing dye has an oxidation-reduction potential at which a silver halide or an organic silver salt is slightly reducible, easily producing a silver cluster forming fog silver in the presence of the reducing agent, even when placed in a dark room. The produced silver cluster also induces fogging as a catalyst nucleus, deteriorating storage stability in the dark room or promoting print-out when placed in a daylight room after development. Further, sensitivity of the infrared sensitive material extends to the thermal radiation region outside the visible region so that the present invention is effective for inhibiting print-out silver produced by thermal radiation. Such a effect is marked in infrared-sensitized photosensitive materials which is sensitized with a supersensitizer. Useful sensitizing dyes, dye combinations exhibiting supersensitization and materials exhibiting supersensitization are described in RD17643 (published in December, 1978), IV-J at page 23, JP-B 9-25500 and 43-4933 (herein, the term, JP-B means published Japanese Patent) and JP-A 59-19032, 59-192242 and 5-341432.

In the invention, an aromatic heterocyclic mercapto compound represented by the following formula (6) is preferred as a supersensitizer:

$$Ar—SM \qquad \text{Formula (6)}$$

wherein M is a hydrogen atom or an alkali metal atom; Ar is an aromatic ring or condensed aromatic ring containing a nitrogen atom, oxygen atom, sulfur atom, selenium atom or tellurium atom. Such aromatic heterocyclic rings are preferably benzimidazole, naphthoimidazole, benzthiazole, naphthothiazole, benzoxazole, naphthooxazole, benzoselenazole, benzotellurazole, imidazole, oxazole, pyrazole, triazole, triazines, pyrimidine, pyridazine, pyrazine, pyridine, purine, and quinoline. Other aromatic heterocyclic rings may also be included.

A disulfide compound which is capable of forming a mercapto compound when incorporated into a dispersion of an organic silver salt and/or a silver halide grain emulsion is also included in the invention. In particular, a preferred example thereof is a disulfide compound represented by the following formula:

Ar—S—S—Ar Formula (7)

wherein Ar is the same as defined in formula (6). The aromatic heterocyclic rings described above may be substituted with a halogen atom (e.g., Cl, Br, I), a hydroxy group, an amino group, a carboxy group, an alkyl group (having one or more carbon atoms, and preferablyl to 4 carbon atoms) or an alkoxy group (having one or more carbon atoms, and preferablyl to 4 carbon atoms).

Exemplary examples of mercapto-substituted aromatic heterocyclic compound are shown below but are not limited to these.

M-1: 2-mercaptobenzimidazole

M-2: 2-mercaptobenzoxazole

M-3: 2-mercaptobenzthiazole

M-4: 5-methyl-2-mercaptobenzimidazole

M-5: 6-ethoxy-2-mercaptobenzthiazole

M-6: 2,2-dithiobis(benzthiazole)

M-7: 3-mercapto-1,2,4-triazole

M-8: 4,5-diphenyl-2-imidazole

M-9: 2-mercaptoimidazole

M-10: 1-ethyl-2-mercaptobenzimidazole

M-11: 2-mercaptoquinoline

M-12: 8-mercaptopurine

M-13: 2-mercapto-4(3H)-quinazoline

M-14: 7-trifluoromethyl-4-quinolinethiol

M-15: 2,3,5,6-tetrachloro-4-pyridinethiol

M-16: 4-amino-6-hydroxy-2-mercaptopyridine monohydrate

M-17: 2-amino-5-mercapto-1,3,4-thiazole

M-18: 3-amino-5-mercapto-1,2,4-triazole

M-19: 4-hydroxy-2-mercaptopyridine

M-20: 2-mercaptopyridine

M-21: 4,6-diamino-2-mercaptopyridine

M-22: 2-mercapto-4-methylpyrimidine hydrochloride

M-23: 3-mercapto-5-phenyl-1,2,4-riazole

M-24: 2-mercapto-4-phenyloxazole

The supersensitizer compound usable in the invention is incorporated into an emulsion layer containing the organic silver salt and silver halide grains, preferably in an amount of 0.001 to 1.0 mol, and more preferably 0.01 to 0.5 mo per mol of silver.

Binders suitable for the photothermographic material to which the present invention is applied are transparent or translucent, and generally colorless. Binders are natural polymers, synthetic resins, and polymers and copolymers, other film forming media; for example, gelatin, gum arabic, poly(vinyl alcohol), hydroxyethyl cellulose, cellulose acetate, cellulose acetatebutylate, poly(vinylpyrrolidone), casein, starch, poly(acrylic acid), poly(methylmethacrylic acid), poly(vinyl chloride), poly(methacrylic acid), copoly (styrene-maleic acid anhydride), copoly(styrene-acrylonitrile), copoly(styrene-butadiene), poly(vinyl acetal) series (for example, poly(vinyl formal)and poly(vinyl butyral), poly(ester) series, poly(urethane) series, phenoxy resins, poly(vinylidene chloride), poly(epoxide) series, poly (carbonate) series, poly(vinyl acetate) series, cellulose esters, poly(amide) series. These may be hydrophilic or hydrophobic polymers. Of these, as a binder preferable for the thermally developable photosensitive layer is polyvinyl acetals and more preferably polyvinyl butyral. Cellulose esters exhibiting higher softening temperature, such as triacetyl cellulose or cellulose acetatebutylate are preferred for non-photosensitive layers such as an over-coat layer or sub-coat layer, specifically, a protective layer or backing layer. These binders may be used in combination. The bibder is used with a range effective to function as a binder. The effective range can optimally be determined by one skilled in the art. As a measure to hold at least an organic silver salt, a ratio of a binder to an organic silver salt, based on weight is preferably within a range of 15:1 to 1:2, more preferably 8:1 to 1:1. The amount of a binder in a photosensitive layer is preferably 1.5 to 6 g/m$^2$, and more preferably 1.7 to 5 g/m$^2$. The amount of less than 1.5 g/m2 results in an increase density of an unexposed area to levels unacceptable to practical use.

Inclusion of a cross-linking agent is specifically effective in the invention. Although the mechanism has not been elucidated, it was proved that the combined use of the cross-linking agent and the labile species-generating compound used relating to the invention gave advantageous effects on storage stability on the dark room and production of print-out silver under daylight. Although it is commonly known that the use of a cross-linking agent in such a binder as described above improves layer adhesion and lessens unevenness in development, it is unexpected that the use of the crosslinking agent in combination with the labile species-generating compound was effective in fog inhibition during storage and prevention of print-out after development.

Crosslinking agents usable in the invention include various commonly known crosslinking agents used for photographic materials, such as aldehyde type, epoxy type, vinylsulfon type, sulfonester type, acryloyl type, carbodiimide type crosslinking agents, as described in JP-A 50-96216. Specifically preferred are an isocyanate type compound, epoxy compound and acid anhydride, as shown below. One of the preferred crosslinking agents is an isocyanate or thioisicyanate compound represented by the following formula:

X=C=N—L—(N=C=X)v Formula (8)

wherein v is 1 or 2; L is a bivalent linkage group of an alkylene, alkenylene, arylene or alkylarylene group; and X is an oxygen atom or a sulfur atom. An arylene ring of the arylene group may be substituted. Preferred substituents include a halogen atom (e.g., bromine atom, chlorine atom), hydroxy, amino, carboxy, alkyl and alkoxyl.

The isocyanate crosslinking agent is an isocyanate compound containing at least two isocyanate group and its adduct. Examples thereof include aliphatic isocyanates, alicyclic isocyanates, benzeneisocyanates, naphthalenediisocyanates, biphenyldiisocyanates, diphenylmethandiisocyanates, triphenylmethanediisocyanates, triisocyanates, tetraisocyanates, their adducts and adducts of these isocyanates and bivalent or trivalent polyhydric alcohols. Exemplary examples are isocyanate compounds described in JP-A 56-5535 at pages 10–12, including: ethanediisocyanate, butanediisocyanate, hexanediisocyanate, 2,2-dimetylpentanediisocyanate, 2,2,4-trimethylpentanediisocyanate, decanediisocyanate, ω,ω'-diisocyanate-1,3-dimethylbenzol, ω,ω'-diisocyanate-1,2-dimethylcyclohexanediisocyanate, ω,ω'-diisocyanate-1,4-diethylbenzol, ω,ω'-diisocyanate-1,5-dimethylnaphthalene, ω,ω'-diisocyanate-n-propypbiphenyl, 1,3-phenylenediisocyanate, 1-methylbenzol-2,4-diisocyanate, 1,3-dimethylbenzol-2,6-diisocyanate, naphthalene-1,4-diisocyanate, 1,1'-naphthyl-2,2'-diisocyanate, biphenyl-2,4'-diisocyanate, 3,3'-dimethylbiphenyl-4,4'-diisocyanate, diphenylmethane-4,4'-diisocyanate, 2,2'-dimethyldiphenylmethane-4,4'-diisocyanate, 3,3'-dimethoxydiphenylmethane-4,4'-diisocyanate, 4,4'-diethoxydiphenylmethane-4,4'-diisocyanate, 1-methylbenzol-2,4,6-triisocyanate, 1,3,5-trimethylbenzene-2,4,6-triisocyanate, diphenylmethane-2,4,4'-triisocyanate, triphenylmethane-4,4',4'-triisocyanate, tolylenediisocyanate, 1,5-naphthylenediisocyanate; dimmer or trimer adducts of these isocyanate compounds (e.g., adduct of 2-mole hexamethylenediisocyanate, adduct of 3 mole hexamethylenediisicyanate, adduct of 2 mole 2,4-tolylenediisocyanate, adduct of 3 mole 2,4-tolylenediisocyanate); adducts of two different isocyanates selected from these isocyanate compounds described above; and adducts of these isocyanate compounds and bivalent or trivalent polyhydric alcohol (preferably having upto 20 carbon atoms, such as ethylene glycol, propylene glycol, pinacol, and trimethylol propane), such as adduct of tolylenediisocyanate and trimethylolpropane, or adduct of hexamethylenediisocyanate and trimethylolpropane. Of these, adduct of isocyanate and polyhydric alcohol improves adhesion between layers, exhibiting high capability of preventing layer peeling, image slippage or production of bubbles. These polyisocyanate compounds may be incorporated into any portion of the photothermographic material, for example, into the interior of a support (e.g., into size of a paper support) or any layer on the photosensitive layer-side of the support, such as a photosensitive layer, surface protective layer, interlayer, antihalation layer or sublayer. Thus it may be incorporated into one or plurality of these layers.

The thioisocyanate type crosslinking agent usable in the invention is to be a compound having a thioisocyanate structure, corresponding to the isocyanates described above.

The crosslinking agents described above are used preferably in an amount of 0.001 to 2 mol, and more preferably 0.005 to 0.5 mol per mol of silver.

The isocyanate compounds and thiisocyanate compounds used in the invention are preferably those which are capable of fuctioning as a hardener. Even when "v" of formula (8) is zero, i.e., even a compound containing only one functional group provides favorred effects. Exemplary examples thereof are shown below but are not limited to these.

1 $C_8H_{17}NCO$

2 $C_{12}H_{25}NCO$

3

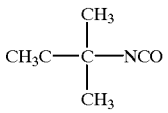

-continued

4

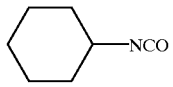

5

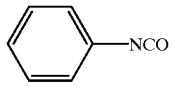

6

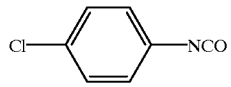

7

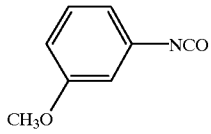

8

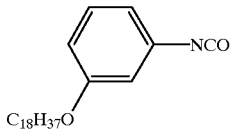

9

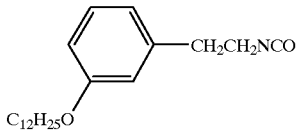

10

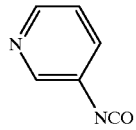

11 $C_8H_{17}NCS$

12 $C_{12}H_{25}NCS$

13

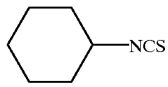

14

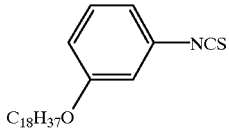

15

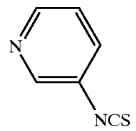

-continued

16

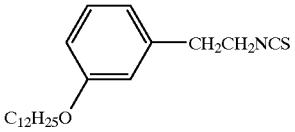

17

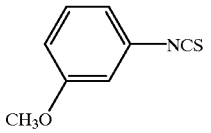

18

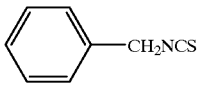

19

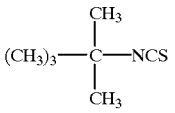

20

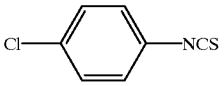

21

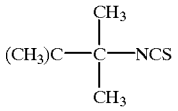

22

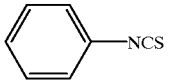

-continued

23

$SCNCH_2CH_2NCS$

Further, preferred crosslinking agent is an epoxy compound containing at least an epoxy group and represented by the formula described below, or an acid anhydride.

The epoxy compound usable in the invention may be any one containing at least one epoxy group and is not limited with respect to the number of the epoxy group, molecular weight and other parameters. The epoxy group is preferably contained in the form of a glycidyl group through an ether bond or an imino bond in the molecule. The epoxy compound may be any one of a monomer, oligomer and polymer, in which the number of the epoxy group in the molecule is preferably 1 to 10 more preferably 2 to 4. In cases where the epoxy compound is a polymer, it may be either one of a homopolymer and copolymer. The number-averaged molecular weight (Mn) preferably 2,000 to 20,000. The epoxy compound used in the invention is preferably a compound represented by the following formula (9):

Formula (9)

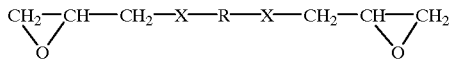

wherein an alkylene group or arylene group represented by R in formula (9) may be substituted by a substituent selected from a halogen atom, a hydroxyalkyl group and an amino group; R in formula (9) preferably contains an amido linkage, ether linkage or thioether linkage; a bivalent linkage group represented by X is preferably —$SO_2$—, —$SO_2NH$—, —S—, —O— or —NR'—, in which R' is a univalent linkage group and preferably an electron-withdrawing group.

Exemplary examples of the epoxy compound are shown below but are not limited to these.

EP-1

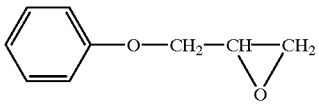

EP-2

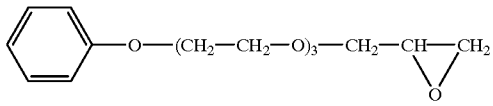

EP-3

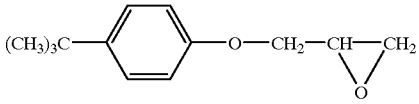

EP-4

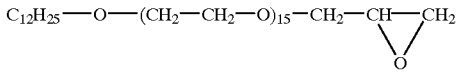

EP-5

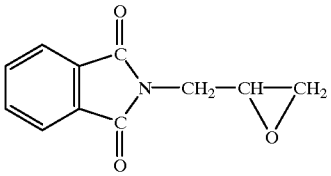

EP-6

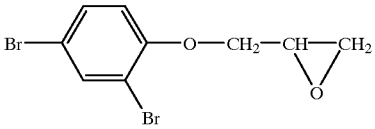

EP-7

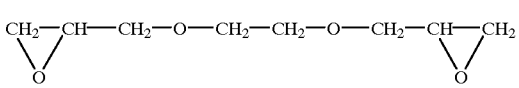

EP-8

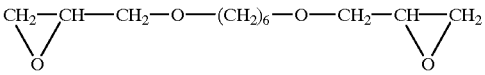

-continued
EP-9
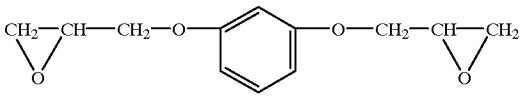
EP-10
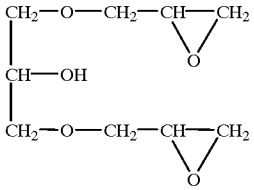
EP-11
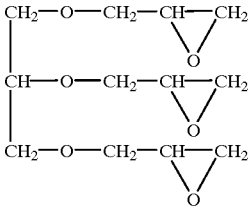
EP-12
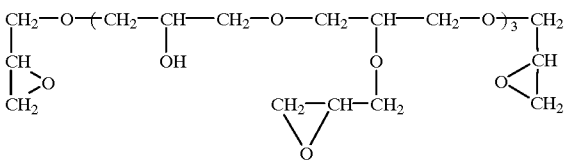
EP-13
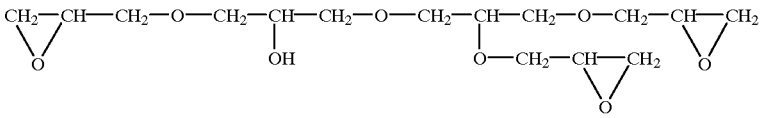
EP-14
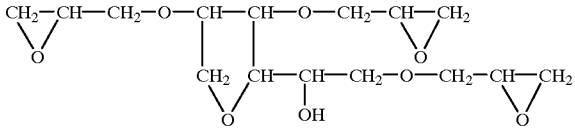
EP-15
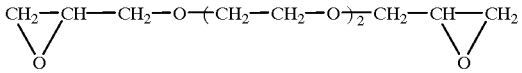
EP-16
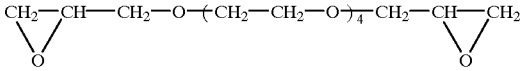
EP-17
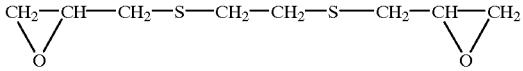
EP-18
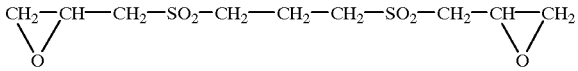
EP-19
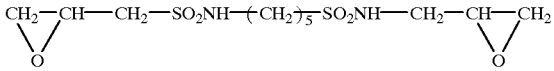
EP-20
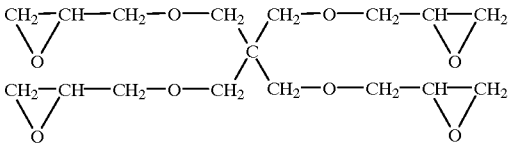
EP-21
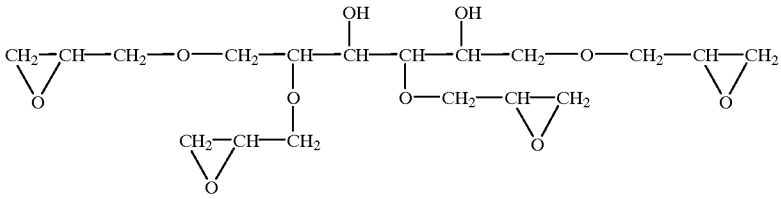
EP-22
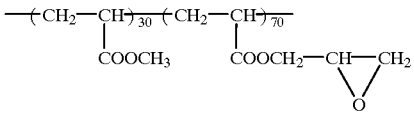
(Mn = 10000)
EP-23
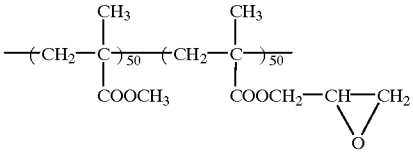
(Mn = 12000)

-continued

EP-24

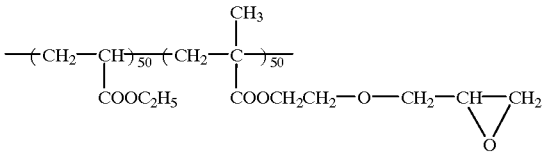

(Mn = 20000)

The epoxy compound may be used alone or combination thereof. The amount to be added is not specifically limited, but preferably $1\times10^{-6}$ to $1\times10^{-2}$ mol/m$^2$, and more preferably $1\times10^{-5}$ to $1\times10^{-3}$ mol/m$^2$. The epoxy compound may be added to any layer of a photosensitive layer, surface protective layer, interlayer, antihalation layer and subbing layer provided on the photosensitive layer-side of the support and may be added to one or plurality of these layers. Further, it may be added to a layer provided on the opposite side of the support, in combination with the photosensitive layer-side. In the case of a photothermographic material having photosensitive layers on both sides of the support, it may be added to any one of the layers.

The acid anhydride used in the invention is preferably a compound containing at least an acid anhydride group represented as below:

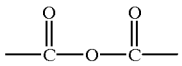

The acid anhydride usable in the invention may be any compound containing one or more acid anhydride group, the number of the acid anhydride group, molecular weight or other parameters are not specifically limited, and a compound represented by the following formula (B) is preferred:

Formula (B)

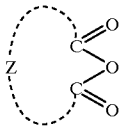

wherein Z is an atomic group necessary to form a monocyclic or polycyclic ring, which may be substituted. Examples of substituent include an alkyl group (e.g., methyl, ethyl, hexyl), an alkoxyl group (e.g., methoxy, ethoxy, octyloxy), an aryl group (e.g., phenyl, naphthyl, tolyl), hydroxy group, an aryloxy group (e.g., phenoxy), an alkylthio group (e.g., methylthio, butylthio), an arylthio group (e.g., phenylthio), an acyl group (e.g., acetyl, propionyl, butylyl), a sulfonyl group (e.g., methylsulfonyl, phenylsulfonyl), an acylamino group, a sulfonylamino group, an acyloxy group (e.g., acetoxy, benzoxy), carboxy group, cyano group, sulfo group and an amino group. It is preferred not to contain a halogen atom as a substituent.

Exemplary examples of the acid anhydride compound are shown below but are not limited to these.

B-1

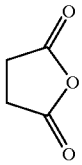

B-2

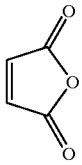

B-3

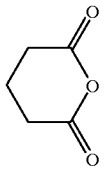

B-4

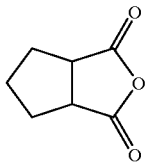

B-5

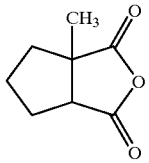

B-6

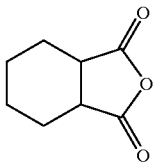

B-7

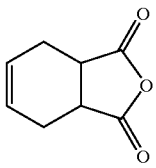

-continued

B-8

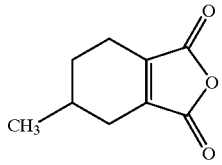

B-9

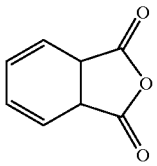

B-10

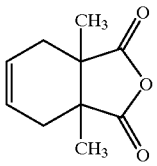

B-11

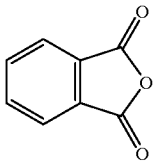

B-12

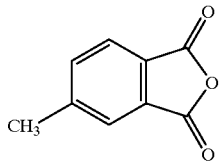

B-13

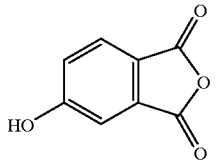

B-14

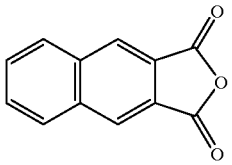

B-15

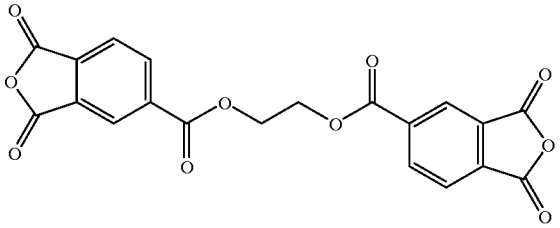

-continued

B-16

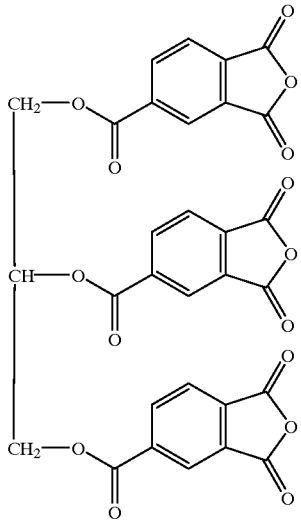

B-17

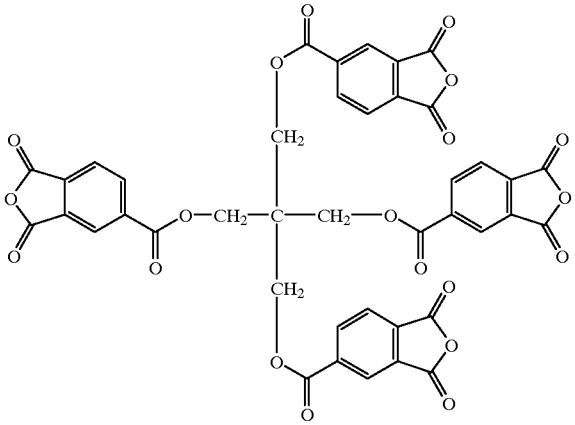

The acid anhydride compound may be used alone or combination thereof. The amount to be added is not specifically limited, but preferably $1\times10^{-6}$ to $1\times10^{-1}$ mol/m$^2$, and more preferably $1\times10^{-4}$ to $1\times10^{-2}$ mol/m$^2$. The acid anhydride compound may be added to any layer of a photosensitive layer, surface protective layer, interlayer, antihalation layer and subbing layer provided on the photosensitive layer-side of the support and may be added to one or plurality of these layers. Further, it may be added to a layer provided on the opposite side of the support, in combination with the photosensitive layer-side. In the case of a photothermographic material having photosensitive layers on both sides of the support, it may be added to any one of the layers.

When an aliphatic dicarboxylic acid anhydride of the compounds represented by formula (B) is contained, alone or in combination with the epoxide compound or labile species-releasing compound, in the photosensitive layer containing non-photosensitive organic silver salt, photosensitive silver halide and a reducing agent, exhibits enhanced effects in antifogging, preventing fogging or desensitization following storage. Of aliphatic dicarboxylic acid anhydrides, succinic acid anhydride and glutaric acid anhydride are preferred. Of alicyclic dicarboxylic acid anhydrides, 1,2-cyclopentanedicarboxylic acid anhydride, 1,2-cyclohexanedicarboxylic acid anhydride and hydrophthalic acid anhydride are preferred. 1,2-Cyclohexanedicarboxylic acid anhydride and hydrophthalic acid anhydride are more preferred. Of alicyclic dicarboxylic acid anhydrides, transisomers are preferred. Trans-1,2-cyclohexanedicarboxylic acid anhydride are specifically preferred. Exemplary preferred hydrophthalic acid anhydrides include, in addition to the compounds described above, 1,2,3,6-tetrahydrophthalic acid anhydride, 3,4,5,6-tetrahydrophthalic acid anhydride, methyltetrahydrophthalic acid, maleylated methylcyclohexenetetrabacic acid anhydride, endo-methylenetetrahydrophthalic acid anhydride, and exo-3,6-epoxy-1,2,3,6-tetrahydrophthalic acid. In addition to the compounds described above, exemplary preferred aliphatic dicarboxylic acid anhydrides include chlorendic acid anhydride, bicyclo[2,2,2]octa-7-ene-2,3,5,6-tetracarboxylic acid anhydride, N-carboxybenzyloxy-L-asparagic acid anhydride andendo-bicyclo[2,2,2]octa-5-ene-2,3-dicarboxylic acid anhydride.

Organic silver salts used in the invention are reducible silver source, and silver salts of organic acids or organic heteroacids are preferred and silver salts of long chain fatty acid (preferably having 10 to 30 carbon atom and more preferably 15 to 25 carbon atoms) or nitrogen containing heterocyclic compounds are more preferred. Specifically, organic or inorganic complexes, ligand of which have a total stability constant to a silver ion of 4.0 to 10.0 are preferred. Exemplary preferred complex salts are described in RD17029 and RD29963, including organic acid salts (for example, salts of gallic acid, oxalic acid, behenic acid, stearic acid, palmitic acid, lauric acid, etc.); carboxyalkylthiourea salts (for example, 1-(3-carboxypropyl)thiourea, 1-(3-caroxypropyl)-3,3-dimethylthiourea, etc.); silver complexes of polymer reaction products of aldehyde with hydroxy-substituted aromatic carboxylic acid (for example, aldehydes (formaldehyde, acetaldehyde, butylaldehyde, etc.), hydroxy-substituted acids (for example, salicylic acid, benzoic acid, 3,5-dihydroxybenzoic acid, 5,5-thiodisalicylic acid, silver salts or complexes of thiones (for example, 3-(2-carboxyethyl)-4-hydroxymethyl-4-(thiazoline-2-thione and 3-carboxymethyl-4-thiazoline-2-thione), complexes of silver with nitrogen acid selected from imidazole, pyrazole, urazole, 1.2,4-thiazole, and 1H-tetrazole, 3-amino-5-benzylthio-1,2,4-triazole and benztriazole or salts thereof; silver salts of saccharin, 5-chlorosalicylaldoxime, etc.; and silver salts of mercaptides. Of these organic silver salts, silver salts of fatty acids are preferred, and silver salts of behenic acid, arachidinic acid and stearic acid are specifically preferred.

The organic silver salt compound can be obtained by mixing an aqueous-soluble silver compound with a compound capable of forming a complex. Normal precipitation, reverse precipitation, double jet precipitation and controlled double jet precipitation described in JP-A 9-127643 are preferably employed. For example, to an organic acid is added an alkali metal hydroxide (e.g., sodium hydroxide, potassium hydroxide, etc.) to form an alkali metal salt soap of the organic acid (e.g., sodium behenate, sodium arachidinate, etc.), thereafter, the soap and silver nitrate are mixed by the controlled double jet method to form organic silver salt crystals. In this case, silver halide grains may be concurrently present.

In the present invention, organic silver salts have an average grain diameter of 10 $\mu$m or less and are monodisperse. The average diameter of the organic silver salt as described herein is, when the grain of the organic salt is, for example, a spherical, cylindrical, or tabular grain, a diameter of the sphere having the same volume as each of these grains. The average grain diameter is preferably between 0.05 and 10 $\mu$m, more preferably between 0.05 and 5 $\mu$m and still more preferably between 0.05 and 0.5 $\mu$m. Furthermore, the monodisperse as described herein is the same as silver halide grains and preferred monodispersibility is between 1 and 30%.

It is also preferred that at least 60% of the total of the organic silver salt is accounted for by tabular grains. The tabular grains refer to grains having a ratio of an average grain diameter to grain thickness, i.e., aspect ratio (denoted as AR) of 3 or more:

AR=average diameter ($\mu$m)/thickness ($\mu$m)

To obtain such tabular organic silver salts, organic silver salt crystals are pulverized together with a binder or surfactant, using a ball mill. Thus, using these tabular grains, photosensitive materials exhibiting high density and superior image fastness are obtained.

To prevent hazing of the photosensitive material, the total amount of silver halide and organic silver salt is preferably 0.5 to 2.2 g in equivalent converted to silver per $m^2$, thereby leading to high contrast images.

The thermally developable photosensitive material (hereinafter, also referred to as photothermographic material), which forms images upon thermal development, comprises a reducible silver source (such as an organic silver salt), photosensitive silver halide, reducing agent and optionally an image toning agent to modify silver image color, which are dispersed in an (organic) binder matrix. The photothermographic material is stable at ordinary temperatures, which is developed, after exposure, upon heating at a high temperature (e.g., 80 to 140° C.). On heating, silver is formed through oxidation-reduction reaction between the organic silver salt (which acts as an oxidant) and the reducing agent. The oxidation-reduction reaction is catalyzed by silver latent images formed upon exposure to light. Silver formed by reaction of the organic silver salt in exposed areas provides a black image in contrast to non-exposed areas, forming images. This reaction process proceeds without supplying processing solution such as water from the exterior.

Image toning agents are preferably incorporated into the photothermographic material used in the present invention. Examples of preferred image toning agents are disclosed in Research Disclosure Item 17029, and include the following:

imides (for example, phthalimide), cyclic imides, pyrazoline-5-one, and quinazolinone (for example, succinimide, 3-phenyl-2-pyrazoline-5-on, 1-phenylurazole, quinazoline and 2,4-thiazolidione); naphthalimides (for example, N-hydroxy-1,8-naphthalimide); cobalt complexes (for example, cobalt hexaminetrifluoroacetate), mercaptans (for example, 3-mercapto-1,2,4-triazole); N-(aminomethyl) aryldicarboxyimides [for example, N-(dimethylaminomethyl)phthalimide]; blocked pyrazoles, isothiuronium derivatives and combinations of certain types of light-bleaching agents (for example, combination of N,N'-hexamethylene(1-carbamoyl-3,5-dimethylpyrazole), 1,8-(3,6-dioxaoctane)bis-(isothiuroniumtrifluoroacetate), and 2-(tribromomethyl-sulfonyl)benzothiazole; merocyanine dyes (for example, 3-ethyl-5-((3-etyl-2-benzothiazolinylidene-(benzothiazolinylidene))-1-methylethylidene-2-thio-2,4-oxazolidinedione); phthalazinone, phthalazinone derivatives or metal salts thereof (for example, 4-(1-naphthyl)phthalazinone, 6-chlorophthalazinone, 5,7-dimethylphthalazinone, and 2,3-dihydro-1,4-phthalazinedione); combinations of phthalazinone and sulfinic acid derivatives (for example, 6-chlorophthalazinone and benzenesulfinic acid sodium, or 8-methylphthalazinone and p-trisulfonic acid sodium); combinations of phthalazine and phthalic acid; combinations of phthalazine (including phthalazine addition products) with at least one compound selected from maleic acid anhydride, and phthalic acid, 2,3-naphthalenedicarboxylic acid or o-phenylenic acid derivatives and anhydrides thereof (for example, phthalic acid, 4-methylphthalic acid, 4-nitrophthalic acid, and tetrachlorophthalic acid anhydride); quinazolinediones, benzoxazine, naphthoxazine derivatives, benzoxazine-2,4-diones (for example, 1,3-benzoxazine-2,4-dione); pyrimidines and asymmetry-triazines (for example, 2,4-dihydroxypyrimidine), and tetraazapentalene derivatives (for example, 3,6-dimercapto-1,4-diphenyl-1H,4H-2,3a,5,6a-tatraazapentalene). Preferred image color control agents include phthalazone or phthalazine.

Antifoggants may be incorporated into the thermally developable photosensitive material to which the present invention is applied. The substance which is known as the most effective antifoggant is a mercury ion. The incorporation of mercury compounds as the antifoggant into photosensitive materials is disclosed, for example, in U.S. Pat. No. 3,589,903. However, mercury compounds are not environmentally preferred. As mercury-free antifoggants, preferred are those antifoggants as disclosed in U.S. Pat. Nos. 4,546,075 and 4,452,885, and P-A 59-57234. Particularly preferred mercury-free antifoggants are heterocyclic compounds having at least one substituent, represented by —C(X1)(X2)(X3) (wherein X1 and X2 each represent halogen, and X3 represents hydrogen or halogen), as disclosed in U.S. Pat. Nos. 3,874,946 and 4,756,999. As examples of suitable antifoggants, employed preferably are compounds described in paragraph numbers [0030] through [0036] of JP-A 9-288328. Further, as another examples of suitable antifoggants, employed preferably are compounds described in paragraph numbers [0062] and [0063] of JP-A 9-90550. Furthermore, other suitable antifoggants are disclosed in U.S. Pat. No. 5,028,523, and European Patent 600,587; 605,981 and 631,176.

In the present invention, a matting agent is preferably incorporated into the image forming layer side. In order to minimize the image abrasion after thermal development, the matting agent is provided on the surface of a photosensitive material and the matting agent is preferably incorporated in an amount of 0.5 to 30 per cent in weight ratio with respect to the total binder in the emulsion layer side.

In cases where a non photosensitive layer is provided on the opposite side of the support to the photosensitive layer, it is preferred to incorporate a matting agent into at least one of the non-photosensitive layer (and more preferably, into the surface layer) in an amount of 0.5 to 40% by weight, based on the total binder on the opposite side to the photosensitive layer.

Materials of the matting agents employed in the present invention may be either organic substances or inorganic substances. Examples of the inorganic substances include silica described in Swiss Patent No. 330,158, etc.; glass powder described in French Patent No. 1,296,995, etc.; and carbonates of alkali earth metals or cadmium, zinc, etc. described in U.K. Patent No. 1.173,181, etc. Examples of the organic substances include starch described in U.S. Pat. No. 2,322,037, etc.; starch derivatives described in Belgian Patent No. 625,451, U.K. Patent No. 981,198, etc.; polyvinyl alcohols described in Japanese Patent Publication No. 44-3643, etc.; polystyrenes or polymethacrylates described in Swiss Patent No. 330,158, etc.; polyacrylonitriles described in U.S. Pat. No. 3,079,257, etc.; and polycarbonates described in U.S. Pat. No. 3,022,169.

The shape of the matting agent may be crystalline or amorphous. However, a crystalline and spherical shape is preferably employed. The size of a matting agent is expressed in the diameter of a sphere having the same volume as the matting agent. The particle diameter of the matting agent in the present invention is referred to the diameter of a spherical converted volume. The matting agent employed in the present invention preferably has an average particle diameter of 0.5 to 10 $\mu$m, and more preferably of 1.0 to 8.0 $\mu$m. Furthermore, the variation coefficient of the size distribution is preferably not more than 50 percent, is more preferably not more than 40 percent, and is most preferably not more than 30 percent. The variation coefficient of the size distribution as described herein is a value represented by the formula described below:

(Standard deviation of particle diameter)/(average particle diameter) −100

The matting agent according to the present invention can be incorporated into any layer. In order to accomplish the object of the present invention, the matting agent is preferably incorporated into the layer other than the photosensitive layer, and is more preferably incorporated into the farthest layer from the support.

Addition methods of the matting agent include those in which a matting agent is previously dispersed into a coating composition and is then coated, and prior to the completion of drying, a matting agent is sprayed. When plural matting agents are added, both methods may be employed in combination.

In addition to these materials, a variety of additives may be optionally incorporated into the photosensitive layer, non-photosensitive layer or other component layer(s). The photothermographic materials of the invention may be added with a surfactant, an antioxidant, a stabilizer, a plasticizer, a UV absorbent or a coating aid. As these additives and other additives described above are preferably employed compounds described in RD17029 (June, 1978, pages 9 to 15).

Supports usable in the thermally developable photosensitive materials include various kinds of polymeric materials, glass, wool fabric, cotton fabric, paper, metal (e.g., aluminum) and those which are convertible to flexible sheets or rolls are preferred in terms of handling as information recording material. Preferred supports usable in thermally developable photosensitive materials are plastic resin films (e.g., cellulose acetate film, polyester film, polyethylene terephthalate film, polyethylene naphthalate film, polyamide film, polyimide film, cellulose triacetate film, polycarbonate film) and biaxially stretched polyethylene terephthalate film is specifically preferred. The thickness of the support is preferably 50 to 300 $\mu$m, and more preferably 70 to 180 $\mu$m.

In the present invention, to improve an electrification property, a conducting compound such as a metal oxide and/or a conducting polymer can be incorporated into a construction layer. These compounds can be incorporated into any layer, preferably into a sublayer, a backing layer and an intermediate layer between a photosensitive layer and a sublayer, etc. In the present invention, the conducting compounds described in U.S. Pat. No. 5,244,773, column 14 through 20, are preferably used.

The coating method of the photosensitive layer, protective layer and backing layer is not specifically limited. Coating can be conducted by any method known in the art, including air knife, dip-coating, bar coating, curtain coating, and hopper coating. Two or more layers can be simultaneously coated. As a solvent for coating solution are employed organic solvents such as methyl ethyl ketone (also denoted as MEK), ethyl acetate and toluene.

The thermally developable photosensitive material according to the invention comprises a support having thereon a photosensitive layer, and preferably further on the photosensitive layer having a non-photosensitive layer. For example, it is preferred that a protective layer is provided on the photosensitive layer to protect the photosensitive layer and that a back coating layer is provided on the opposite side of the support to the photosensitive layer to prevent adhesion between photosensitive materials or sticking of the photosensitive material to a roller. Further, there may be provided a filter layer on the same side or opposite side to the photosensitive layer to control the amount or wavelengths of light transmitting the thermally developable photosensitive layer. Alternatively, a dye or pigment may be incorporated into the photosensitive layer. In this case, dyes described in JP-A 8-201959 are preferably used therein. The photosensitive layer may be comprised of plural layers. To adjust contrast, a high-speed layer and low speed layer may be provided in combination. Various adjuvants may be incorporated into the photosensitive layer, non-photosensitive layer or other component layer(s).

The thermally developable photosensitive material, which is stable at ordinary temperatures, is exposed and heated at a high temperature (preferably 80 to 200° C., and more preferably 100 to 150° C.) to undergo development. In cases when heated at a temperature of lower than 80° C., sufficient image density can be obtained within a short time. Further, in cases when heated at a temperature of higher than 200° C., a binder melts and is transferred to a roller, adversely affecting not only images but also transportability and a developing machine. The organic silver salt (functioning as an oxidant) and the reducing agent undergo oxidation-reduction reaction upon heating to form silver images. The reaction process proceeds without supplying any processing solution such as water.

Any light source within the infrared region is applicable to exposure of the thermally developable photosensitive material and infrared semiconductor lasers (780 nm, 820 nm) are preferred in terms of high power and transmission capability through the photosensitive material.

In the invention, exposure is preferably conducted by laser scanning exposure. It is also preferred to use a laser exposure apparatus, in which scanning laser light is not exposed at an angle substantially vertical to the exposed surface of the photosensitive material. The expression "laser light is not exposed at an angle substantially vertical to the exposed surface" means that laser light is exposed preferably at an angle of 55 to 88°, more preferably 60 to 86°, still more preferably 65 to 84, and optimally 70 to 82°. When the photosensitive material is scanned with laser light, the beam spot diameter on the surface of the photosensitive material is preferably not more than 200 μm, and more preferably not more than 100 μm. Thus, the less spot diameter preferably reduces an angle displacing from verticality of the laser incident angle. The lower limit of the beam spot diameter is 10 μm. The thus laser scanning exposure can reduce deterioration in image quality due to reflection light, such as occurrence of interference fringe-like unevenness.

Exposure applicable in the invention is conducted preferably using a laser scanning exposure apparatus producing longitudinally multiple scanning laser light, whereby deterioration in image quality such as occurrence of interference fringe-like unevenness is reduced, as compared to scanning laser light with longitudinally single mode. Longitudinal multiplication can be achieved by a technique of employing backing light with composing waves or a technique of high frequency overlapping. The expression "longitudinally multiple" means that the exposure wavelength is not a single wavelength. The exposure wavelength distribution is usually not less than 5 nm and not more than 10 nm. The upper limit of the exposure wavelength distribution is not specifically limited but usually about 60 nm.

It is preferred that when subjected to thermal development, the thermally developable photosensitive material contains an organic solvent. Examples of solvents include ketones such as acetone, isophorone, ethyl amyl ketone, methyl ethyl ketone, methyl isobutyl ketone; alcohols such as methyl alcohol, ethyl alcohol, n-propyl alcohol, isopropyl alcohol, n-butyl alcohol, isobutyl alcohol, diacetone alcohol, cyclohexanol, and benzyl alcohol; glycols such as ethylene glycol, dimethylene glycol, triethylene glycol, propylene glycol and hexylene glycol; ether alcohols such as ethylene glycol monomethyl ether, and dimethylene glycol monomethyl ether; ethers such as ethyl ether, dioxane, and isopropyl ether; esters such as ethyl acetate, butyl acetate, amyl acetate, and isopropyl acetate; hydrocarbons such as n-pentane, n-hexane, n-heptane, cyclohexene, benzene, toluene, xylene; chlorinated compounds such as chloromethyl, chloromethylene, chloroform, and dichlorobenzene; amines such as monomethylamine, dimethylamine, triethanol amine, ethylenediamine, and triethylamine; and water, formaldehyde, dimethylformaldehyde, nitromethane, pyridine, toluidine, tetrahydrofuran and acetic acid. The solvents are not to be construed as limiting these examples. These solvents may be used alone or in combination.

The solvent content in the photosensitive material can be adjusted by varying conditions such as temperature conditions at the drying stage after the coating stage. The solvent content can be determined by means of gas chromatography under the conditions suitable for detecting the solvent. The total solvent content (based on weight) of the thermally developable photosensitive material used in the invention is preferably adjusted to be 5 to 1,000 mg per $m^2$ of the photothermographic material and more preferably 100 to 500 mg/$m^2$ (based on the weight of constituting components of the photosensitive material, except for a support). The solvent content within the range described above leads to a thermally developable photosensitive material with low fog density as well as high sensitivity.

EXAMPLES

The present invention will be further described based on examples but embodiments of the invention are by no means limited to these examples.

Example 1

Preparation of a Subbed PET Photographic Support

Both surfaces of a biaxially stretched thermally fixed 175 μm PET film, available on the market, was subjected to corona discharging at 8 w/$m^2$·min. Onto one side of the film, the subbing coating composition a-1 described below was applied so as to form a dried layer thickness of 0.8 μm, which was then dried. The resulting coating was designated Subbing Layer A-1. Onto the opposite surface, the subbing coating composition b-1 described below was applied to form a dried layer thickness of 0.8 μm. The resulting coating was designated Subbing Layer B-1.

| Subbing Coating Composition a-1 | |
|---|---|
| Latex solution (solid 30%) of a copolymer consisting of butyl acrylate (30 weight %), t-butyl acrylate (20 weight %) styrene (25 weight %) and 2-hydroxy ethyl acrylate (25 weight %) | 270 g |
| (C-1) | 0.6 g |
| Hexamethylene-1,6-bis(ethyleneurea) | 0.8 g |
| Water to make | 1 liter |

| Subbing Coating Composition b-1 | |
|---|---|
| Latex liquid (solid portion of 30%) of a copolymer consisting of butyl acrylate (40 weight %) styrene (20 weight %) glycidyl acrylate (25 weight %) | 270 g |
| (C-1) | 0.6 g |
| Hexamethylene-1,6-bis(ethyleneurea) | 0.8 g |
| Water to make | 1 liter |

Subsequently, the surfaces of Subbing Layers A-1 and B-1 were subjected to corona discharging with 8 w/m$^2$ ·minute. Onto the Subbing Layer A-1, the upper subbing layer coating composition a-2 described below was applied so as to form a dried layer thickness of 0.8 $\mu$m, which was designated Subbing Layer A-2, while onto the Subbing Layer B-1, the upper subbing layer coating composition b-2 was applied so at to form a dried layer thickness of 0.8 $\mu$m, having a static preventing function, which was designated Subbing Upper Layer B-2.

| Upper Subbing Layer Coating Composition a-2 | |
|---|---|
| Gelatin in an amount (weight) to make | 0.4 g/m$^2$ |
| (C-1) | 0.2 g |
| (C-2) | 0.2 g |
| (C-3) | 0.1 g |
| Silica particles (av. size 3 $\mu$m) | 0.1 g |
| Water to make | 1 liter |

| Upper Subbing Layer Coating Composition b-2 | |
|---|---|
| (C-4) | 60 g |
| Latex solution (solid 20% comprising) (C-5) as a substituent | 80 g |
| Ammonium sulfate | 0.5 g |
| (C-6) | 12 g |
| Polyethylene glycol (average molecular weight of 600) | 6 g |
| Water to make | 1 liter |

(C-1)

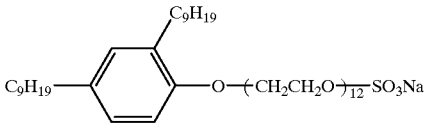

-continued (C-2)

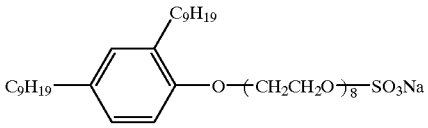

(C-3)

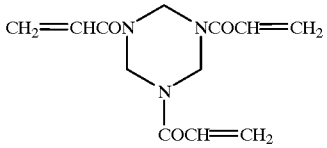

(C-4)

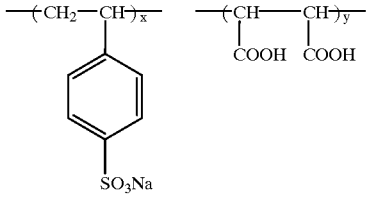

$\overline{M}_n$ = 5000

($\overline{M}$n is a number average molecular weight)

x:y = 75:25 (weight ratio)

(C-5)

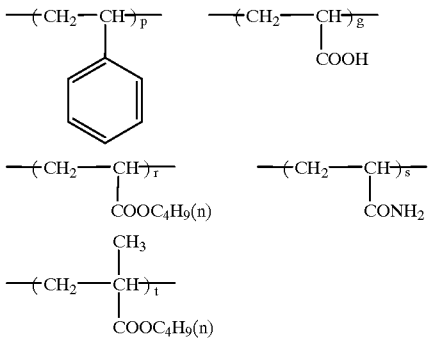

p:g:r:s:t = 40:5:10:5:40 (weight ratio)

(C-6)

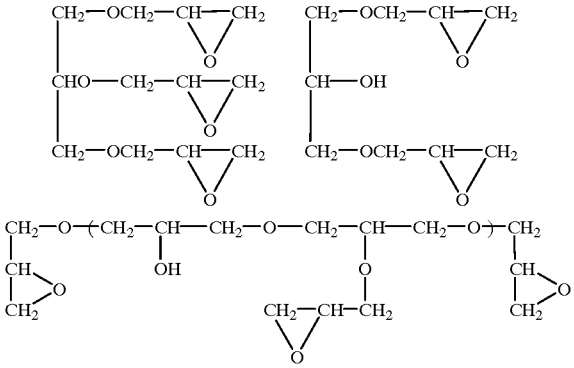

Mixture consisting of the three compounds illustrated above

Preparation of Photosensitive Silver Halide Emulsion A

In 900 ml of deionized water were dissolved 7.5 g of gelatin and 10 mg of potassium bromide. After adjusting the temperature and the pH to 35° C. and 3.0, respectively, 370 ml of an aqueous solution containing 74 g silver nitrate and an equimolar aqueous solution containing potassium bromide, potassium iodide (in a molar ratio of 98 to 2) and $1\times10^{-4}$ mol/mol Ag of iridium chloride were added over a period of 10 minutes by the controlled double-jet method, while the pAg was maintained at 7.7. Thereafter, 4-hydroxy-6-methyl-1,3,3a,7-tetrazaindene was added and the pH was adjusted to 5 using NaOH. There was obtained cubic silver iodobromide grains having an average grain size of 0.06 μm, a variation coefficient of the projection area equivalent diameter of 11 percent, and the proportion of the {100} face of 87 percent. The resulting emulsion was flocculated to remove soluble salts, employing a flocculating agent and after desalting, 0.1 g of phenoxyethanol was added and the pH and pAg were adjusted to 5.9 and 7.5, respectively to obtain silver halide emulsion A.

Preparation of Powdery Organic Silver Salt A

In 4720 ml water were dissolved 111.4 g of behenic acid, 83.8 g of arachidic acid and 54.9 g of stearic acid at 80° C. The, after adding 540.2 ml of 1.5M aqueous sodium hydroxide solution with stirring and further adding 6.9 ml of concentrated nitric acid, the solution was cooled to a temperature of 55° C. to obtain an aqueous organic acid sodium salt solution. To the solution were added the silver halide emulsion obtained above (equivalent to 0.038 mol silver) and 450 ml water and stirring further continued for 5 min., while maintained at a temperature of 55° C. Subsequently, 760 ml of 1M aqueous silver nitrate solution was added in 2 min. and stirring continued further for 20 min., then, the reaction mixture was filtered to remove aqueous soluble salts. Thereafter, washing with deionized water and filtration were repeated until the filtrate reached a conductivity of 2 μS/cm, and after subjecting to centrifugal dehydration, the reaction product was dried with heated air at 37° C. until no reduction in weight was detected to obtain powdery organic silver salt A.

Preparation of Photosensitive Emulsion dispersing Solution

In 1457 g methyl ethyl ketone was dissolved 14.57 g of polyvinyl butyral powder (Butvar B-79, available from Monsanto Corp.) and further thereto was gradually added 500 g of the powdery organic silver salt with stirring by a dissolver type homogenizer. Thereafter, the mixture was dispersed using a media type dispersion machine (available from Gettzmann Corp.), which was packed 1 mm Zr beads (available from Toray Co. Ltd.) by 80%, at a circumferential speed of 13 m and for 3 min. of a retention time with a mill to obtain photosensitive emulsion dispersing solution.

Preparation of Infrared Sensitizing Dye Solution

In 73.4 ml methanol were dissolved 350 mg of infrared sensitizing dye No. S-43, 13.96 g of 2-chlorobenzoic acid, and 2.14 g of 5-methyl-2-mercaptobenzimidazole in a dark room to obtain an infrared sensitizing dye solution.

Preparation of Stabilizer Solution

Stabilizer 1 of 1.0 g and potassium acetate of 0.5 g were dissolved in 8.5 g methanol to prepare a stabilizer solution.

Preparation of Developer Solution

Developer 1,1-bis(2-hydroxy-3,5-dimethylphenyl)-2-methylpropane of 17.74 g was dissolved in MEK to make 100 ml of a developer solution.

Preparation of Antifoggant Solution

Antifoggant 2 of 5.81 g was dissolved in MEK to make 100 ml of an antifoggant solution.

Preparation of Photosensitive Layer Coating Composition

The photosensitive emulsion dispersing solution of 50 g and 15.11 g MEK were maintained at 21° C. with stirring. Then, antifoggant 1 (390 μl of 10% methanol solution) was added and stirred for 1 hr. and calcium bromide (996 μl of 10% methanol solution) was added and further stirred for 30 min. Subsequently, 1.416 ml of an infrared sensitizing dye solution and 667 μl stabilizer solution were added and stirred for 1 hr., then, the temperature was lowered to 13° C. and stirring was further conducted for 30 min. Next, 13.31 g of polyvinyl butyral (Butvar B-79, available from Monsanto Co.) was added thereto and stirred for 30 min., while being maintained at 13° C., thereafter, the following addenda were added at 15 min. intervals with stirring.

| | |
|---|---|
| Phthalazine | 305 mg |
| Tetrachlorophthalic acid | 102 mg |
| 4-Methylphthalic acid | 137 mg |
| Infrared dye 1 | 37 mg |

After stirring the above composition for 15 min., the following addenda were successively added thereto with stirring to obtain a photosensitive layer coating solution.

| | |
|---|---|
| Antifoggant solution | 5.47 ml |
| Image stabilizer [of formula (1) or (2)] Table 1 | |
| Developer solution | 14.06 ml |
| Crosslinking agent etc. (as shown in Table 1) 10% MEK solution | 1.60 ml |

| Backing Layer coating | |
|---|---|
| Cellulose acetate (10% methyl ethyl ketone solution) | 15 ml/m$^2$ |
| Matting agent, monodisperse silica having monodispersity of 15% and average size of 10 μm | 30 mg/m$^2$ |

Photosensitive Layer Coating

The coating solution thus prepared was coated so as to have a silver coverage of 2 g/m$^2$ and dried at 75° C. for a period of 5 min. Drying was conducted in an atmosphere of nitrogen gas stream to inhibit adverse effects caused by oxygen.

Surface Protective Layer

The following composition was coated on the photosensitive layer.

| | |
|---|---|
| Methyl ethyl ketone (MEK) | 17 ml/m$^2$ |
| Cellulose acetate | 2.3 g/m$^2$ |
| Matting agent, monodisperse silica having monodispersity of 10% and average size of 4 μm | 70 mg/m$^2$ |

Photothermographic material Samples 101 to 121 were prepared by incorporating an image stabilizer of formula (1) or (2) and crosslinking agent isocyanates or thioisocyanates of formuls (8), as shown in Table 1.

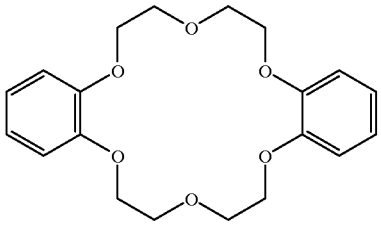

Stabilizer 1

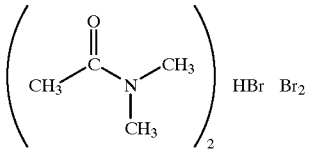

Antifoggant 1

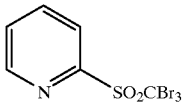

Antifoggant 2

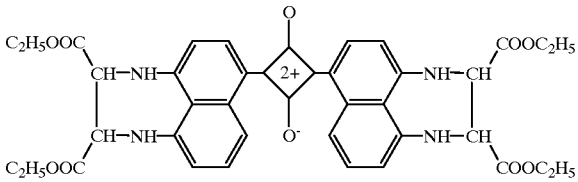

Infrared dye 1

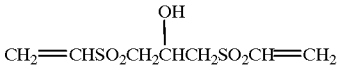

Vinylsufon compound

TABLE 1

| | Crosslinking Agent | | Image stabilizer | | |
|---|---|---|---|---|---|
| Sample | Compound | Amount*1 | Compound | Amount*1 | Remark |
| 101 | — | — | — | — | Comp. |
| 102 | HMDI*2 | 200 mg | — | — | Comp. |
| 103 | HMDI | 200 mg | BI-4 | 2.50 g | Inv. |
| 104 | HMDI | 200 mg | BI-3 | 2.50 g | Inv. |
| 105 | HMDI | 200 mg | I-1 | 300 mg | Inv. |
| 106 | HMDI | 200 mg | I-33 | 300 mg | Inv. |
| 107 | HMDTI*3 | 200 mg | — | — | Comp. |
| 108 | HMDTI | 200 mg | BI-4 | 2.50 g | Inv. |
| 109 | HMDTI | 200 mg | BI-3 | 2.50 g | Inv. |
| 110 | HMDTI | 200 mg | I-1 | 300 mg | Inv. |
| 111 | HMDTI | 200 mg | I-33 | 300 mg | Inv. |
| 112 | HMDI | 200 mg | — | — | Comp. |
| | VS*4 | 50 mg | | | |
| 113 | HMDI | 200 mg | BI-4 | 2.50 g | Inv. |
| | VS | 50 mg | | | |
| 114 | HMDI | 200 mg | BI-3 | 2.50 g | Inv. |
| | VS | 50 mg | | | |
| 115 | HMDI | 200 mg | I-1 | 300 mg | Inv. |
| | VS | 50 mg | | | |
| 116 | HMDI | 200 mg | I-33 | 300 mg | Inv. |
| | VS | 50 mg | | | |
| 117 | HMDTI | 200 mg | — | — | Comp. |
| | VS | 50 mg | | | |
| 118 | HMDTI | 200 mg | BI-4 | 2.50 g | Inv. |
| | VS | 50 mg | | | |
| 119 | HMDTI | 200 mg | BI-3 | 2.50 g | Inv. |
| | VS | 50 mg | | | |

TABLE 1-continued

| | Crosslinking Agent | | Image stabilizer | | |
|---|---|---|---|---|---|
| Sample | Compound | Amount*1 | Compound | Amount*1 | Remark |
| 120 | HMDTI | 200 mg | I-1 | 300 mg | Inv. |
| | VS | 50 mg | | | |
| 121 | HMDTI | 200 mg | I-33 | 300 mg | Inv. |
| | VS | 50 mg | | | |

*1Amount per $m^2$ of photothermographic material
*2HMDI: Hexamethylenediisocyanate
*3HMDTI: hexamethylenedithioisocyanate
*4VS: Vinylsulfon compound Measurement of Solvent Content of Film Film samples were each measured with respect to the solvent content. Thus, sample films each were cut to an area of 46.3 $cm^2$, further finely cut to about 5 mm, contained into a specified Bayern bottle, which was closely packed with septum and aluminum cap, and set to head space sampler HP769 (available Hewlett Pachard Co.), which was connected to gas chromatography (GC) Hewlett Packard type 5971 provided with a hydrogen flame ion detector (FID). Chromatograms were obtained under the measurement conditions including a head space sampler heating temperature of 120° C. for 20 min., a GC-introducing temperature of 150° C., column of DB-624 (available from J & W co.) and temperature-increasing of 45° C. (3 min.) to 100° C. at a rate of 8°/min. Solvents to be measure were methyl ethyl ketone and methanol. A given amount of each solvent, which was further diluted with butanol was contained into a Bayern bottle and subjected to the chromatographic measurement in a manner similar to above. Using a calibration curve prepared from the obtained chromatogram peak area, the solvent content of each film sample was determined.

Photothermographic material Samples 101 to 121 were aged under the condition A and measured according to the procedure described above. As a result, the solvent content thereof was within the range of 100 to 120 mg/$m^2$.

Exposure and Development

Samples each were subjected to laser scanning exposure from the emulsion side using an exposure apparatus having a light source of 800 to 820 nm semiconductor laser of longitudinal multi-mode, which was made by means of high frequency overlapping. In this case, exposure was conducted at an angle between the exposed surface and exposing laser light was 75° and in an atmosphere at a temperature of 23° C. and 50% RH (and as a result, images with superior sharpness were unexpectedly obtained, as compared to exposure at an angle of 90°). Using an automatic processor provided with a heated drum, subsequently, exposed samples were subjected to thermal development at 110° C. for 15 sec., while bringing the protective layer surface of the photosensitive material into μmcontact with the drum surface. The thermal development was conducted in an atmosphere at 23° C. and 50% RH.

Thermally developed samples each were subjected to sensitometry using a densitometer and evaluated with respect to a fog density (i.e., minimum density and denoted as Dmin) and sensitivity. The sensitivity was represented by a relative value of reciprocal of exposure necessary to give a density of Dmin plus 1.0, based on the sensitivity of Sample 1 being 100.

Storage Stability

Samples each were allowed to stand for a period of 7 days under the condition A or B described below and subjected to exposure and development, as described above.

Condition A: 25° C. and 55% RH.

Condition b: 40° C. and 80% RH

Images thus obtained were sensitometrically evaluated. The difference in the minimum density (also denoted as Dmin) between conditions A and B, i.e., Dmin(B)−Dmin(A) was determined as a measure of storage stability of unexposed photothermographic materials. Results thereof are shown in Table 2.

Image Lasting Quality

Samples were allowed to stand under the condition A for 7 days and then subjected to exposure and development in a manner similar to the above. Sample thus processed were further allowed to stand in an atmosphere at 25° C. and 55% RH under fluorescent lamps and after then, aged samples each were evaluated with respect to image tone, based on the following criteria:

5: No problem in image tone,

4: No problem in practical use in image tone,

3: Slightly yellowish but acceptable level,

2: Unfavored image tone and unacceptable level, and

1: Marked change observed and unacceptable level.

TABLE 2

| | Aged under Condition A, 7 days | | Storage | Image Lasting | |
|---|---|---|---|---|---|
| Sample | Fog | Sensitivity | Stability | Quality | Remark |
| 101 | 0.53 | 100 | 0.45 | 1 | Comp. |
| 102 | 0.45 | 105 | 0.38 | 1 | Comp. |
| 103 | 0.12 | 117 | 0.15 | 4 | Inv. |
| 104 | 0.11 | 120 | 0.13 | 4 | Inv. |
| 105 | 0.13 | 115 | 0.13 | 4 | Inv. |
| 106 | 0.10 | 122 | 0.12 | 4 | Inv. |
| 107 | 0.42 | 104 | 0.36 | 1 | Comp. |
| 108 | 0.11 | 117 | 0.14 | 4 | Inv. |
| 109 | 0.10 | 120 | 0.13 | 4 | Inv. |
| 110 | 0.11 | 118 | 0.15 | 4 | Inv. |
| 111 | 0.10 | 120 | 0.12 | 4 | Inv. |
| 112 | 0.39 | 105 | 0.33 | 1 | Comp. |
| 113 | 0.10 | 123 | 0.13 | 4 | Inv. |
| 114 | 0.09 | 125 | 0.10 | 5 | Inv. |
| 115 | 0.10 | 122 | 0.11 | 5 | Inv. |
| 116 | 0.08 | 127 | 0.09 | 5 | Inv. |
| 117 | 0.37 | 107 | 0.30 | 1 | Comp. |
| 118 | 0.09 | 128 | 0.10 | 5 | Inv. |
| 119 | 0.09 | 128 | 0.09 | 5 | Inv. |
| 120 | 0.09 | 125 | 0.09 | 5 | Inv. |
| 121 | 0.08 | 130 | 0.08 | 5 | Inv. |

As apparent from Table 2, inventive samples led to superior results not only in sensitivity but also in storage stability and image lasting quality.

Example 2

On a photosensitive layer side of a commercially available, biaxially stretched, thermally fixed and blue-tinted 175 μm PET film, subbing layers A-1 and A-2 were coated and subbing layers B-1 and B-2 were coated on the opposite side of the support in a manner similar to Example 1 to prepare a photographic support.

Photosensitive silver halide emulsion A and powdery organic silver salt A were prepared similarly to example 1 to prepare a photosensitive emulsion dispersing solution. Using these, photothermographic material Samples 201 to 221 were prepared similarly to Example 1, in which an image stabilizer represented by formula (1) or (2) and a crosslinking agent of an epoxy compound represented by formula (9) or an acid anhydride represented by formula (B) were used as shown in Table 3.

TABLE 3

| | Crosslinking Agent | | Image stabilizer | | |
|---|---|---|---|---|---|
| Sample | Compound | Amount*1 | Compound | Amount*1 | Remark |
| 201 | — | — | — | — | Comp. |
| 202 | EP-1 | 200 mg | — | — | Comp. |
| 203 | EP-1 | 200 mg | BI-4 | 2.50 g | Inv. |
| 204 | EP-1 | 200 mg | BI-3 | 2.50 g | Inv. |
| 205 | EP-1 | 200 mg | I-1 | 300 mg | Inv. |
| 206 | EP-1 | 200 mg | I-33 | 300 mg | Inv. |
| 207 | EP-9 | 200 mg | — | — | Comp. |
| 208 | EP-9 | 200 mg | BI-4 | 2.50 g | Inv. |
| 209 | EP-9 | 200 mg | BI-3 | 2.50 g | Inv. |
| 210 | EP-9 | 200 mg | I-1 | 300 mg | Inv. |
| 211 | EP-9 | 200 mg | I-33 | 300 mg | Inv. |
| 212 | EP-1 | 200 mg | — | — | Comp. |
| | B-11 | 50 mg | | | |
| 213 | EP-1 | 200 mg | BI-4 | 2.50 g | Inv. |
| | B-11 | 50 mg | | | |
| 214 | EP-1 | 200 mg | BI-3 | 2.50 g | Inv. |
| | B-11 | 50 mg | | | |
| 215 | EP-1 | 200 mg | I-1 | 300 mg | Inv. |
| | B-11 | 50 mg | | | |
| 216 | EP-1 | 200 mg | I-33 | 300 mg | Inv. |
| | B-11 | 50 mg | | | |
| 217 | EP-9 | 200 mg | — | — | Comp. |
| | B-11 | 50 mg | | | |
| 218 | EP-9 | 200 mg | BI-4 | 2.50 g | Inv. |
| | B-11 | 50 mg | | | |
| 219 | EP-9 | 200 mg | BI-3 | 2.50 g | Inv. |
| | B-11 | 50 mg | | | |
| 220 | EP-9 | 200 mg | I-1 | 300 mg | Inv. |
| | B-11 | 50 mg | | | |
| 221 | EP-9 | 200 mg | I-33 | 300 mg | Inv. |
| | B-11 | 50 mg | | | |

*1: Amount per $m^2$ of photothermographic material

Storage stability of unexposed photothermographic material samples and image stability of processed samples were evaluated similarly to Example 1. Results thereof are shown in Table 4. Sensitivity is represented by a relative value, based on the sensitivity of Sample 201 aged under the condition A being 100.

TABLE 4

| | Aged under Condition A, 7 days | | Storage | Image Lasting | |
|---|---|---|---|---|---|
| Sample | Fog | Sensitivity | Stability | Quality | Remark |
| 201 | 0.55 | 100 | 0.48 | 1 | Comp. |
| 202 | 0.47 | 108 | 0.41 | 1 | Comp. |
| 203 | 0.15 | 120 | 0.16 | 4 | Inv. |
| 204 | 0.13 | 122 | 0.13 | 4 | Inv. |
| 205 | 0.13 | 118 | 0.15 | 4 | Inv. |
| 206 | 0.12 | 124 | 0.14 | 4 | Inv. |
| 207 | 0.45 | 107 | 0.37 | 1 | Comp. |
| 208 | 0.13 | 120 | 0.16 | 4 | Inv. |
| 209 | 0.12 | 122 | 0.15 | 4 | Inv. |
| 210 | 0.14 | 118 | 0.16 | 4 | Inv. |
| 211 | 0.12 | 123 | 0.14 | 4 | Inv. |
| 212 | 0.39 | 105 | 0.33 | 1 | Comp. |
| 213 | 0.11 | 124 | 0.13 | 4 | Inv. |
| 214 | 0.10 | 125 | 0.12 | 5 | Inv. |
| 215 | 0.12 | 125 | 0.12 | 5 | Inv. |
| 216 | 0.10 | 130 | 0.12 | 5 | Inv. |
| 217 | 0.41 | 105 | 0.35 | 1 | Comp. |
| 218 | 0.11 | 128 | 0.13 | 5 | Inv. |
| 219 | 0.12 | 130 | 0.10 | 5 | Inv. |
| 220 | 0.10 | 126 | 0.11 | 5 | Inv. |
| 221 | 0.09 | 132 | 0.09 | 5 | Inv. |

As apparent from Table 4, inventive samples led to superior results not only in sensitivity but also in storage stabilty and image lasting quality.

Example 3

On a photosensitive layer side of a commercially available, biaxially stretched, thermally fixed and blue-tinted 175 μm PET film, subbing layers A-1 and A-2 were coated and subbing layers B-1 and B-2 were coated on the opposite side of the support in a manner similar to Example 1 to prepare a photographic support.

Photosensitive silver halide emulsion A and powdery organic silver salt A were prepared similarly to example 1 to prepare a photosensitive emulsion dispersing solution. Using these, photothermographic material Samples 301 to 321 were prepared similarly to Example 1, in which supersensitizer 5-methyl-2-mercaptobenzimidazole (M-4) was contained or not, and an image stabilizer represented by formula (1) or (2) and a crosslinking agent were used as shown in Table 5.

TABLE 5

| | Crosslinking Agent & Supersensitizer | | Image stabilizer | | |
|---|---|---|---|---|---|
| Sample | Compound | Amount*1 | Compound | Amount*1 | Remark |
| 301 | — | — | — | — | Comp. |
| 302 | HMDI*2 | 200 mg | — | — | Comp. |
| 303 | HMDI | 200 mg | BI-4 | 2.50 g | Inv. |
| 304 | HMDI | 200 mg | BI-3 | 2.50 g | Inv. |
| 305 | HMDI | 200 mg | I-1 | 300 mg | Inv. |
| 306 | HMDI | 200 mg | I-33 | 300 mg | Inv. |
| 307 | HMDTI*3 | 200 mg | — | — | Comp. |
| 308 | HMDTI | 200 mg | BI-4 | 2.50 g | Inv. |
| 309 | HMDTI | 200 mg | BI-3 | 2.50 g | Inv. |
| 310 | HMDTI | 200 mg | I-1 | 300 mg | Inv. |
| 311 | HMDTI | 200 mg | I-33 | 300 mg | Inv. |
| 312 | HMDI | 200 mg | — | — | Comp. |
| | M-4*4 | 50 mg | | | |
| 313 | HMDI | 200 mg | BI-4 | 2.50 g | Inv. |
| | M-4 | 50 mg | | | |
| 314 | HMDI | 200 mg | BI-3 | 2.50 g | Inv. |
| | M-4 | 50 mg | | | |
| 315 | HMDI | 200 mg | I-1 | 300 mg | Inv. |
| | M-4 | 50 mg | | | |
| 316 | HMDI | 200 mg | I-33 | 300 mg | Inv. |
| | M-4 | 50 mg | | | |
| 317 | HMDTI | 200 mg | — | — | Comp. |
| | M-4 | 50 mg | | | |
| 318 | HMDTI | 200 mg | BI-4 | 2.50 g | Inv. |
| | M-4 | 50 mg | | | |
| 319 | HMDTI | 200 mg | BI-3 | 2.50 g | Inv. |
| | M-4 | 50 mg | | | |
| 320 | HMDTI | 200 mg | I-1 | 300 mg | Inv. |
| | M-4 | 50 mg | | | |
| 321 | HMDTI | 200 mg | I-33 | 300 mg | Inv. |
| | M-4 | 50 mg | | | |

*1Amount per $m^2$ of photothermographic material
*2HMDI: Hexamethylenediisocyanate
*3HMDTI: hexamethylenedithioisocyanate
*4M-4: 5-methyl-2-mercaptobenzimidazole Storage stability of unexposed photothermographic material samples and image stability of processed samples were evaluated similarly to Example 1, provided that Sample were aged for a period of 9 days. Results thereof are shown in Table 6. Sensitivity is represented by a relative value, based on the sensitivity of Sample 301 aged under the condition A being 100.

TABLE 6

| | Aged under Condition A, 9 days | | Storage | Image Lasting | |
|---|---|---|---|---|---|
| Sample | Fog | Sensitivity | Stability | Quality | Remark |
| 301 | 0.58 | 20 | 0.55 | 1 | Comp. |
| 302 | 0.48 | 25 | 0.50 | 1 | Comp. |
| 303 | 0.17 | 23 | 0.25 | 3 | Inv. |
| 304 | 0.16 | 25 | 0.23 | 3 | Inv. |
| 305 | 0.18 | 23 | 0.25 | 3 | Inv. |
| 306 | 0.15 | 30 | 0.22 | 3 | Inv. |
| 307 | 0.45 | 25 | 0.45 | 1 | Comp. |
| 308 | 0.15 | 23 | 0.24 | 3 | Inv. |
| 309 | 0.15 | 25 | 0.23 | 3 | Inv. |
| 310 | 0.16 | 23 | 0.25 | 3 | Inv. |
| 311 | 0.22 | 28 | 0.23 | 3 | Inv. |
| 312 | 0.40 | 100 | 0.35 | 2 | Comp. |
| 313 | 0.10 | 125 | 0.14 | 4 | Inv. |
| 314 | 0.10 | 125 | 0.12 | 5 | Inv. |
| 315 | 0.10 | 122 | 0.11 | 5 | Inv. |
| 316 | 0.09 | 128 | 0.10 | 5 | Inv. |
| 317 | 0.37 | 107 | 0.30 | 1 | Comp. |
| 318 | 0.09 | 128 | 0.10 | 5 | Inv. |
| 319 | 0.09 | 128 | 0.09 | 5 | Inv. |
| 320 | 0.10 | 127 | 0.09 | 5 | Inv. |
| 321 | 0.09 | 135 | 0.09 | 5 | Inv. |

As apparent from Table 6, inventive samples led to superior results not only in sensitivity but also in storage stability and image lasting quality.

Example 4

Photothermographic material samples 401 to 411 were prepared similarly to Example 1, except that infrared-sensitizing dye S-43 was replaced by an infrared-sensitizing dye as shown in Table 7 (in an amount of $5\times10^{-4}$ mol).

Dye-A

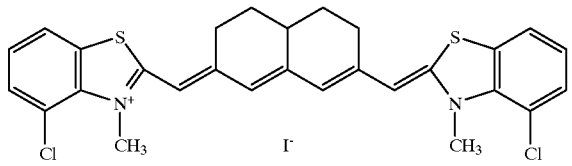

Dye-B

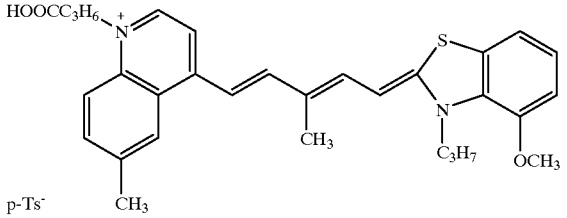

Dye-C

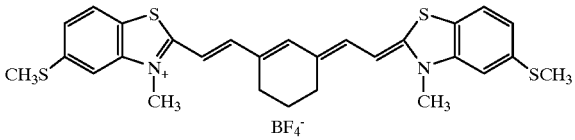

Thus, the following cross-linking agent and image stabilizer were added, based on the formulation of Sample 102, i.e., crosslinking agent hexamethylenediisocyanate, 0.6 g of BI-6 and 0.1 g of I-33 as compounds generating a labile species other than a halogen atom, 0.2 g of 4-38 as a halogen generating compound were incorporated. Samples thus prepared were evaluated similarly to Examples 1, 2 and 3, provided that samples were aged for a period of 9 days. Results thereof are shown in Table 7.

TABLE 6

| Sample | Infra-Red Dye | Aged under Condition A, 9 days Fog | Sensitivity | Storage Stability | Image Lasting Quality | Remark |
|---|---|---|---|---|---|---|
| 401 | Dye-A | 0.21 | 100 | 0.25 | 3 | Inv. |
| 402 | Dye-B | 0.27 | 105 | 0.30 | 3 | Inv. |
| 403 | Dye-C | 0.17 | 45 | 0.20 | 3 | Inv. |
| 404 | S-11 | 0.10 | 117 | 0.13 | 5 | Inv. |
| 405 | S-13 | 0.11 | 123 | 0.12 | 5 | Inv. |
| 406 | S-16 | 0.12 | 120 | 0.13 | 5 | Inv. |
| 407 | S-27 | 0.13 | 125 | 0.16 | 5 | Inv. |
| 408 | S-43 | 0.09 | 130 | 0.10 | 5 | Inv. |
| 409 | S-49 | 0.08 | 127 | 0.09 | 5 | Inv. |
| 410 | S-64 | 0.09 | 128 | 0.11 | 5 | Inv. |
| 411 | S-68 | 0.10 | 125 | 0.12 | 5 | Inv. |

In the Table, sensitivity was represented by a relative value, based the sensitivity of sample 401 being 100. Although improvements in storage stability are commonly expressed in systems containing various infrared-sensitizing dyes, as can be seen from Table 7, it was proved that the effects are marked in specified dyes.

Example 5

Photothermographic material samples 501 to 516 were prepared similarly to sample 1 of Example 1, except that the amount of antifoggant 2 solution was increased from 5.47 ml to 8.0 ml and a crosslinking agent was varied as shown in Table 8. After being aged under the condition A (denoted as Aging-A) or aged under the condition B (denoted as Aging-B), samples were exposed and processed similarly to Example 1, and evaluated with respect to sensitivity (denoted as S) and fogging (denoted as Fog). Sensitivity was represented by a relative value, based on the sensitivity of sample 501 aged un condition B being 100. Results thereof are shown in Table 8.

TABLE 8

| Sample | Acid Anhydride (mg/m$^2$) | Aging-A Fog | S | Aging-B Fog | S | Remark |
|---|---|---|---|---|---|---|
| 501 | | 0.150 | 102 | 0.300 | 100 | Comp |
| 502 | Tetrachlorophthalic acid anhydride (100) | 0.080 | 100 | 0.100 | 80 | Comp |
| 503 | Tetrachlorophthalic acid anhydride (200) | 0.040 | 25 | 0.055 | 10 | Comp |
| 504 | Cis-1,2-cyclohexane-dicarboxylic acid anhydride (100) | 0.060 | 102 | 0.065 | 100 | Inv. |
| 505 | Cis-1,2-cyclohexane-dicarboxylic acid anhydride (200) | 0.040 | 97 | 0.042 | 98 | Inv. |
| 506 | Trans-1,2-cyclohexane-dicarboxylic acid anhydride (100) | 0.055 | 102 | 0.055 | 102 | Inv. |
| 507 | Trans-1,2-cyclohexane-dicarboxylic acid anhydride (200) | 0.030 | 100 | 0.030 | 100 | Inv. |
| 508 | Succinic acid anhydride (100) | 0.070 | 100 | 0.078 | 95 | Inv. |

TABLE 8-continued

| Sample | Acid Anhydride (mg/m$^2$) | Aging-A Fog | S | Aging-B Fog | S | Remark |
|---|---|---|---|---|---|---|
| 509 | Succinic acid anhydride (200) | 0.045 | 95 | 0.046 | 90 | Inv. |
| 510 | Glutaric acid anhydride (200) | 0.050 | 93 | 0.060 | 90 | Inv. |
| 511 | N-carboxybenzyloxy-L-asparagic acid anhydride (200) | 0.040 | 95 | 0.040 | 93 | Inv. |
| 512 | 1,2-Cyclopentanedi-carboxlic acid anhydride (200) | 0.043 | 93 | 0.045 | 90 | Inv. |
| 513 | 1,2,3,6-Tetrahydro-phthalic acid anhydride (200) | 0.042 | 98 | 0.045 | 95 | Inv. |
| 514 | 3,4,5,6-tetrahydro-phthalic acid anhydride (200) | 0.045 | 98 | 0.050 | 95 | Inv. |
| 515 | Maleylated methylcyclo-hexenetetrabasic acid anhydride (200) | 0.040 | 100 | 0.040 | 95 | Inv. |
| 516 | Endo-methylenetetra-hydrophthalic acid anhydride (200) | 0.046 | 102 | 0.047 | 98 | Inv. |

As can be seen from Table 8, samples containing no atic carboxylic acid anhydride exhibited high fogging, particularly when aged under condition B. Further, comparative samples by use of tetrachlorophthalic acid exhibited markedly reduced sensitivity when aged under condition B. In contrast thereto, it was proved that inventive samples by use of an aliphatic carboxylic acid exhibited little increase in fogging and little reduction in sensitivity.

What is claimed is:

1. A photothermographic material comprising a non-photosensitive organic silver salt, a photosensitive silver halide, a reducing agent, a binder and a cross-linking agent; the photothermographic material further comprising a compound capable of generating a labile species other than a halogen atom upon exposure to ultraviolet radiation or visible radiation to deactivate the reducing agent, said compound is a biimidazolyl compound represented by the following formula (1) or an iodonium compound represented by the following formula (2):

formula [1]

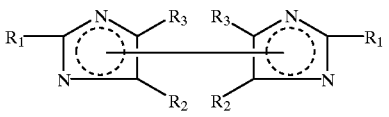

wherein $R_1$, $R_2$ and $R_3$ each are an alkyl group, an alkenyl group, an alkoxy group, an aryl group, hydroxy, a halogen atom, an aryloxyl group, an alkylthio group, an arylthio group, an acyl group, a sulfonyl group, an acylamino group, sulfonylamino group, an acyloxy group, carboxy, cyano, a sulfo group, or an amino group;

formula [2]

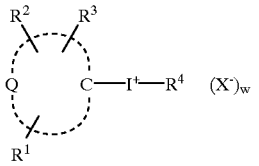

wherein Q is a group of atoms necessary to complete a 5-, 6-, or 7-membered ring, and the atoms being selected from a carbon atom, nitrogen atom, oxygen atom and sulfur atom; $R^1$, $R^2$ and $R^3$ each are a hydrogen atom, an alkyl group, an alkenyl group, an alkoxy group, an aryl group, hydroxy, a halogen atom, an aryloxyl, an alkylthio group, an arylthio group, an acyl group, a sulfonyl group, an acylamino group, sulfonylamino group, an acyloxy group, a carboxy group, a cyano group, a sulfo group, or an amino group, provided that $R^1$, $R^2$ and $R^3$ may be bonded with each other to form a ring; $R^4$ is a carboxylate group or $O^-$; W is 0 or 1, provided that when $R^3$ is a sulfo group or a carboxy group, W is 0 and $R^4$ is $O^-$; $X^-$ is an anionic counter ion.

4. The photothermographic material of claim 1, wherein the silver halide is spectrally sensitized with a sensitizing dye in the presence of a mercapto compound.

5. The photothermographic material of claim 1, wherein the silver halide is sensitized with an infrared sensitizing dye.

6. The photothermographic material of claim 1, wherein the crosslinking agent is selected from the group consisting of an epoxy compound, an acid anhydride, isocyanate compound and an isothiocyanate compound.

7. The photothermographic material of claim 1, wherein the photothermographic material further comprises a compound capable of generating a halogen atom as a labile species upon exposure to ultraviolet radiation or visible radiation.

8. The photothermographic material of claim 1, wherein the amount of the compound capable of generating a labile species other than a halogen atom is 0.001 to 0.1 mol/$m^2$.

9. The photothermographic material of claim 1, wherein the amount of the reducing agent is $1\times10^{-2}$ to 10 mol per mol of silver contained in the photothermographic material.

10. The photothermographic material of claim 4, wherein the infrared sensitizing dye is represented by the following formulas (1) to (4):

Formula (1)

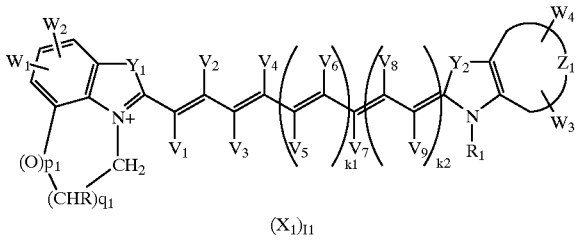

Formula (2)

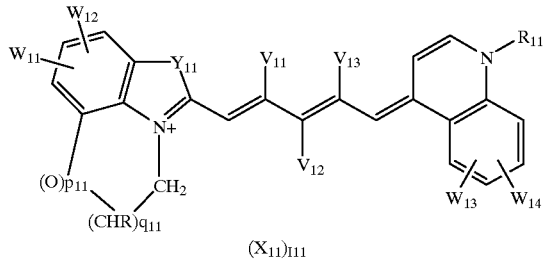

Formula (3)

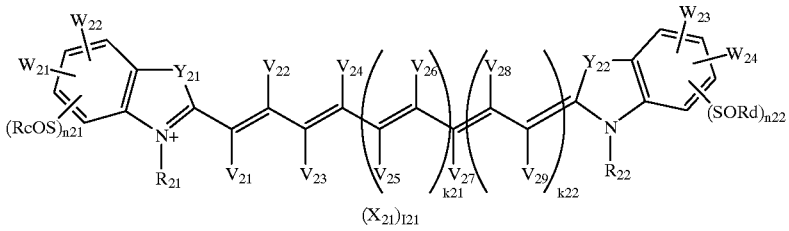

Formula (4)

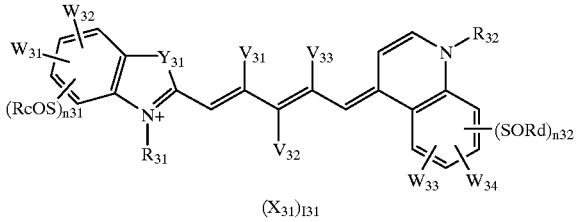

2. The photothermographic material of claim 1, wherein the compound capable of generating a labile species other than a halogen atom is a biimidazolyl compound.

3. The photothermographic material of claim 1, wherein the compound capable of generating a labile species other than a halogen atom is an iodonium compound.

wherein $Y_1$, $Y_2$, $Y_{11}$, $Y_{22}$ and $Y_{31}$ each are independently an oxygen atom, a sulfur atom, a selenium atom, —C(Ra)(Rb)— group or —CH═CH— group, in which Ra and Rb each are a hydrogen atom, an alkyl group or a non-metallic atom group necessary to form an aliphatic spiro ring; $Z_1$ is a non-metallic atom group necessary to form a 5- or 6-membered ring; R is a hydrogen atom, a lower alkyl group, a cycloalkyl group, an aralkyl group, a lower alkoxy group, an aryl group, a hydroxy group or a halogen atom; $R_1$, $R_{11}$, $R_{21}$, $R_{22}$, $R_{31}$ and $R_{32}$ each are an aliphatic group or a non-metallic atom group necessary to form a condensed ring between $R_1$ and $W_3$ or between $R_{11}$ and $W_{14}$; Rc and Rd each are independently an unsubstituted lower alkyl group, a cycloalkyl group, an aralkyl group, an aryl group or a heterocyclic group; $W_1$, $W_2$, $W_3$, $W_4$ $W_{11}$, $W_{12}$, $W_{13}$, $W_{14}$, $W_{21}$, $W_{22}$, $W_{23}$, $W_{24}$, $W_{31}$, $W_{32}$, $W_{33}$, and $W_{34}$ each are independently a hydrogen atom, a substituent or a non-metallic atom group necessary to form a condensed ring by bonding between $W_1$ and $W_2$, $W_{11}$ and $W_{12}$, $W_{21}$ and $W_{22}$, $W_{23}$ and $W_{24}$, $W_{31}$ and $W_{32}$, or $W_{33}$ and $W_{34}$; $V_1$ to $V_9$, $V_{11}$ to $V_{13}$, $V_{21}$ to $V_{29}$, and $V_{31}$ to $V_{33}$ each are independently a hydrogen atom, a halogen atom, an amino group, an alkylthio group, an arylthio group, a lower alkyl group, a lower alkoxyl group, an aryl group, an aryloxyl group, a heterocyclic group or a non-metallic atom group necessary to form a 5- to 7-membered ring by bonding between $V_1$ and $V_3$, $V_2$ and $V_4$, $V_3$ and $V_5$, $V_2$ and $V_6$, $V_5$ and $V_7$, $V_6$ and $V_8$, $V_7$ and $V_9$, $V_{11}$ and $V_{13}$, $V_{21}$ and $V_{23}$, $V_{22}$ and $V_{24}$, $V_{23}$ and $V_{25}$, $V_{24}$ and $V_{26}$, $V_{25}$ and $V_{27}$, $V_{26}$ and $V_{28}$, $V_{27}$ and $V_{29}$, or $V_{31}$ and $V_{33}$; $X_{21}$ and $X_{31}$, provided that at least one of $V_1$ to $V_9$ and at least one of $V_{11}$ to $V_{13}$ are a group other than a hydrogen atom; $X_1$, $X_{11}$, $X_{21}$ and $X_{31}$, each are an ion necessary to compensate for an intramolecular charge; 11, 111, 121 and 131 each an ion necessary to compensate for an intramolecular charge; k1, k2, k31 and k32 each are 0 or 1; n21, n22, n31 and n32 each are 0, 1 or 2, provided that n1 and n22, and n31 and n32 are not 0 at the same time; p1 and p11 are each 0 or 1; q1 and q11 each are 1 or 2, provided that the sum of p1 and q1 and the sum of p11 and q11 each are respectively not more than 2.

11. The photothermographic material of claim 3, wherein the mercapto compound is represented by the following formula A or B Ar—SM formula A Ar—S—S—Ar formula B wherein Ar is an aromatic ring or condensed aromatic ring containing a nitrogen atom, oxygen atom, sulfur atom, selenium atom or tellurium atom; and M is a hydrogen atom or an alkali metal atom.

12. The photothermographic material of claim 11, wherein the mercapto compound is contained in an amount of 0.001 to 1.0 mol per mol of silver.

13. The photothermographic material of claim 1 is prepared by coating a photosensitive composition comprising the non-photosensitive organic silver salt, the photosensitive silver halide, the reducing agent, the binder, and the cross-linking agent of 0.001 to 2 mol per mol of silver.

14. The photothermographic material of claim 1, wherein the amount of the compound capable of generating a labile species other than a halogen atom is 0.001 to 0.1 mol/$m^2$; and the amount of the reducing agent being $1\times10^{-2}$ to 10 mol per mol of silver contained in the photothermographic material; the total amount of the organic silver salt and silver halide, based on silver, being 0.5 to 2.2 g/$m^2$; and the amount of the binder being 1.5 to 6 g/$m^2$.

15. The photothermographic material of claim 14, wherein the silver halide is sensitized with an infrared sensitizing dye as claimed in claim 13.

16. A method for preparing a photothermographic material comprising:

preparing a photosensitive composition containing a non-photosensitive organic silver salt, a photosensitive silver halide, a reducing agent, a binder and a cross-linking agent, and coating the photosensitive composition on a support, wherein the photosensitive composition further contains a compound capable of generating a labile species other than a halogen atom upon exposure to ultraviolet radiation or visible radiation, said compound is a biimidazolyl compound represented by the following formula (1) or an iodonium compound represented by the following formula (2):

formula [1]

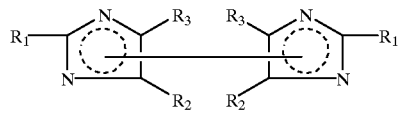

wherein $R_1$, $R_2$ and $R_3$ each are an alkyl group, an alkenyl group, an alkoxy group, an aryl group, hydroxy, a halogen atom, an aryloxyl group, an alkylthio group, an arylthio group, an acyl group, a sulfonyl group, an acylamino group, sulfonylamino group, an acyloxy group, carboxy, cyano, a sulfo group, or an amino group;

formula [2]

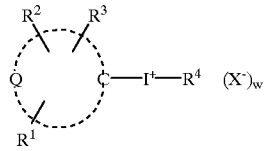

wherein Q is a group of atoms necessary to complete a 5-, 6-, or 7-membered ring, and the atoms being selected from a carbon atom, nitrogen atoms, oxygen atom and sulfur atom; $R^1$, $R^2$ and $R^3$ each are a hydrogen atom, an alkyl group, an alkenyl group, an alkoxy group, an aryl group, hydroxy, a halogen atom, an aryloxyl, an alkylthio group, an arylthio group, an acyl group, a sulfonyl group, an acylamino group, sulfonylamino group, an acyloxy group, a carboxy group, a cyano group, a sulfo group, or an amino group, provided that $R^1$, $R^2$ and $R^3$ may be bonded with each other to form a ring; $R^4$ is a carboxylate group or $O^-$; W is 0 or 1, provided that when $R^3$ is a sulfo group or a carboxy group, W is 0 and $R^4$ is $O^-$; $X^-$ is an anionic counter ion.

* * * * *